United States Patent [19]

Hall et al.

[11] 4,405,985

[45] Sep. 20, 1983

[54] GUIDANCE COMPUTER

[75] Inventors: Eldon C. Hall, Wollaston; Harold H. Seward; Joseph D. Sabo, both of Arlington; Vincent R. De Marco, Reading, all of Mass.; Millard B. Prisant, Bayside, N.Y.

[73] Assignee: The United States of America as represented by the Secretary of the Navy, Washington, D.C.

[21] Appl. No.: 502,689

[22] Filed: Oct. 22, 1965

[51] Int. Cl.[3] ..... G06F 15/14

[52] U.S. Cl. ..... 364/423; 364/457; 364/453; 367/89

[58] Field of Search ..... 235/150.2, 150.25, 150.27, 235/152; 364/423, 457, 453; 367/89

[56] References Cited

U.S. PATENT DOCUMENTS

| | | | |
|---|---|---|---|
| 2,835,131 | 5/1958 | Vacquier | 74/5.37 |
| 2,865,579 | 12/1958 | Caillette | 244/52 |
| 2,932,467 | 4/1960 | Scorgie | 244/3.15 |
| 2,944,426 | 7/1960 | Amara | 74/5.34 |
| 3,271,565 | 9/1966 | Blackman | 364/459 |

*Primary Examiner*—Nelson Moskowitz

[57] ABSTRACT

A digital computer for guiding the flight of a ballistic missile through the instrumentation of a Q Matrix. The computer may be described as being the digital counterpart of a mechanical differential analyzer in that it is made up of a number of appropriately interconnected integrators which generate the solution of the particular equation or set of equations being solved. An initial value of velocity-to-be-gained is inserted into the computer and then by means of accelerometer outputs, multipliers, adders and integrators, samples of the missile's velocity are compared with the velocity-to-be-gained to generate output signals to control or guide the trajectory of the missile during its powered flight.

8 Claims, 77 Drawing Figures

PULSE GENERATOR WAVEFORMS

OSCILLATOR SYNC. CIRCUIT WAVEFORMS

OSCILLATOR SYNC. CIRCUIT WAVEFORMS

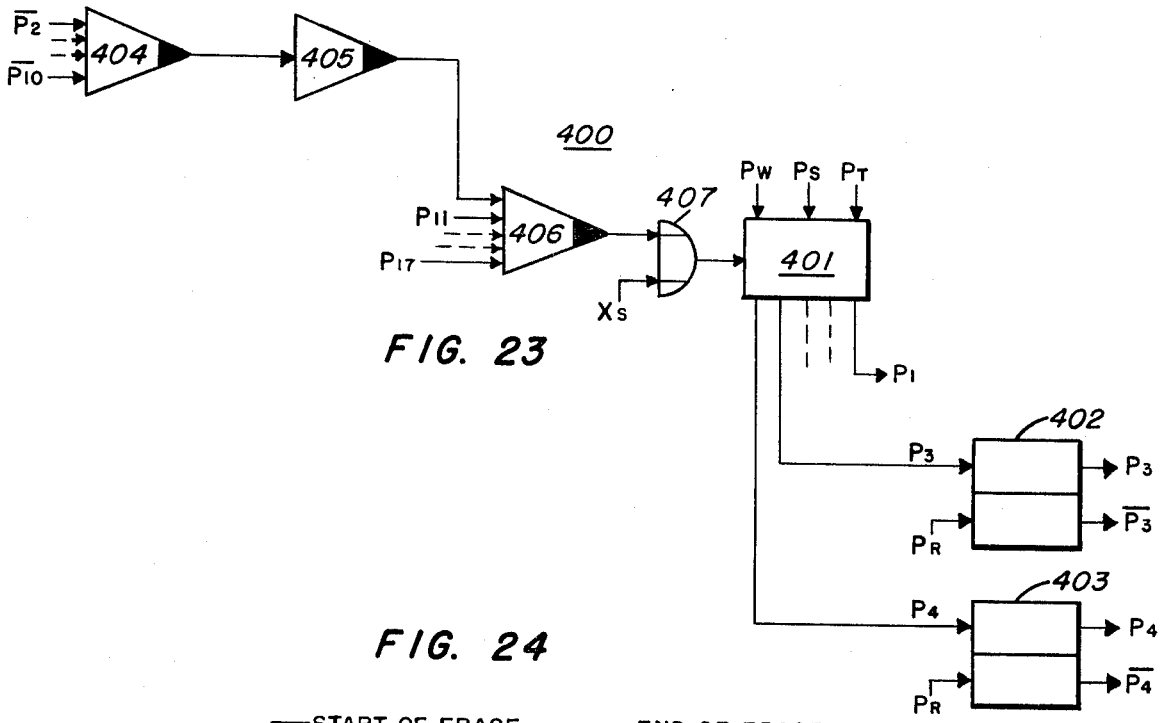
FIG. 23
FIG. 24
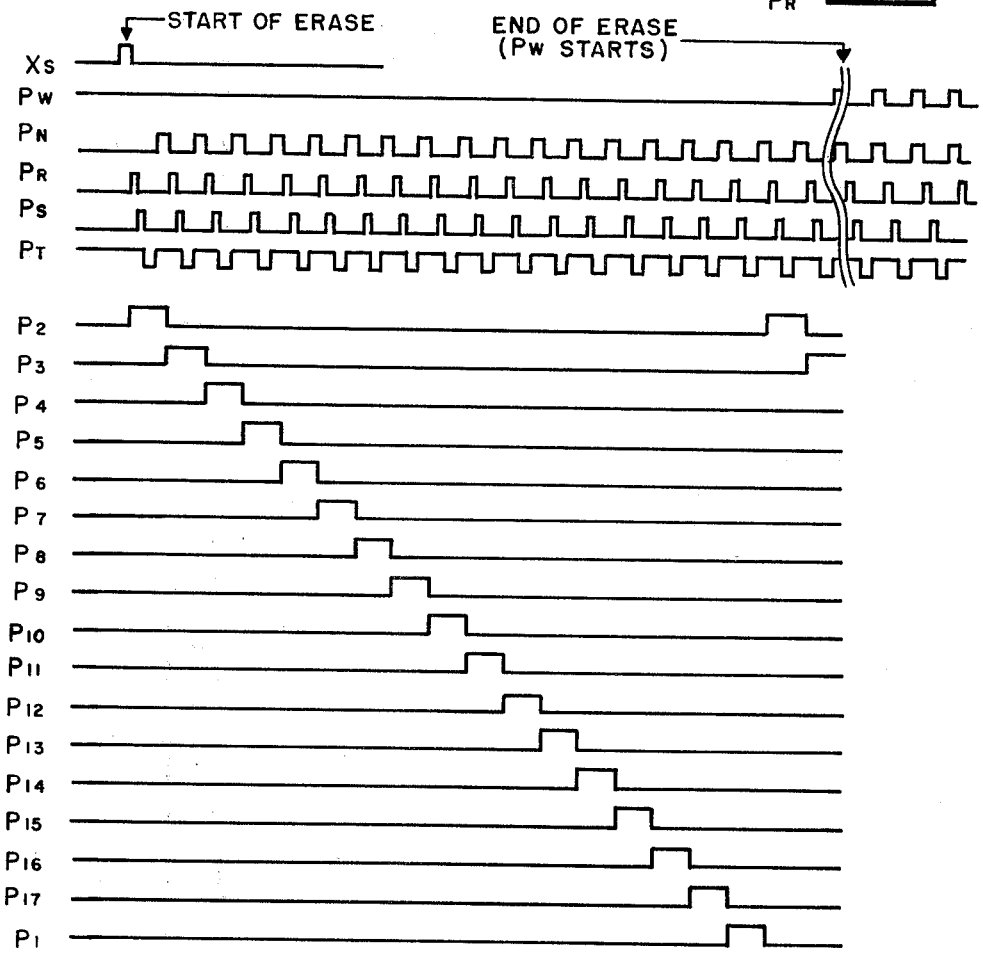
PULSE GENERATOR WAVEFORMS

FIG. 31
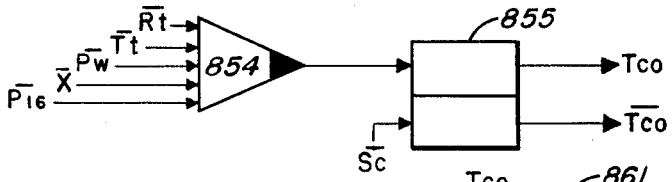
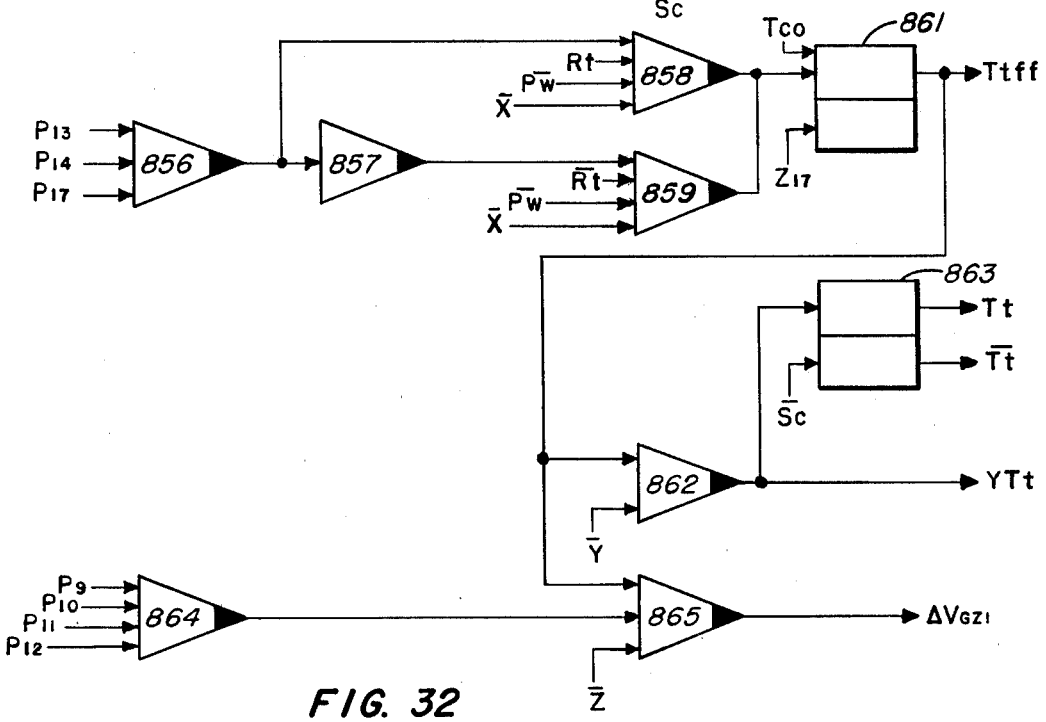
FIG. 32
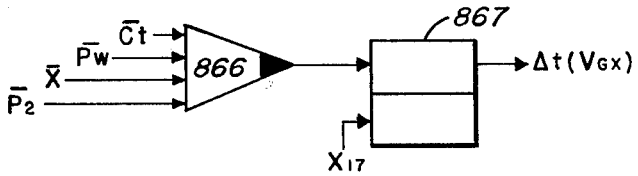
FIG. 33
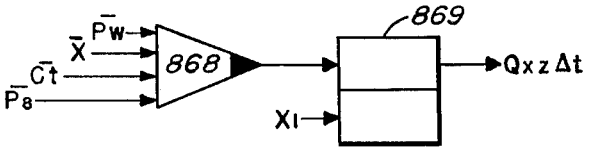
FIG. 34

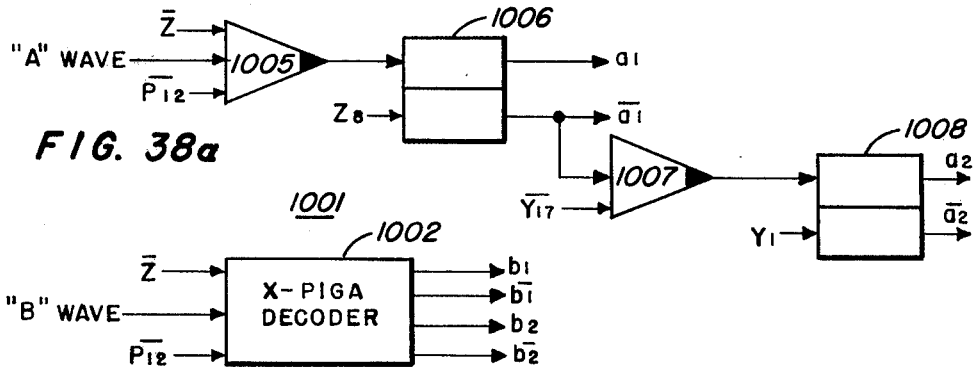
FIG. 38a
FIG. 38b
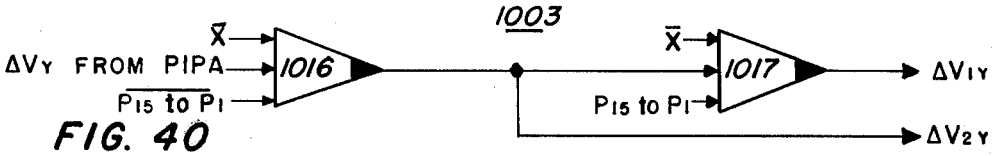
FIG. 40
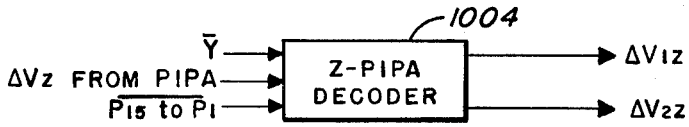
FIG. 41
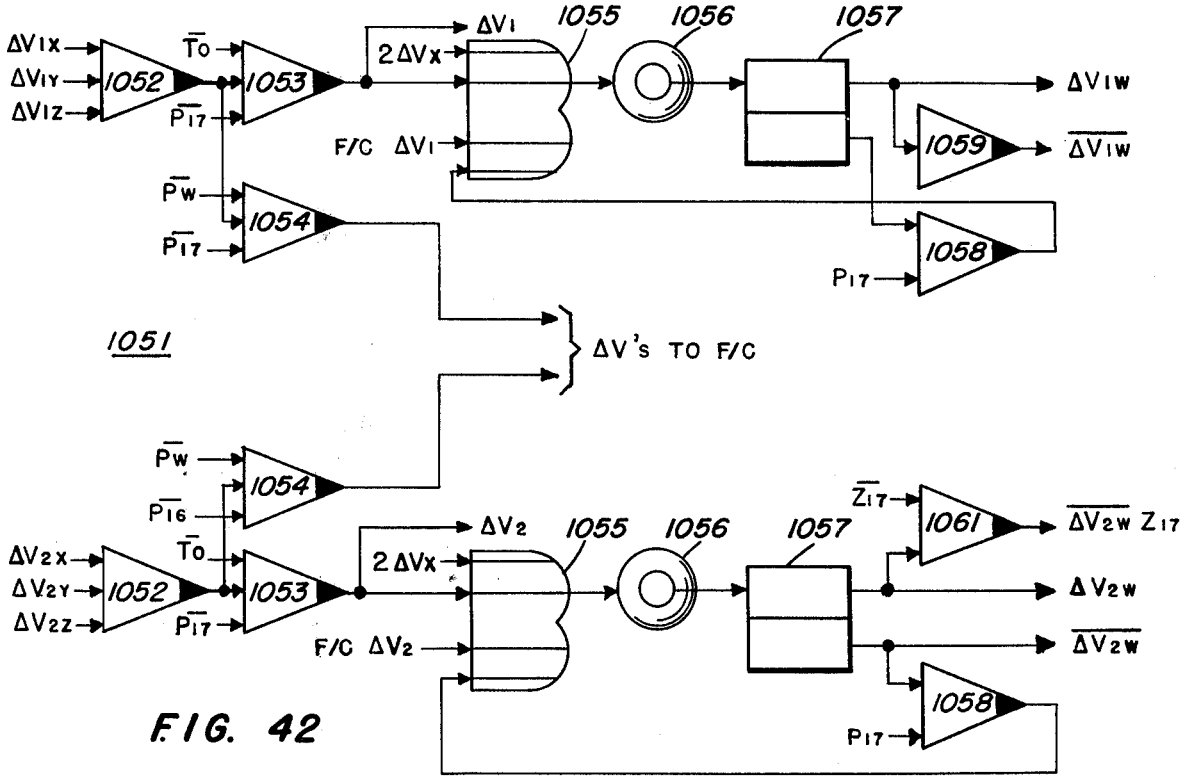
FIG. 42

GUIDANCE COMPUTER

The present invention relates generally to digital guidance computers and more particularly to digital guidance computers for use in ballistic missiles and the like.

A ballistic missile is one in which the majority of the flight trajectory is unpowered and unguided. The guided and powered portion of flight may be likened to that portion of flight of an artillery projectile within the gun barrel; and the ballistic flight portion is similar to the projectile's flight from the time it leaves the gun barrel to the time of impingement upon the target. If all missles were aerodynamically perfect, if all external factors governing flight were exactly the same, and if all launches were made under the exact same condition, a timer would be the only guidance device necessary in launching a ballistic missile. The timer could function to cut off the thrust from the missile's engines after a specific time of flight, thus enabling the ballistic trajectory to carry the missile from the time the engines are cut off, the muzzle of an imaginary gun barrel of powered flight, to the target area. But, because of variations in engine thrust, missile weight, aerodynamic qualities, wind, atmospheric conditions and other variables; the time required for powered flight and the point in space of ending such flight varies from launch to launch necessitating a sophisticated system for guiding a missile during its powered flight phase.

Conventionally, guidance has been accomplished by some sort of ground control. To indicate the actual position of the missile and its desired position, the receipt and transmission of information from the ground is required in the form of radio or radar waves, or in the form of a visual signal. An inertial guidance system is unique in that it is completely self-contained; that is, changes in motion of the vehicle are sensed and utilized within the missile itself, eliminating the need for transmission of signals from vehicle to ground and ground to vehicle.

An inertial guidance system basically consists of: (1) an inertial platform upon which are mounted accelerometers, devices which sense changes in velocity; that is, the acceleration of the missile; and (2) a computer to which output signals from the accelerometers are fed, mathematically operating upon these signals, and generating output signals to control or guide the trajectory of the missile during powered flight.

Copending Application, Ser. No. 502,717 filed on Oct. 22, 1965 for Guidance System by Eldon C. Hall et al., further identified as Navy Case No. 30341, is typical of the environment in which the present invention may find utility. The system of Application, Ser. No. 502,717 is intended, however, merely as an example of one of many systems in which the present invention may be used and it should be understood that the present invention is in no way restricted to use in this system alone. Although the Guidance System of Application, Ser. No. 502,717 is completely disclosed therein, a brief summary of that system and a description of the missile of which the system forms a part is included herein to facilitate ease of understanding and continuity of the disclosure of the present invention.

The missile referred to hereinbefore is of the ballistic variety designed to be fired from a land position, a surface ship, a fixed submerged position or a submerged vessel. A two-staged rocket motor propels the missile during the powered portion of flight. Thereafter, it enters a free-fall or ballistic flight mode, impinging upon a preselected target area. In order that the launch area position be undisclosed to the enemy, the launch vehicle, for example, a submarine traveling underwater, should be required not to transmit external signals. An all inertial navigation system avoids transmission of signals between ship and missile. Alignment of the fire control system is accomplished prior to sailing. The missile uses an all inertial guidance system having a stable platform which is pre-aligned to the extremely accurate inertial reference of the ship's navigation system. Since communication between the ship and the launched missile is unnecessary, both the ship and the missile are better able to remain undetected.

The guidance system uses "correlated velocity" computations making it unnecessary to compute the position of the missile at any time during flight.

Basically, the missile senses changes in velocity, compares these changes with programmed changes for a particular trajectory, and computes a velocity to be gained in the form of $$Vg = Vc - Vm \tag{1}$$

where:

Vg is the velocity to be gained;

Vc is the computed or correlated velocity; and Vm is the actual velocity of the missile. When the velocity to be gained equals zero, (or $$Vg = 0 \tag{2}$$

substitute equation (2) into equation (1)

$$Vc = Vm \tag{3}$$

the missile is in the correct trajectory to ballistically fall to earth and impinge upon the target area. Using this approach and a carefully preselected axis set, it is unnecessary to compute the velocity vectors due to gravitational force or target position vectors.

Mounted upon the stable platform are three gyroscopes which determine the inertial reference frame and keep the platform in a stable position relative to such frame, and three velocity sensing gyros or accelerometers which sense the missile's actual velocities (Vm) rerlative to the programmed velocities (Vc). Each velocity sensed has three scalar components, one along each of the three missile axes; therefore, there are three equations for the computation of each velocity to be gained (Vg), one for each attitude.

These equations are derived in copending Application, Ser. No. 343,552, filed Oct. 22, 1965 and will be reproduced herein below.

Traditionally, guidance systems have employed analog computation devices either wholly electrical, wholly mechanical or electromechanical, in which the parameters to be operated upon, continually varying parameters, are translated into quantities directly proportional to these parameters. Such quantities may be the rotation of a shaft, movement of a linkage, or amplitude of a voltage or current. These quantities are operated upon continually and simultaneously to give a real-time solution which may be fed directly to a control system. Because of the direct relationship between measured parameters and quantities to be operated upon; analog devices are usually elementary in construction and hence, inexpensive, light weight, and reliable. Digital computers operate on numerical representations of measured parameters and hence, have no real-time relationship to the parameters represented by the numerical quantities. Further, in the past, digital computers have been complex and costly, and have necessitated the use of analog to digital, and digital to analog converters to translate the measured parameters into numerical data and then back to analog quantities.

With the requirement for more sophisticated guidance systems, the need for greater accuracy in guidance computers is paramount. Converters have been developed with finer resolution and with the ability to operate at greater speeds. Semi-conductor and other solid state circuit techniques have vastly reduced the size and weight, and increased the reliability of digital computers. Development of the digital differential analyzer, counterpart of the mechanical analyzer, has been an extremely significant art advance.

While analog computers operate in only one mode, a typical example being servo-loop correction computation; the in-flight digital computer of the present invention is used for navigation and steering computation, stability computation, pre-flight check-out and alignment, performance monitoring and telemetering (in test flights), multimode flight control, staging control, thrust cut-off computation and pre-arming computation.

The present invention provides a realtime, incremental wired program, digital in-flight guidance computer for use in the guidance loop of a multimode ballistic missile.

The computer of the present invention, in conjunction with a computer located in the fire control system, performs many and varied functions prior to launch, during launch phase, and during flight. Basically, the computer undergoes a complete checkout in conjunction with the fire control system and before firing procedure begins. During firing procedure and as a part thereof, two separate operations are performed; firing alignment process and storage and checkout of initial conditions read into the computer from the fire control unit. During the flight mode, the computer functions include the launch mode, pitch program which includes staging corrections and staging, pre-arm and cut-off.

Computer checkout is a test of all computer functions, simulation of the prelaunch phase in the specific sequence of events as those followed during prelaunch procedure is accomplished, and an erase signal is transmitted from the fire control to clear all of the storage registers. The Vg's are fed into the computer modified therein and read back to the fire control computer. Similarly, the other constants to be stored are fed into the computer and then are read back from the computer to the fire control system for checking. This completes the computer checkout procedure and the launch simulation is ready.

The fire control system simulates the launch signal and furnishes simulated pulses indicative of velocity changes to the computer for a flight phase check. During this test, the velocity to be gained signals are monitored so that their values at occurrence of the cut-off signal are available for checking and testing. The timing command signals, steering commands, pre-arm and cut-off signals are monitored to assure proper operation of the guidance system. The erection and alignment process of the inertial reference platform is accomplished prior to launch in order to weigh the stable platform with respect to an inertial axis and the axis formed by the computer frame. Since the missile rests in the launch tube of the cruising submarine, this necessitates that the stabilized member of the axis of the accelerometer, which is mounted thereon and which will have assumed some haphazard orientation, be aligned. The coarse alignment process aligns the stable member with respect to the axis divided by the missile frame. Since the missile itself may not be aligned in such a manner that the stable platform establish a true horizontal reference inertially, the fine alignment process is necessary.

The fine alignment process moves the platform with respect to the missile, thereby aligning the stable platform. This process will introduce an error on the resolvers on the gyro gimbels. When the missile is fired, these errors will be resolved by moving the missile with respect to the stable platform. Therefore, when no error signals are generated from the resolvers, or the errors have been corrected by the servos, the missile will be aligned with respect to the stable platform.

This process uses the output of the accelerometers of the aligned stable platform. In order that the accelerometers be sensed, the computer must be utilized. The axis system is chosen so that, when the platform is horizontal, the outputs from the PIPAS (Pulse Integrating Pendulum Accelerometer) are equal in magnitude and opposite in sense or direction, thereby canceling one another. This factor is used to accomplish erection of the stable member.

The check-out and effect on prelaunch conditions having been fulfilled, the fire control system starter generates a start computation signal (SC) and a timer initiate signal (TO). No further inputs from the fire control are permitted to enter the computer. Although the missile has not been launched, as far as the guidance system is concerned, the missile is in flight. Motion of the submarine, and hence motion of the missile, are detected by the accelerometer and stored in appropriate registers within the computer. During the initial phases of launch, starting with the TO signal and lasting until 3.84 seconds after TO while the missile is being launched, the computer calculates pitch and yaw commands in a manner to be explained hereinafter, but it does not generate steering commands until after the 3.84 second limit. During this time period, all missile control is through the missile stablilization loop, thereby allowing the missile to recover from any unusual attitude which may be a result of launch. After 3.84 seconds have passed, the guidance system commences steering commands which cause the missile to pitch over toward the target. Thus, during the first phase of flight, the missile is allowed to fly in a primarily vertical attitude while passing through the denser portions of the atmosphere. In addition, all flight commands from guidance computer preclude any sudden maneuvering and allow the misssile pitch angle to be controlled gradually and in a manner in accordance with a predetermined program. For approximately a 50-second interval, steering commands are issued at a rapid rate and the pitch of the missile is changed at the maximum permissible rate. The following is the programmed phase of flight:

The guided flight phase commences shortly thereafter. The first stage rocket burns out and the second stage rocket powers the missile. When the velocity to be gained (Vg) reaches the predetermined limit, a prearm signal (PA) is generated by the computer and sent to the re-entry body. When the velocity to be gained equals zero, a cut-off signal (CO) is generated by the computer and the reentry body separates from the missile's second stage. The re-entry body is now on a ballistic flight pattern which will carry it to the target.

An object of the present invention is the provision of an in-flight guidance computer for a ballistic missile.

A further object of the present invention is the provision of a multi-mode guidance computer.

Still another object of the present invention is the provision of an in-flight guidance computer capable of pre-flight checkout and alignment of a guidance system for a ballistic missile.

Yet another object of the present invention is the provision of a guidance computer for a ballistic missile which operates in real-time mode.

Still another object of the present invention is the provision of an in-flight computer providing computation for navigation and steering, stability, pre-flight checkout and alignment, performance monitoring, telemetering, multi-mode flight control, staging control, thrust cut-off computation, and pre-arm computation of a ballistic missile. Yet another object of the present invention is the provision of a guidance computer for a ballistic missile capable of multi-mode computations, which computer operates on a real-time basis.

A still further object of the present invention is the provision of an in-flight guidance computer in the inertial guidance system of a ballistic missile system.

Yet another object of the present invention is the provision of a real-time multi-mode guidance computer for use in an all inertial guidance system of a ballistic missile which receives no guidance or control signals external of the missile after launch time.

Another object of the present invention is the provision of a guidance computer for use in an all inertial guidance system using the velocity to be gained concept of guidance computation.

Yet another object of the present invention is the provision of a real-time multi-mode guidance computer for use in an all inertial guidance system which uses the velocity to be gained concept of guidance control for use in a surface-to-surface ballistic missile.

Other objects and many of the attendant advantages of this invention will be readily appreciated as the same becomes better understood by reference to the following detailed description when considered in connection with the accompanying drawings in which like reference numbers designate like parts throughout the several figures thereof and wherein:

FIG. 1*a* illustrates a logic symbol for an AND gate;

FIG. 1*b* illustrates typical circuitry for an AND gate;

FIG. 2*a* depicts a logic symbol for an OR gate;

FIG. 2*b* shows typical circuitry of an OR gate;

FIG. 3*a* illustrates one logic symbol for an inverter;

FIG. 3*b* shows a transistorized amplifier which may be used to produce the inversion function;

FIGS. 4*a* to *d* illustrate various logic symbols used for the NOR function or circuit;

FIGS. 5*a* and *b* illustrate a bistable multivibrator or flip-flop;

Figure 8A:
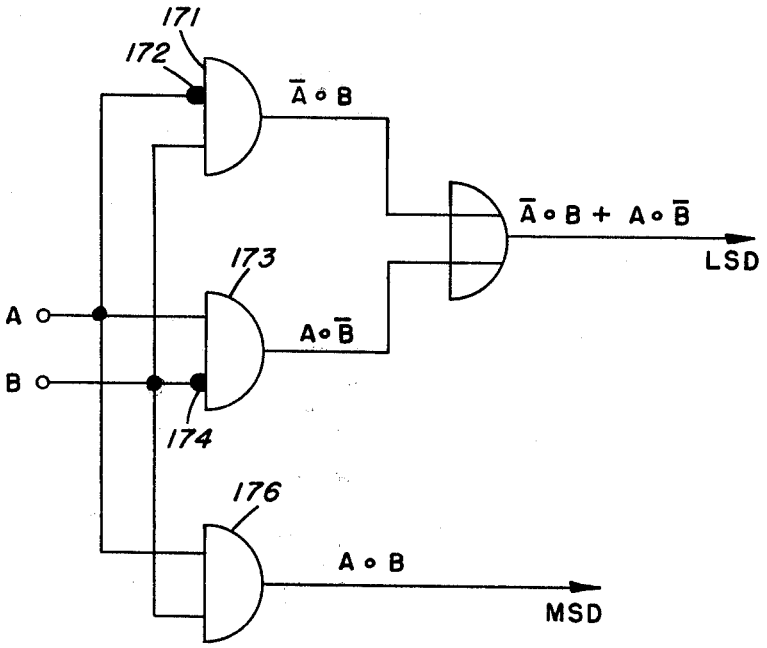
Figure 8B:
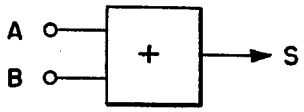
Figure 9A:
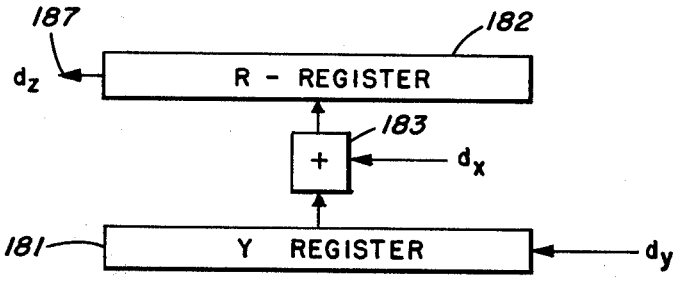
Figure 9B:
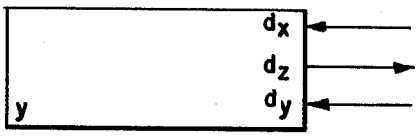
Figure 10:
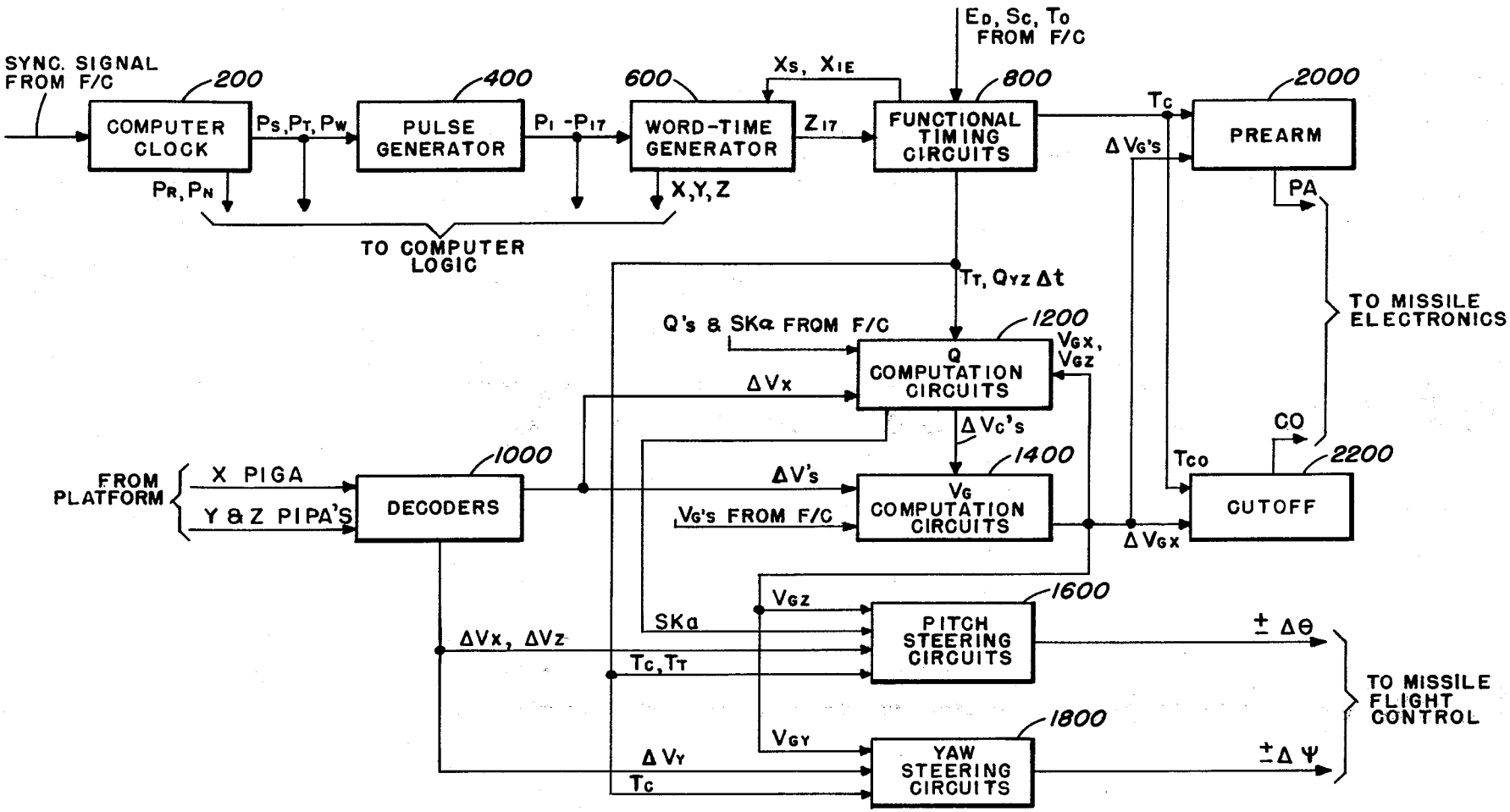
Figure 11:
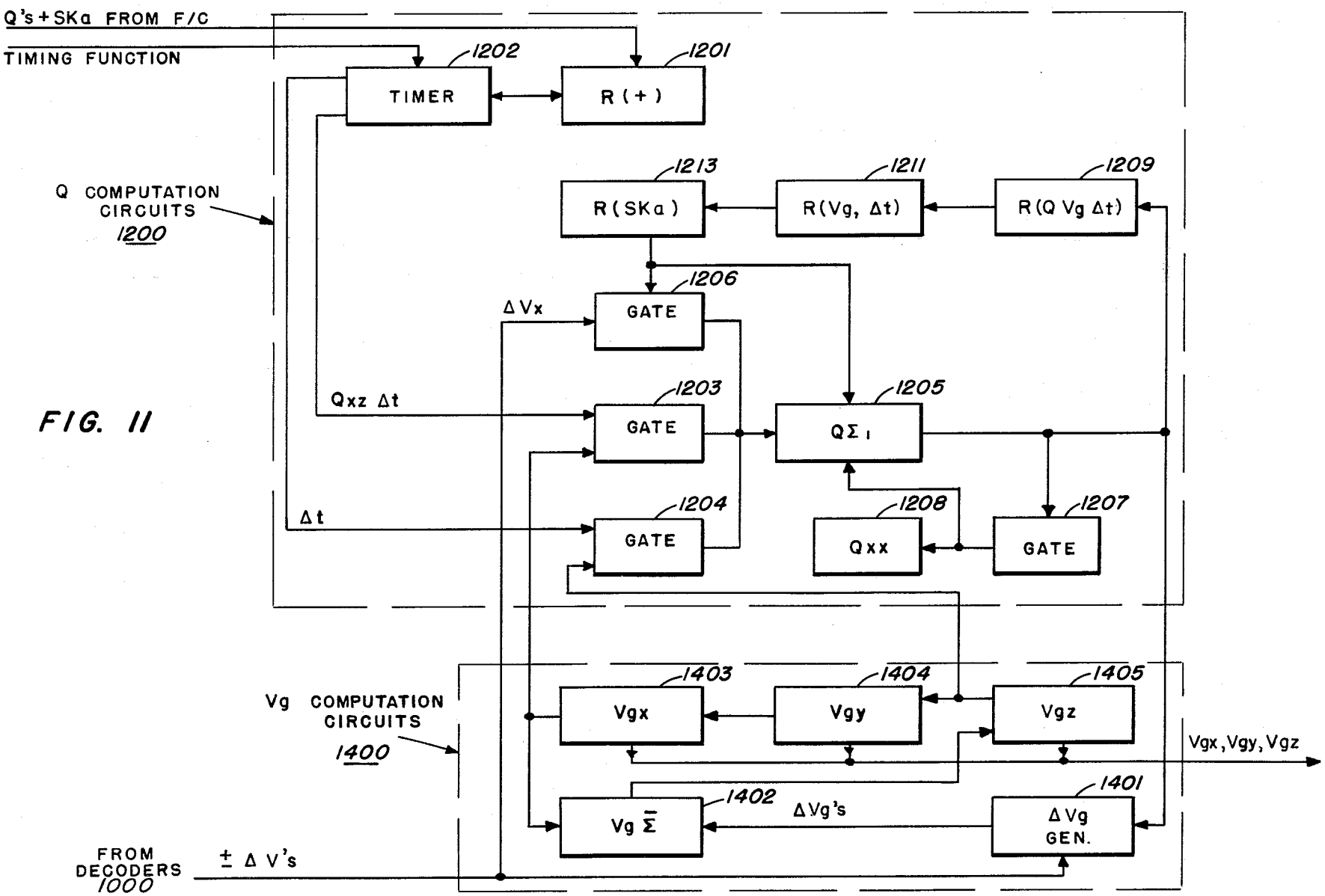
Figure 12:
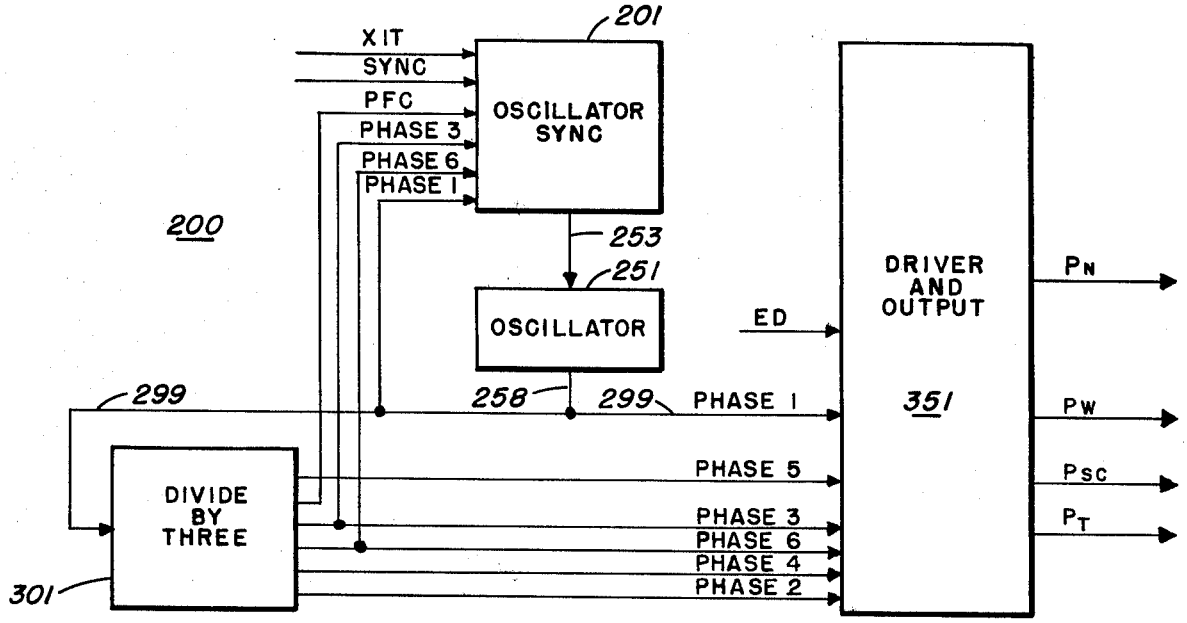
Figure 13:
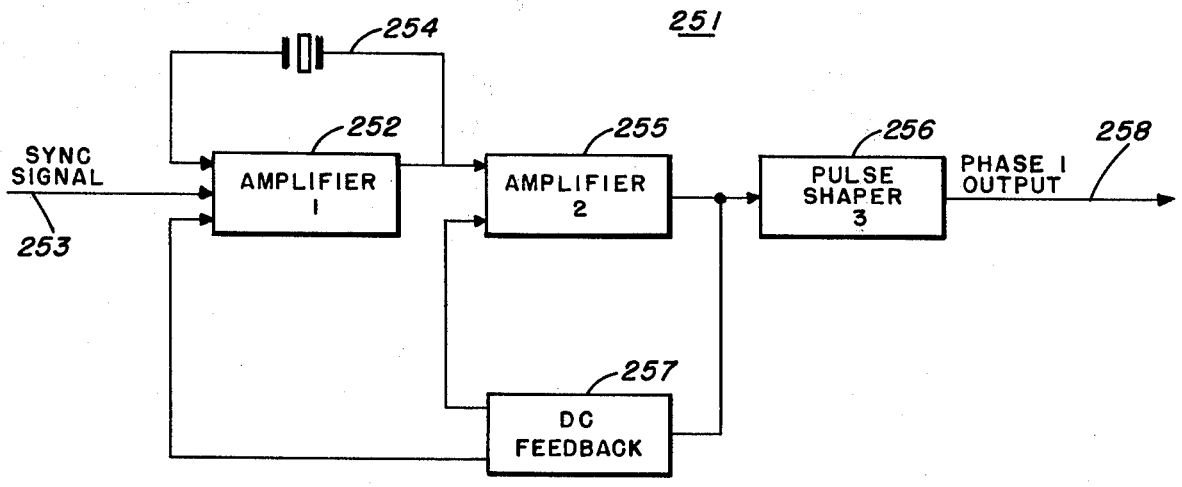
Figure 14:
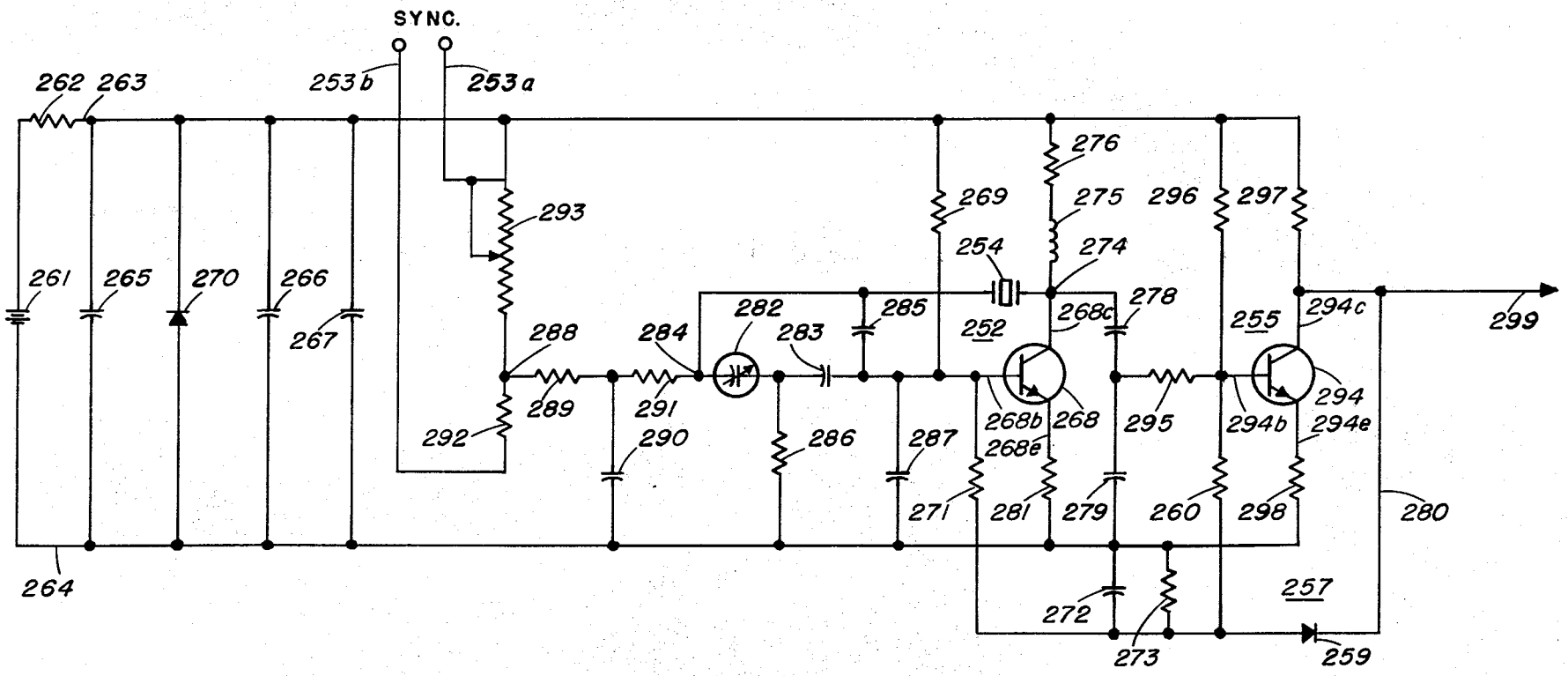
Figure 15:
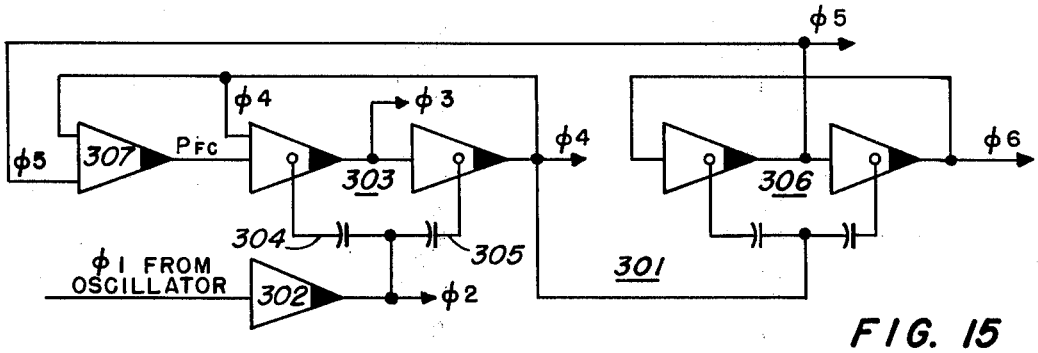
Figure 16:
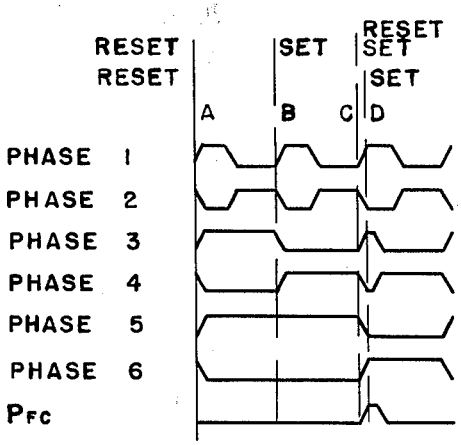
Figure 17:
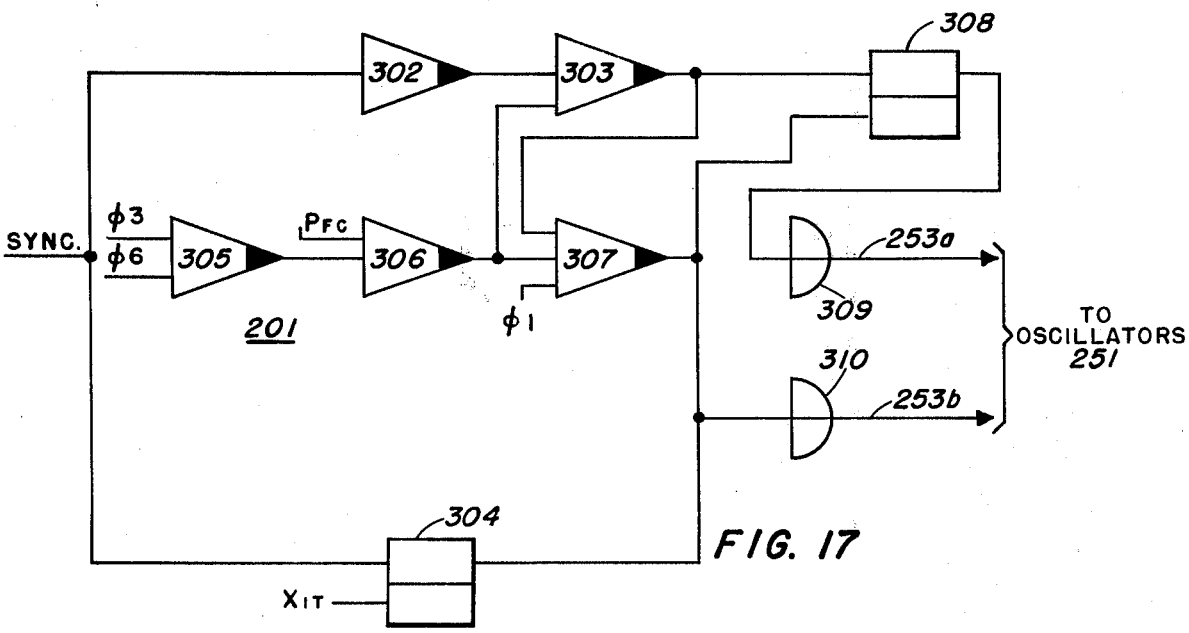
Figure 22:
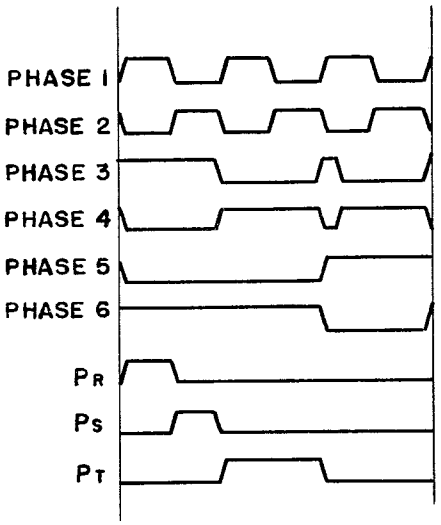
Figure 19:
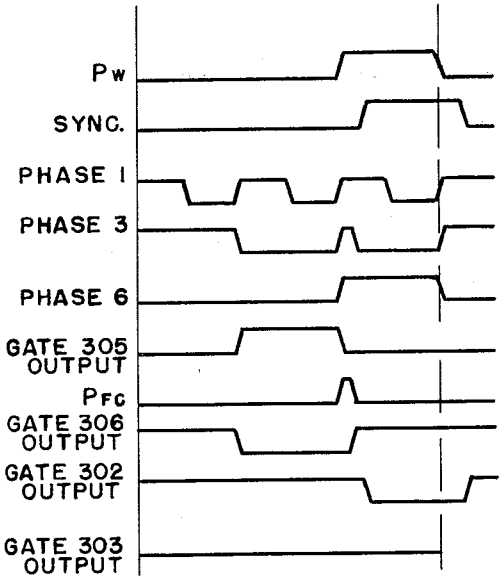
Figure 18:
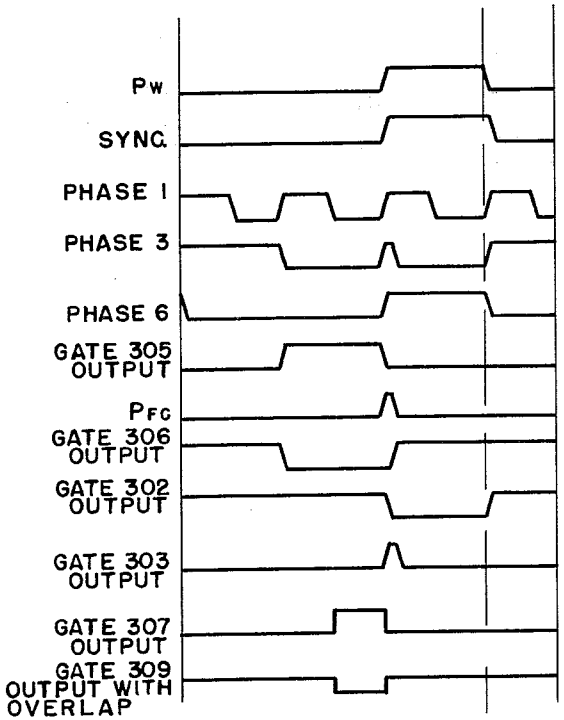
Figure 20:
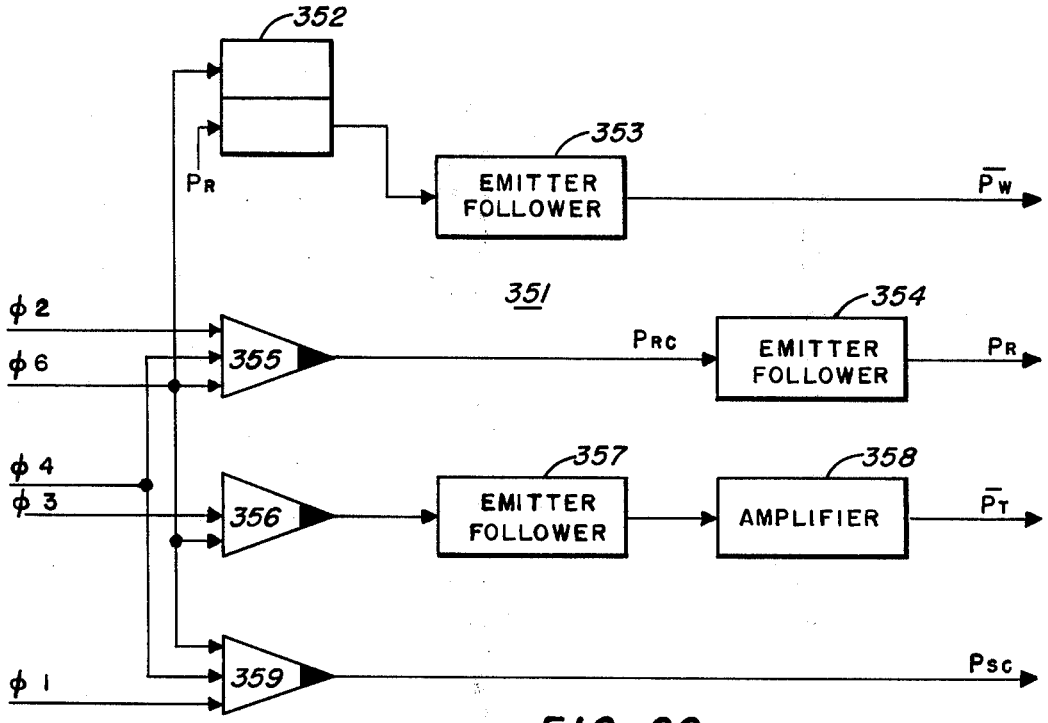
Figure 21:
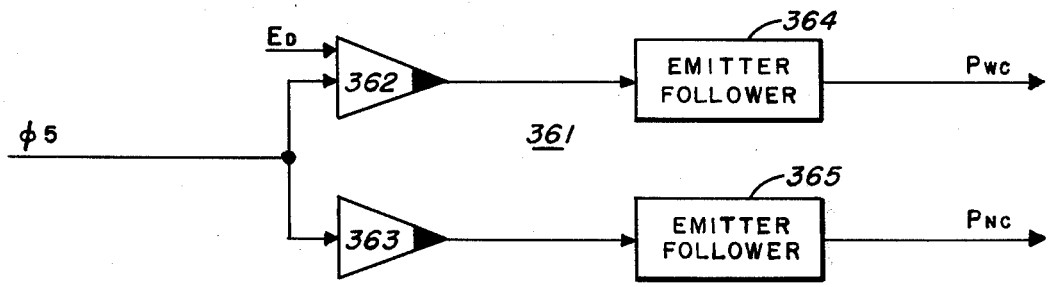
Figure 27:
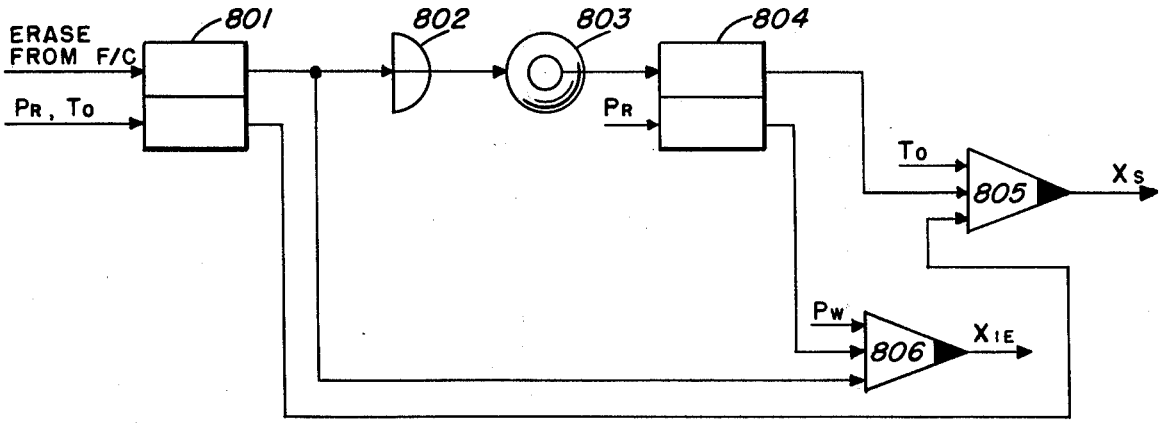
Figure 28:
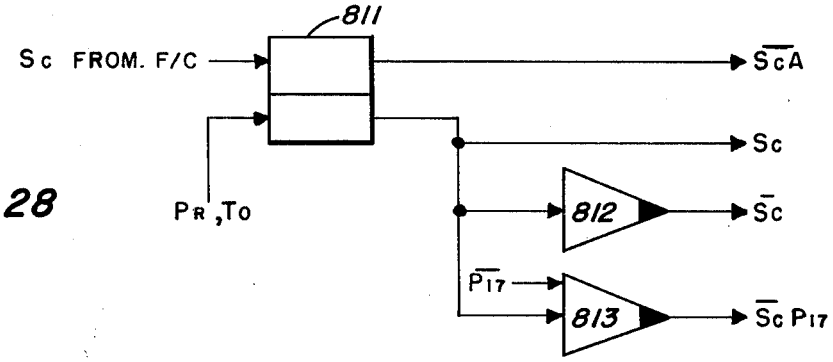
Figure 30:
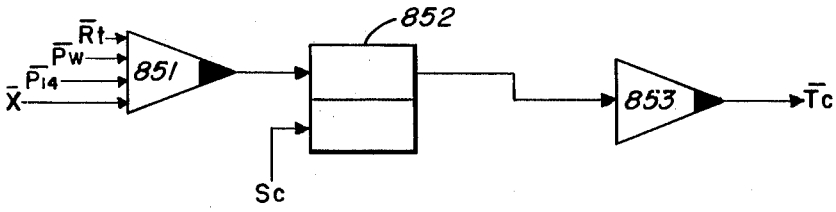
Figure 29:
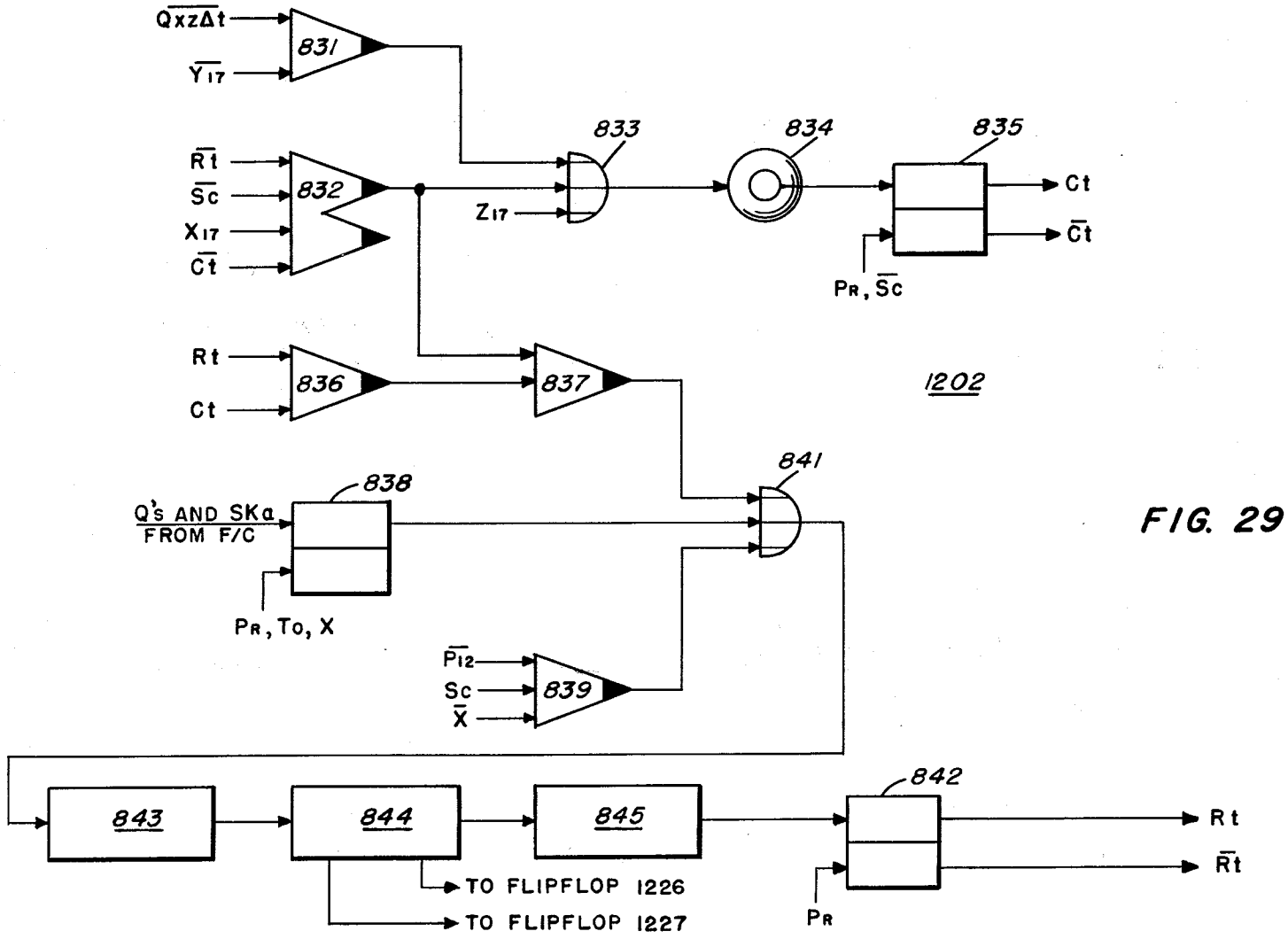
Figure 35:
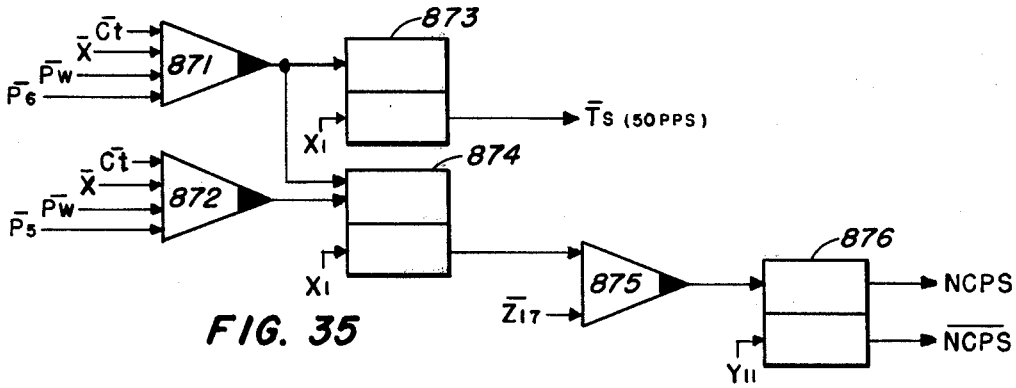
Figure 36:
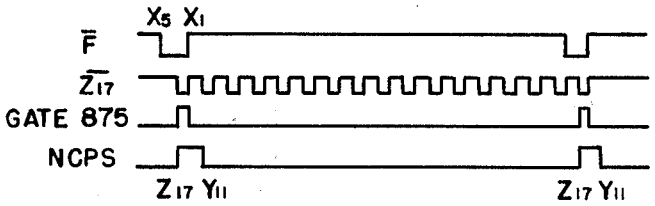
Figure 37A:
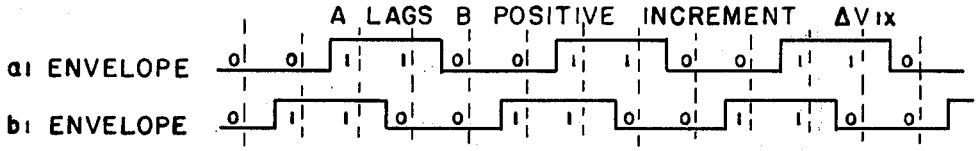
Figure 37B:
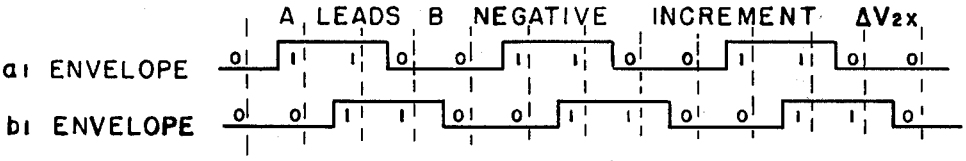
Figure 37C:
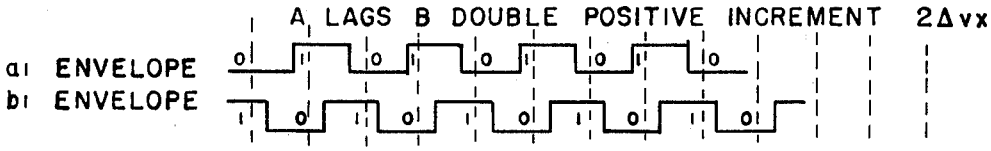
Figure 39:
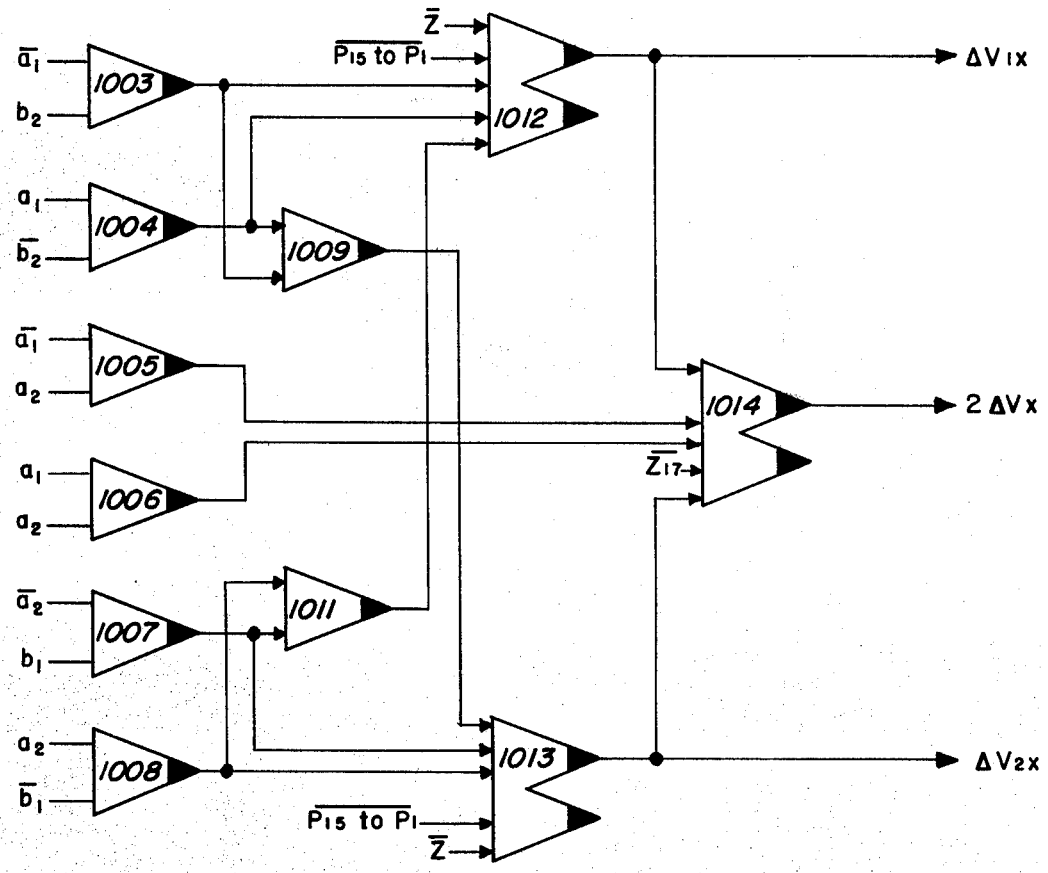
Figure 43:
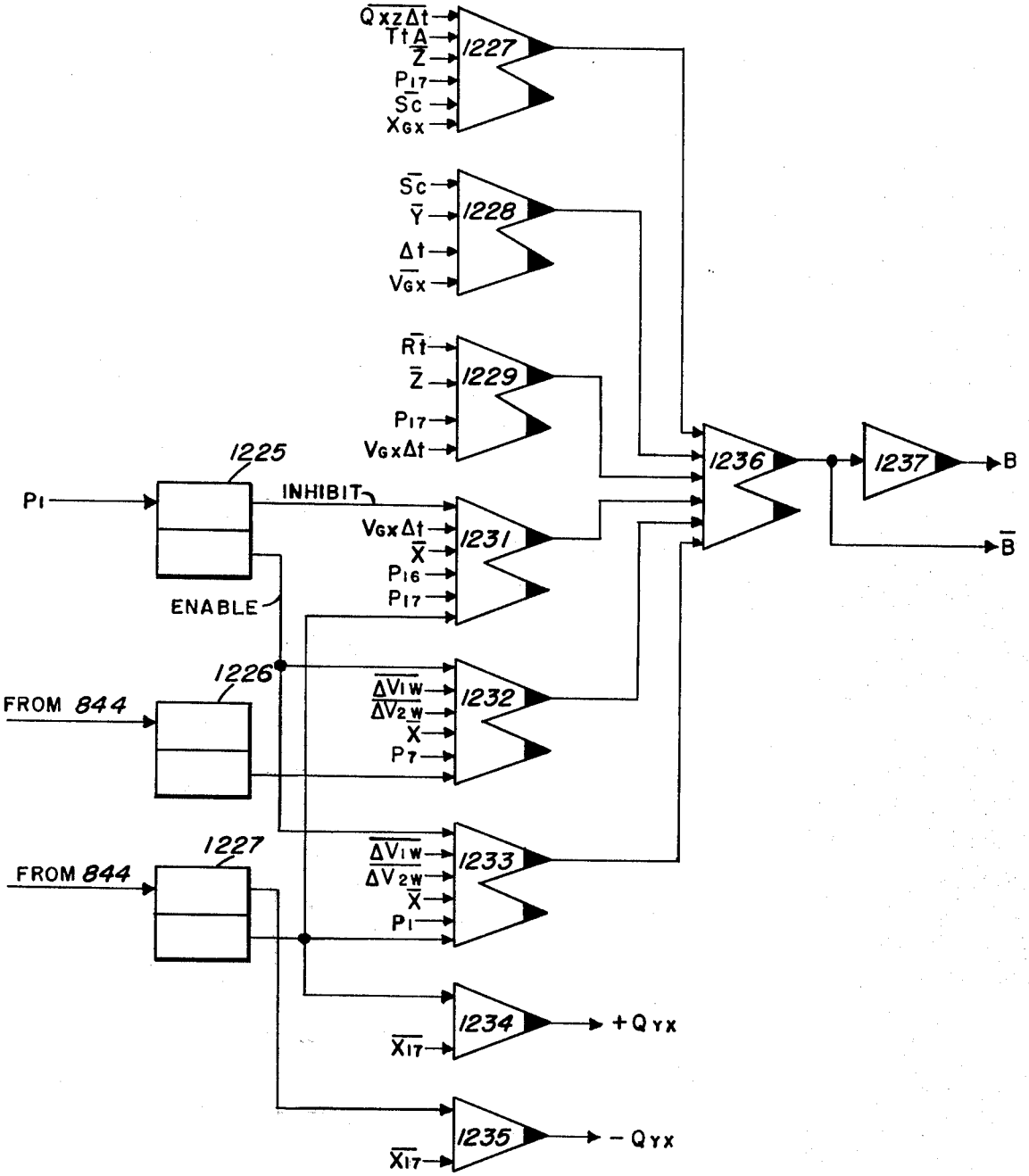
Figures 44, 45:
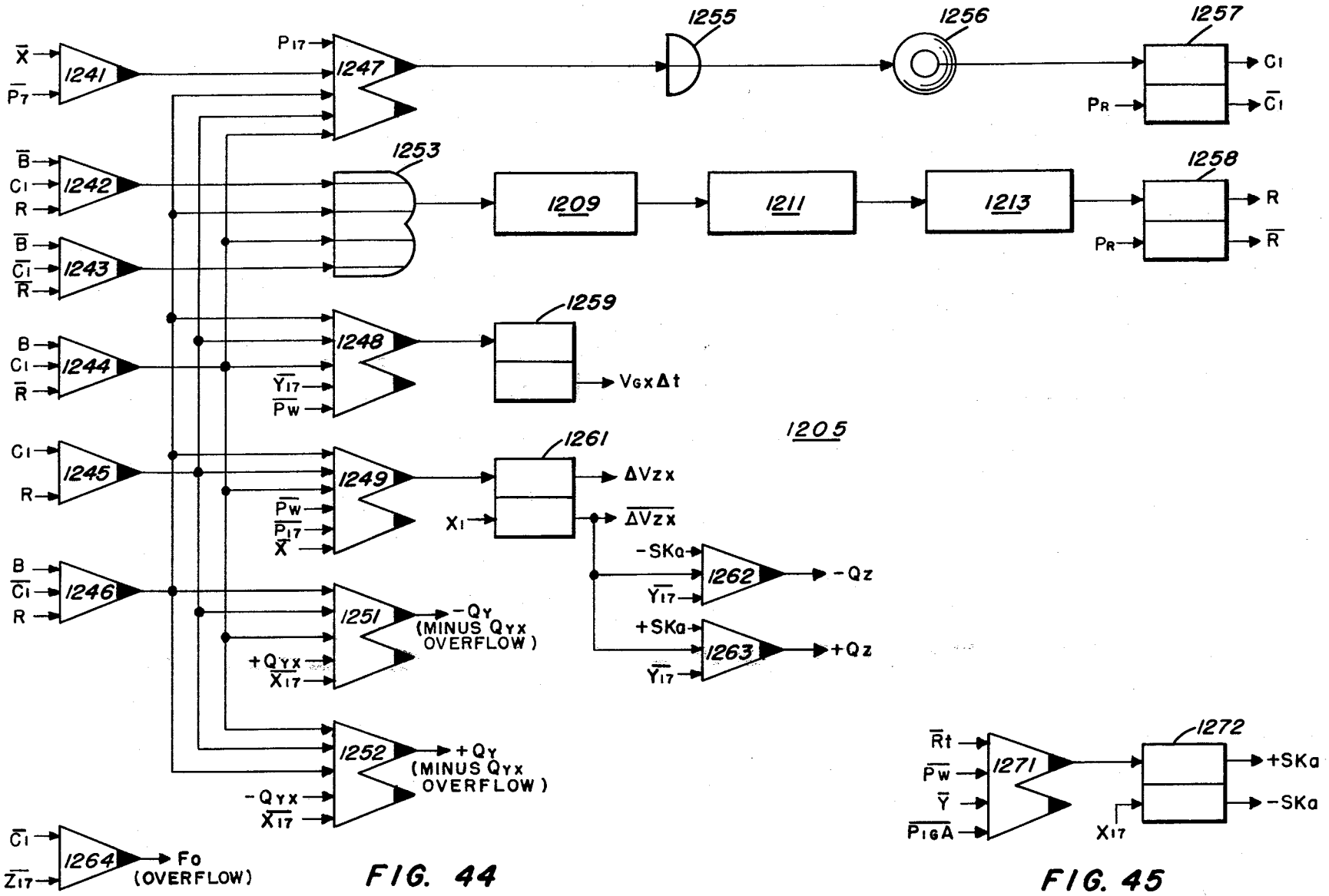
Figure 46:
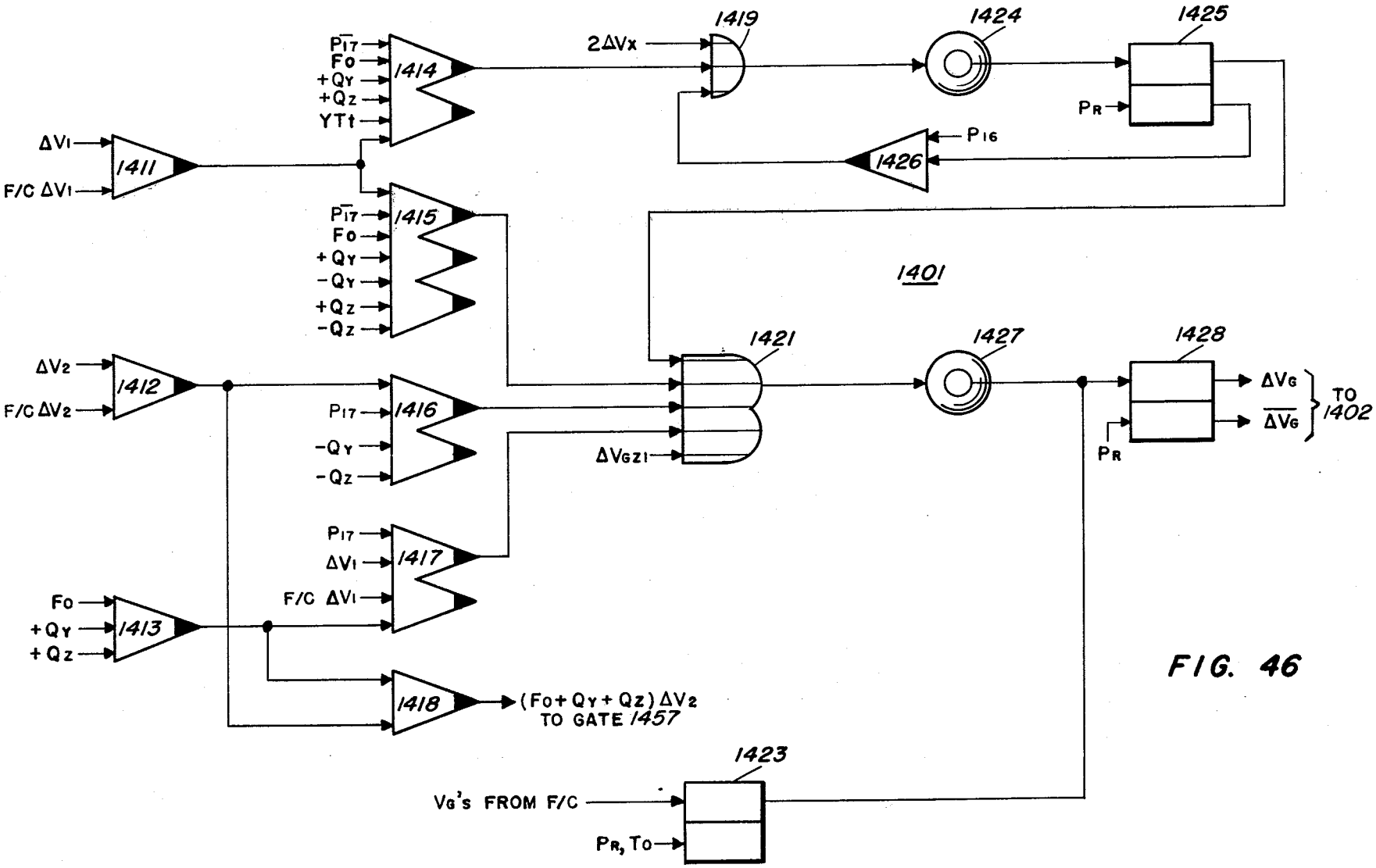
Figure 47:
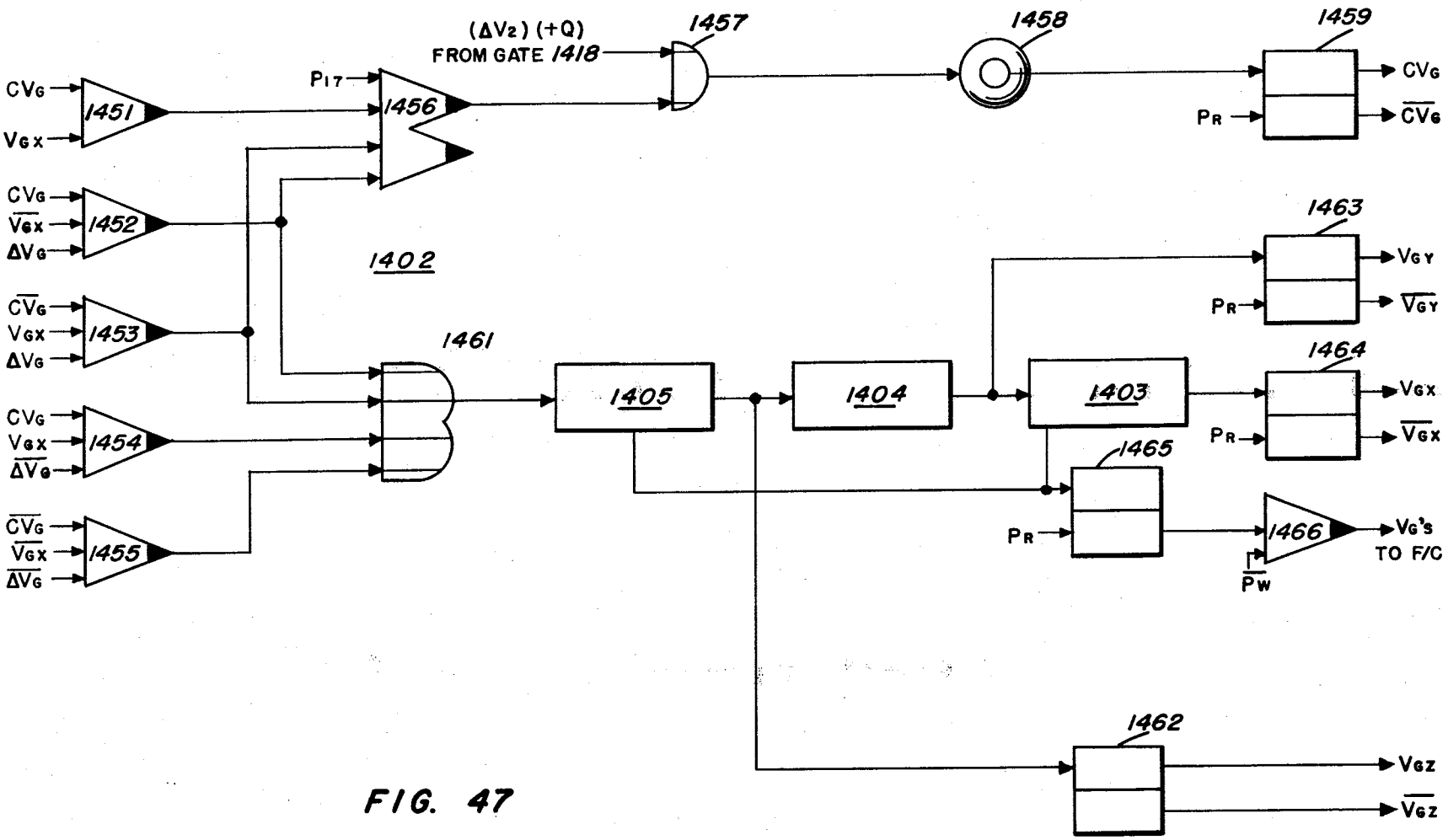
Figures 48A, 48B:
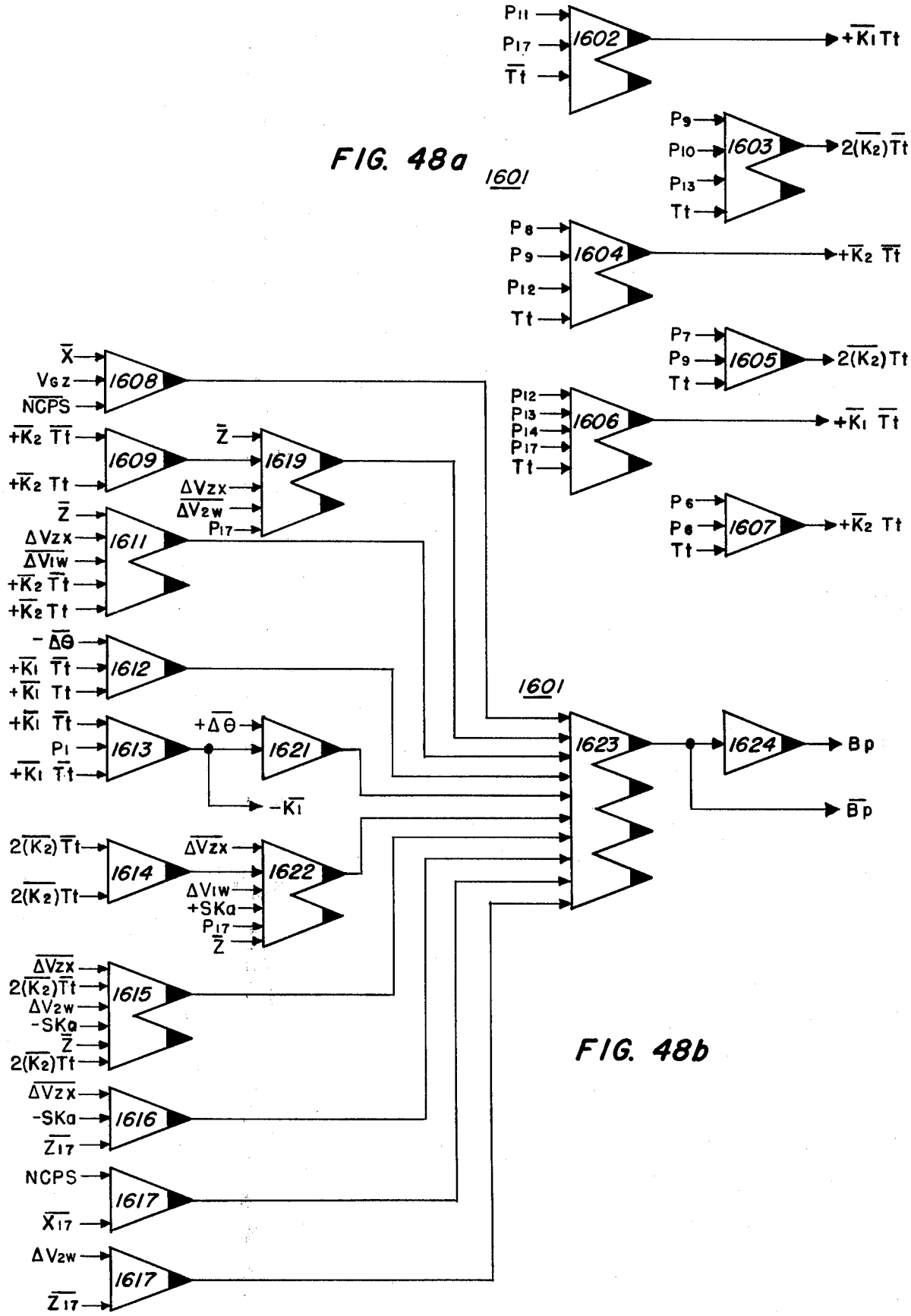
Figures 49, 50:
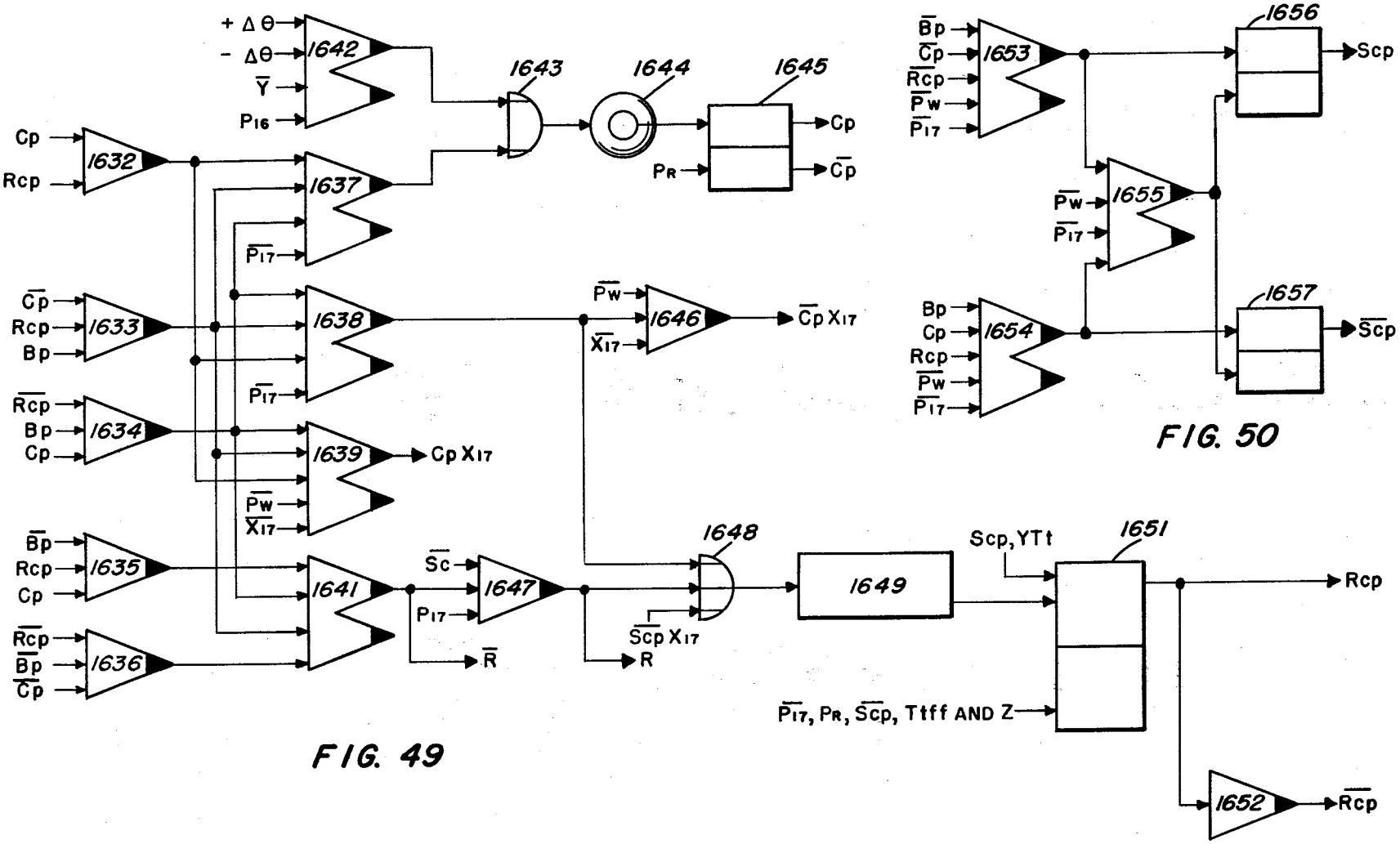
Figure 51A:
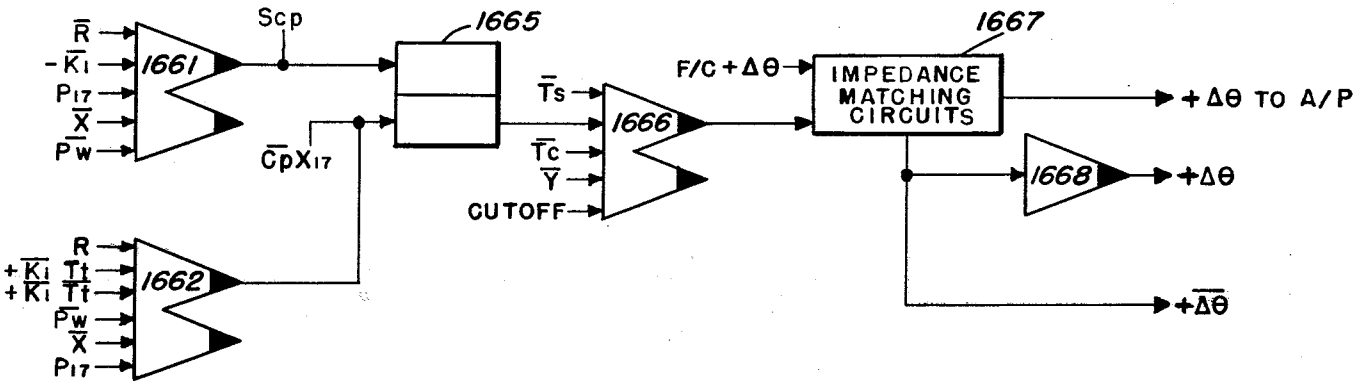
Figure 51B:
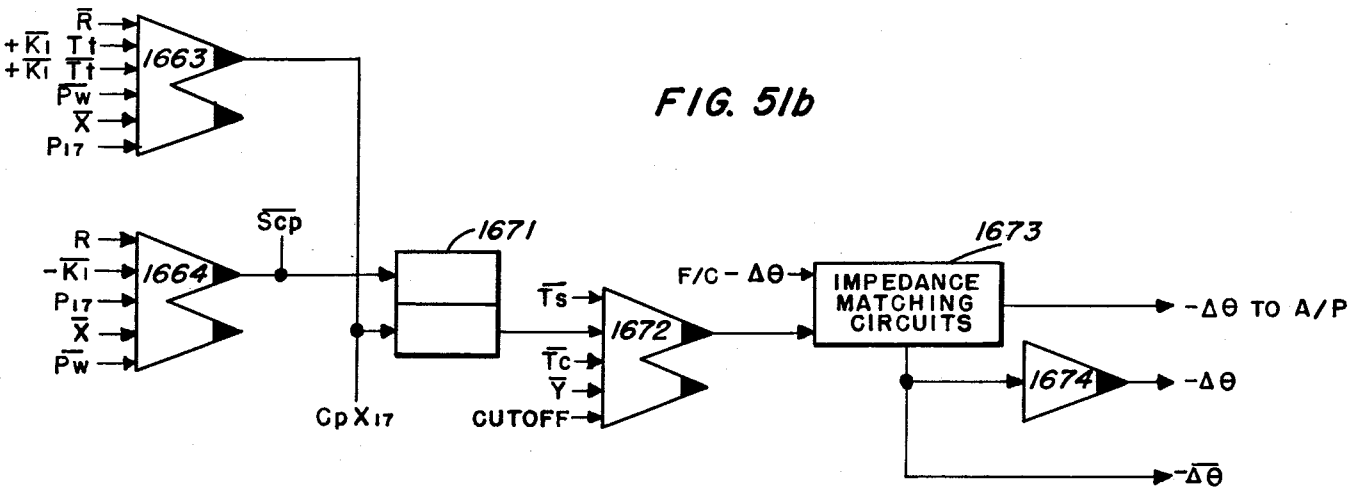
Figure 52:
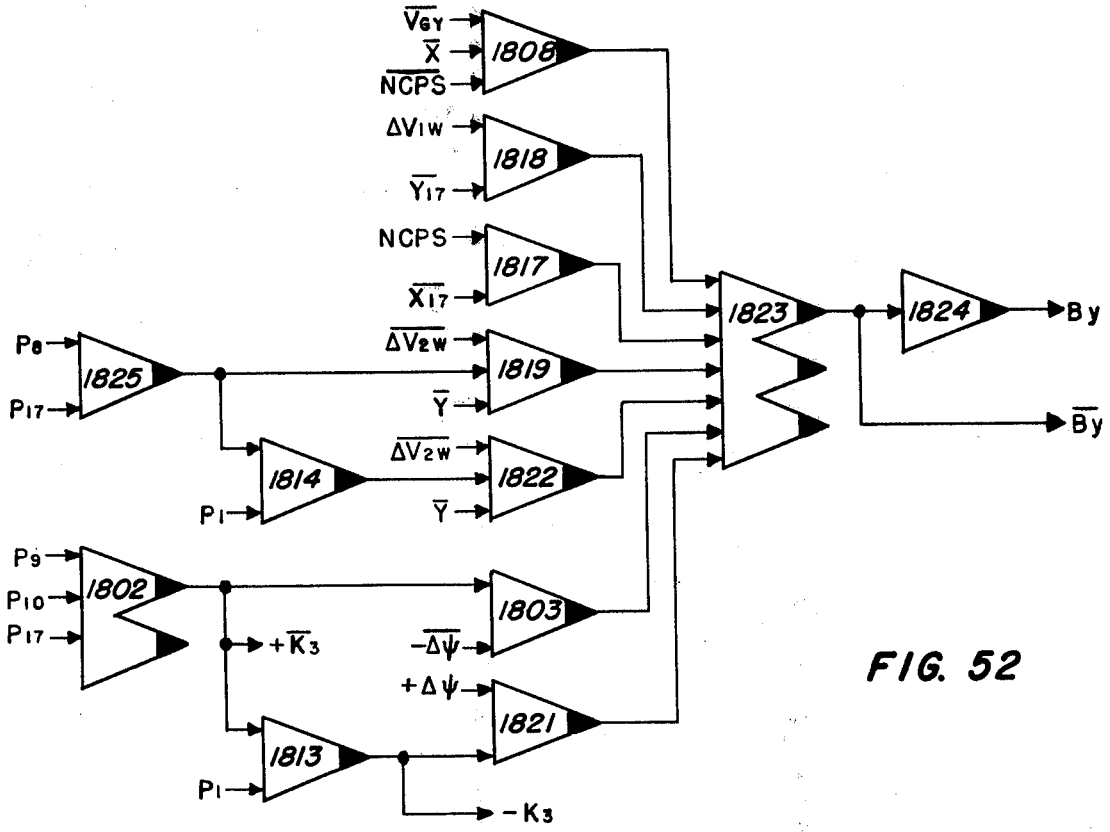
Figure 54:
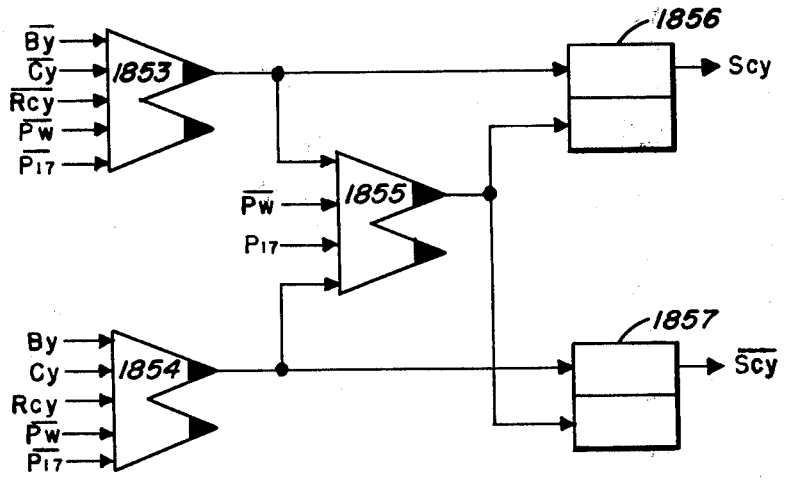
Figure 53:
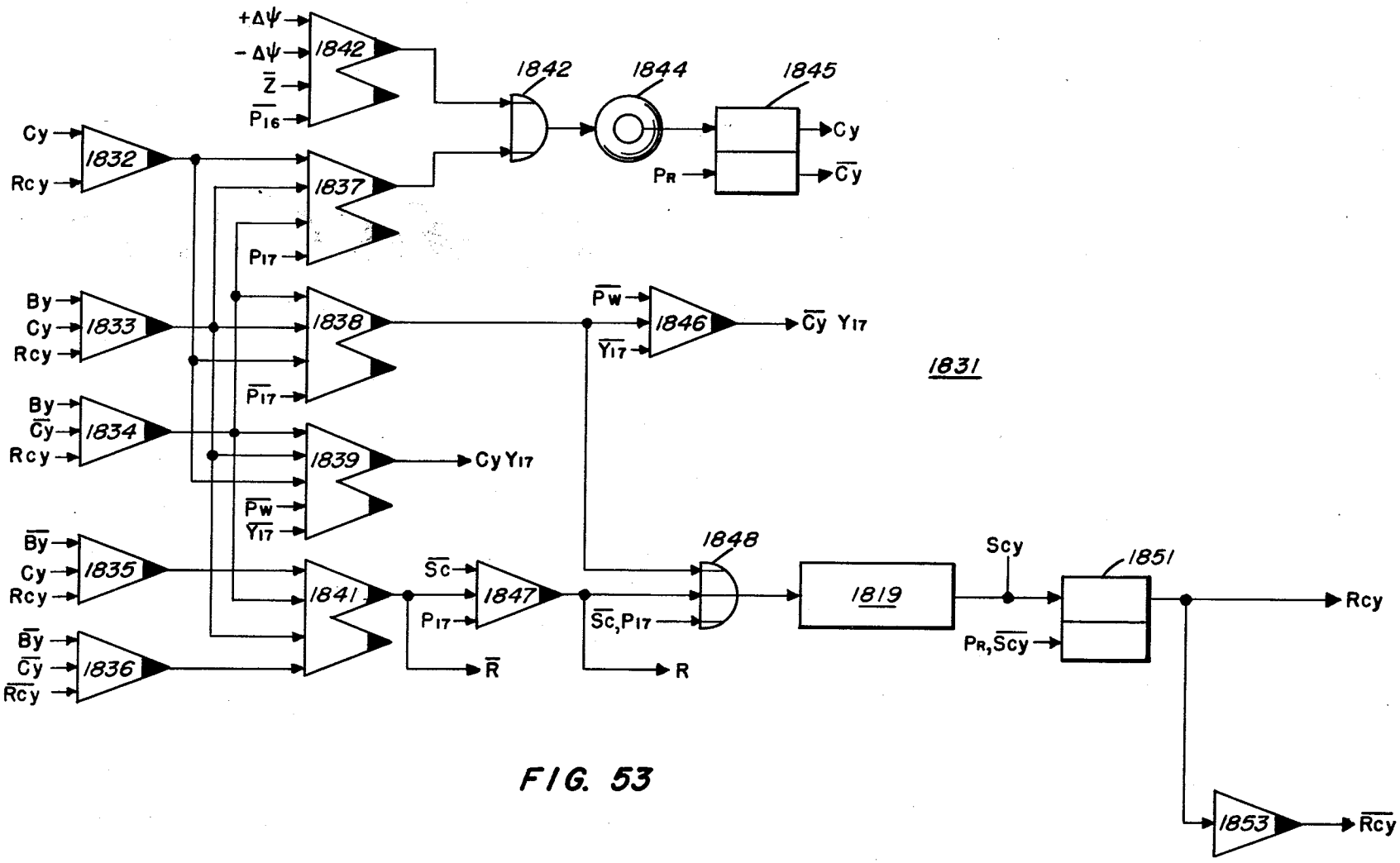
Figure 55A:
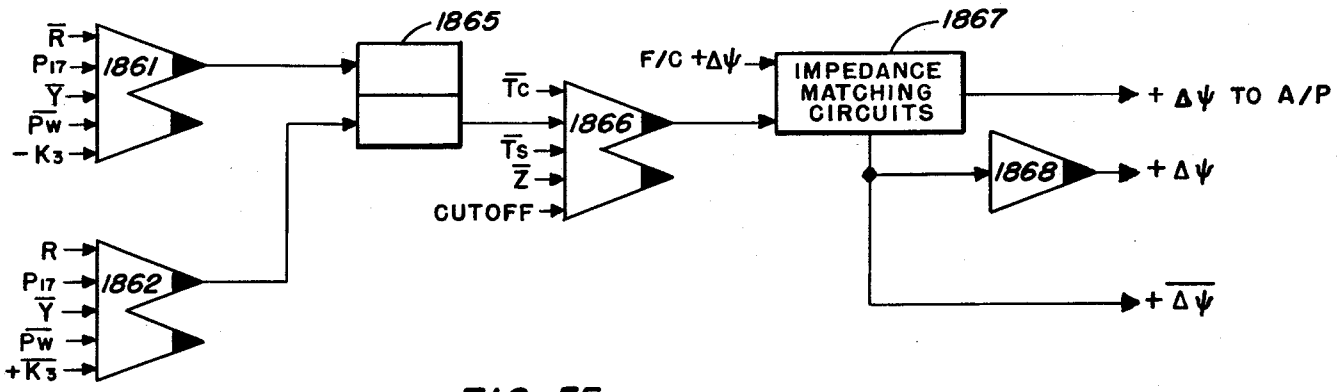
Figures 56, 57:
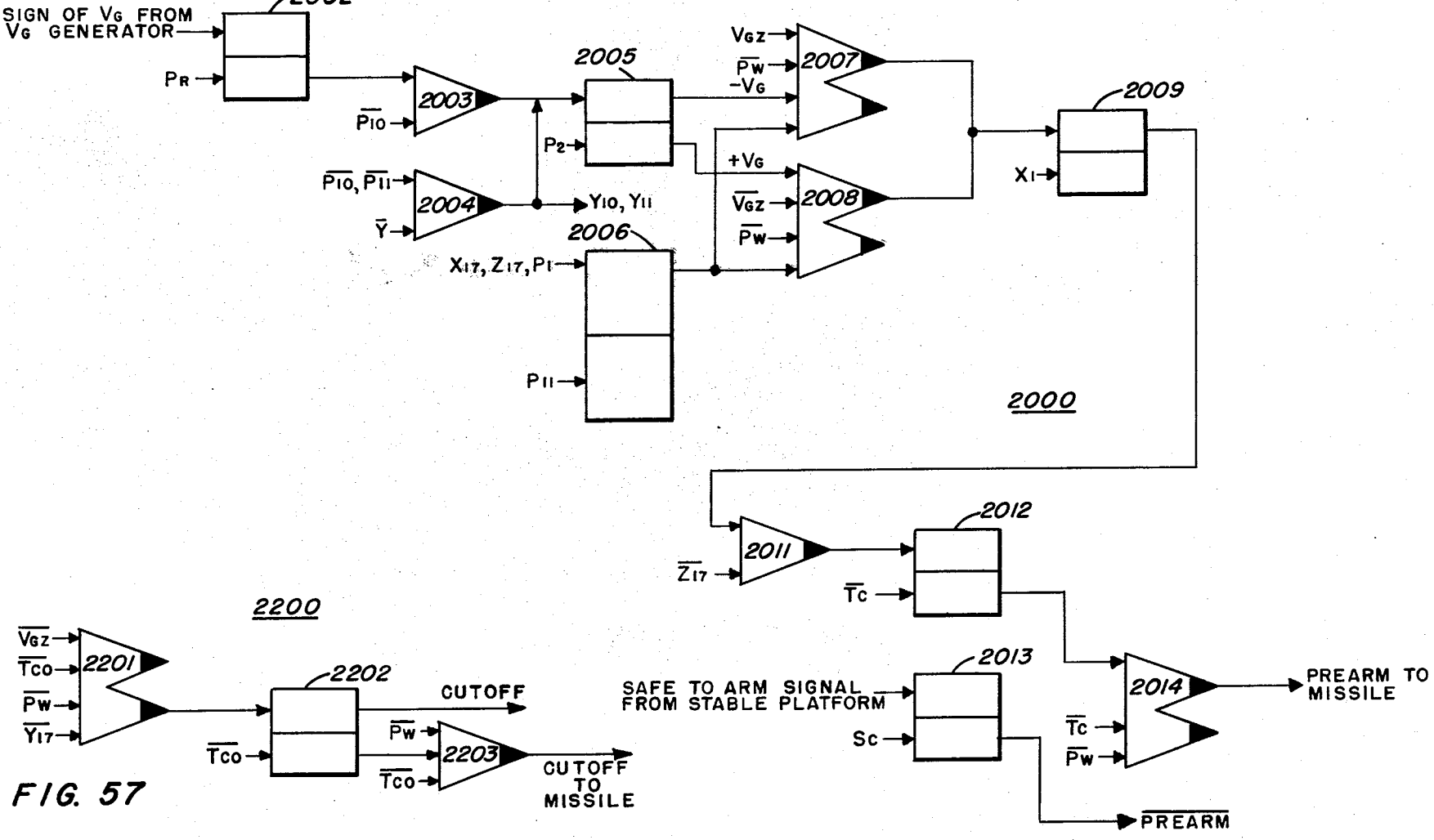

FIG. 8*a* depicts the logic used for an adder circuit;

FIG. 8*b* shows the logic symbol employed for an adder;

FIG. 9*a* illustrates the component units of a digital differential analyzer;

FIGS. 9*b* and *c* show a shorthand logic symbol for digital differential analyzers;

FIG. 10 depicts a generalized functional block diagram of the computer forming the present invention;

FIG. 11 illustrates a functional block diagram of the Vg computation loop of the computer;

FIG. 12 shows a functional block diagram of the computer clock;

FIG. 13 shows a block diagram of the oscillator of the clock of FIG. 12;

FIG. 14 is a detailed schematic diagram of the oscillator of FIG. 13;

FIG. 15 illustrates the logic diagram of the divide-by-three circuit of the clock of FIG. 12;

FIG. 16 depicts the waveforms generated by the divide-by-three circuits;

FIG. 17 shows the logic of the synchronization circuit of the oscillator of FIG. 13;

FIGS. 18 and 19 show the relationship of waveforms generated by the circuitry of FIGS. 14 and 17;

FIGS. 20 and 21 illustrate the logic employed in the driver and output circuitry of the computer clock of FIG. 12;

FIG. 22 depicts the waveforms of the input and output pulses of the circuitry of FIGS. 20 and 21;

FIGS. 23 illustrates the logic diagram of the pulse generator;

FIG. 24 shows the relationship of the input and output waveforms of the device of FIG. 23;

FIGS. 25 and 26*a* through 26*c* show the logic circuitry of the word-time generator;

FIG. 27 illustrates the logic used to generate the Xs and Xie signals;

FIG. 28 depicts the circuitry which generates the Sc pulse used in the computer;

FIG. 29 illustrates the basic timing circuit of the computer;

FIG. 30 depicts the circuitry necessary to generate the Tc signal;

FIG. 31 shows the logic circuitry which generates the "cutoff" signal;

FIG. 32 shows the logic which is used to generate the "Tt" pulse signal;

FIG. 33 indicates the logic used to generate the $\Delta t$ (Vgx) signal;

FIG. 34 illustrates the circuitry which generates the Oxz$\Delta t$ signal;

FIG. 35 depicts the logic which generates the NCPS signal;

FIG. 36 illustrates waveform at certain points in the circuit of FIG. 35;

FIGS. 37*a* to 37*c* represent the relationship of the A and B waves to the X decoder;

FIGS. 38*a* and 38*b* illustrate a portion of the X-PIGA divider logic circuitry;

FIG. 39 illustrates the portion of the X decoder which produces the $\Delta$Vx signals;

FIG. 40 shows the Y-PIPA decoder;

FIG. 41 shows the X-PIPA decoder;

FIG. 42 illustrates the $\Delta$Vw generator;

FIG. 43 depicts the logic circuit of the input section to the Q summer;

FIG. 44 illustrates the logic of the Q summer circuit;

FIG. 45 depicts the SKU gating circuitry;

FIG. 46 illustrates the logic of the Vg generator section of the Vg computation circuit;

FIG. 47 shows the logic circuitry for the Vg summer and associated registers;

FIG. 48*a* and *b* depict the input logic to the pitch circuits;

FIG. 49 represents the logic circuitry of the pitch adder;

FIG. 50 illustrates the logic of the pitch overflow detection circuit;

FIGS. 51*a* and *b* show the logic of the pitch comparator and generator circuits;

FIG. 52 illustrates the yaw input logic circuit;

FIG. 53 illustrates the logic of the yaw adder circuit;

FIG. 54 illustrates the logic circuitry of the yaw overflow detection circuit;

FIGS. 55*a* and *b* depict the logic circuits of the pitch comparator and generator circuits;

FIG. 56 depicts the pre-arm logic circuitry;

FIG. 57 illustrates the cutoff logic circuit;

and

Figure 58A:
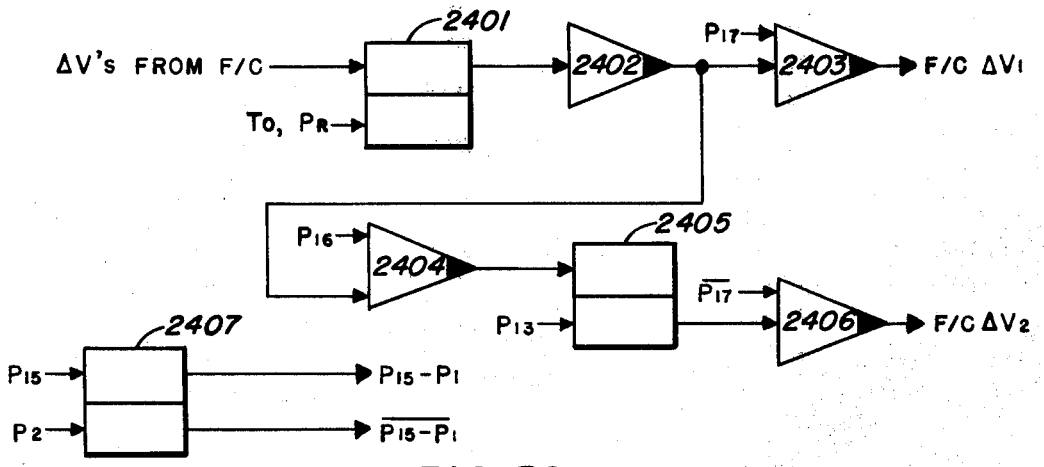
Figure 58B:
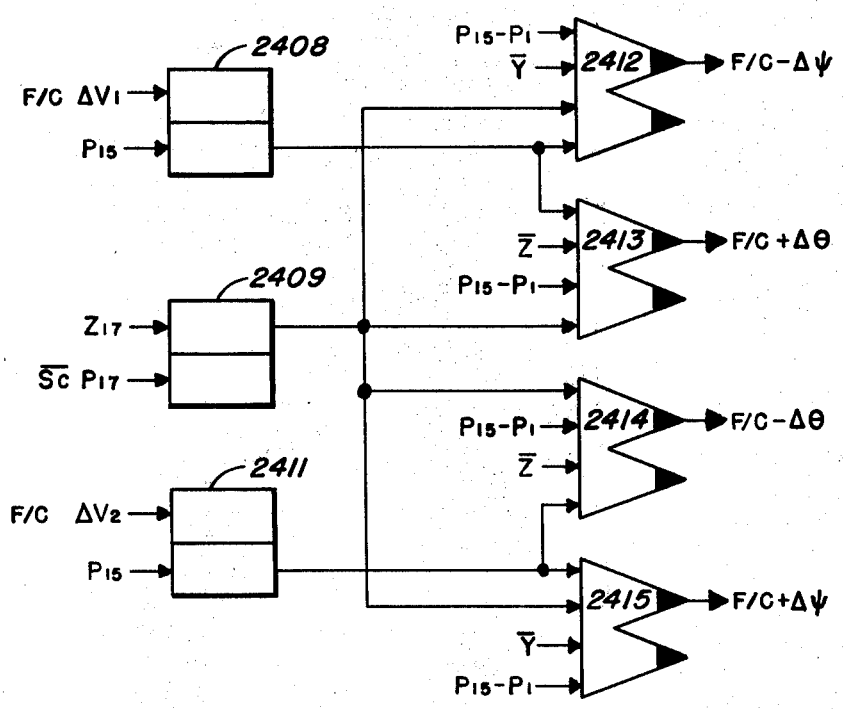

FIGS. 58*a* and *b* show the fire control-autopilot check circuits.

The computer of the present invention used modular type construction, each basic circuit unit comprising a module. Three logic functions form a basis from which all digital logical elements are built. They are; the "AND" function, the "OR" function, and the "invertor." Using a binary number system, there are but two conditions represented by an "0" or "1." These may be the presence or absence of a quantity; for example, absence of a current or voltage, and the presence of a current or voltage, or an occurrence such as the opening or closing of a switch. A positive system of logic is defined, if the ON condition, such as the presence of voltage, represents a binary "1", and the OFF condition, absence of the voltage, represents a binary "0". Similarly, a negative system of logic is defined, if the ON condition represents an "0" and the OFF condition represents a "1".

AND FUNCTION

Figure 1A:
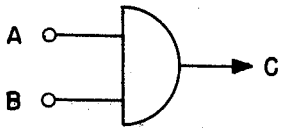

A symbol for the AND function, the AND circuit, or AND gate, is shown in FIG. 1*a* where A and B are input terminals and C is the output terminal. If both A and B signals are present at the same time, an output signal appears at C; if neither A nor B, A alone, or B alone have signals applied thereto, there is no output. A convenient manner to represent binary functions is a truth table. The truth table for the AND function is shown in Table I.

TABLE I

| A | B | C |
|---|---|---|
| 0 | 0 | 0 |
| 0 | 1 | 0 |
| 1 | 0 | 0 |
| 1 | 1 | 1 |

Using Boolean algebra notation, the AND function may be represented by the equation:

$$A \cdot B = C \tag{4}$$

which is read A and B equal C. There may be any number of inputs to the "AND" gate, but all must be present simultaneously for an output signal to be generated.

Figure 1B:
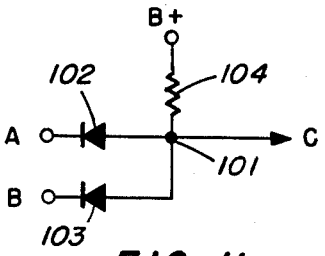

An "AND" gate may be instrumentated in any of a number of ways; one such instrumentation is shown in FIG. 1*b*, where A and B are input terminals to the circuit and C is the output terminal. Diodes 102 and 103 are placed between terminals A and B and junction 101. The anodes of the diodes are tied to terminal 101 and the cathodes are tied to input terminals A and B. This junction point 101 is supplied with a suitable D.C. bias (B+) through resistor 104, which bias is greater than the voltage necessary to produce a binary 1. The output terminal C is also tied directly to the junction 101. Assuming positive logic, if no signal is applied to either terminal A or B, current will flow from B+, through resistor 104 and diodes 102 and 103. There will be no voltage drop across the diodes, assuming ideally no forward resistance. The entire voltage B+will be dropped across the resistor 104, and output terminal C at the same potential as junction 101 will remain at zero potential. If there is an input to terminal A, current will flow through diode 103. Again there will be no voltage drop across dioe 103 and C will remain at zero, the ideal back resistance of diode 102 being infinite. Similarly, if an input appears at terminal B, current will flow through diode 102, and C will reamin at zero. If, however, inputs appear at both A and B simultaneously, a voltage equal to a binary 1, that signal applied to A and B, will appear at terminal C. Thus, the circuit shown in FIG. 1*b* satisfies the truth table for an AND function.

OR FUNCTION

Figure 2A:
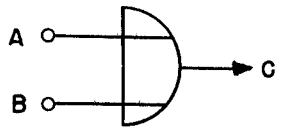

The logic symbol for the "OR" function is shown in FIG. 2*a*, where A and B are inputs thereto and C is the output. If there is an input to A, B, or A and B simultanesously, an output appears at C. If neither A nor B are present, there is no output at C. The truth table for an OR function is shown in Table II.

TABLE II

| A | B | C |
|---|---|---|
| 0 | 0 | 0 |
| 0 | 1 | 1 |
| 1 | 0 | 1 |
| 1 | 1 | 1 |

Using the Boolean notation, the OR function may be represented by the equation:

$$A + B = C \tag{5}$$

which reads A or B equal C.

Figure 2B:
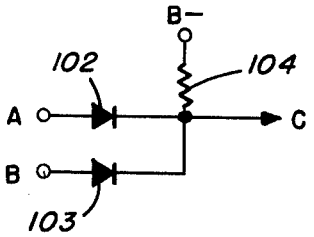

As in the case of an AND function, the OR function may be instrumentated many ways. A diode gate is shown in FIG. 2*b*, differing from the AND gate shown in FIG. 1*b* in only two respects; the diodes 102 and 103 are reversed and the bias voltage is negative (B−). Again assuming positive logic, if there is an input to A, current will flow through diode 102 and resistor 104 to B−; there being no voltage drop across diode 102, an output appears at terminal C. Similarly, an output will appear at C if an input appears at terminal B or at terminals A and B simultaneously. If there are no inputs to the gate, there will be no output appearing at terminal C.

It is of inerest to note that if negative logic is used, the gate of FIG. 1*b* performs the OR logic function, and similarly, the gate of FIG. 2*b* performs the AND function. This is shown by substituting voltage in the truth tables. For example, the modified truth table for FIG. 1*b* is:

TABLE III

| A | B | C |
|---|---|---|
| $E_o$ | $E_o$ | $E_o$ |
| $E_o$ | $E_1$ | $E_o$ |

TABLE III-continued

| A | B | C |
|---|---|---|
| $E_1$ | $E_o$ | $E_o$ |
| $E_1$ | $E_1$ | $E_1$ |

where $E_o$ is equal to zero volts and $E_1$ is equal to a voltage greater than $E_o$ but less than $B^{30}$.

If position logic is used, the table satisfies the ANd function shown in Table I; $E_1$ becoming a binary 1 and $E_o$ becoming a binary 0. But if $E_1$ is representative of a binary 0 and $E_o$ is representative of a 1, the table satisfies the OR function logic shown in Table II.

INVERTOR

Figure 3A:
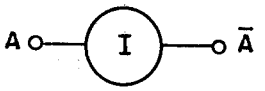

The third basic function is that of inversion. As shown in FIG. 3*a*, an input A appears at the input terminal and the output is $\overline{A}$ or the inversion of A. Thus, if a binary 0 appears at the input, the ouput is 1 and if 1 appears at the input, the output is 0. $\overline{A}$, the inversion of A, is commonly referred to as "A not" or "A notted."

Figure 3B:
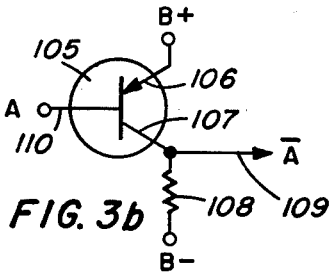

A typical invertor is shown in FIG. 3*b;* a PNP transistor 105 with the emitter 106 connected to B+, a source of positive voltage, the collector 107 tied to a source of negative voltage B− through resistor 108, the output terminal 109 tied to the collector terminal 107 and the input applied to the base 110. With a negative input applied to the base 110, a heavy current flows through the resistor 108 causing the output 109 to become more positive, thus the inversion. This function is also commonly referred to as the NOT function.

NOR FUNCTION

Figure 4A:
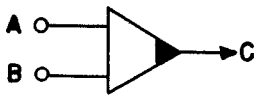
Figure 4B:
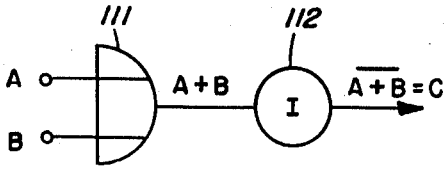

The basic building block of the computer of the present invention is the NOR circuit or NOR gate. As the name implies, the NOR function is no more than the combination of a NOT, or invertor, and an OR gate. The name NOR is a contraction of *NOT OR.* A logic symbol for the NOR gate is shown in FIG. 4*a*. The Boolean notation for a NOR is:

$$\overline{A+B}=C \tag{6}$$

which reads, "the quantity A or B not" or "the quantity A or B notted" equals C. FIG. 4*b* shows the logical composition of the NOR gate; an OR gate 111 feeding an invertor 112, the inputs to the OR gate being "A" and "B" which yield an output of $\overline{A+B}$ fed to invertor 112 which yields an output of A+B. The truth table for a NOR gate is shown in Table IV.

TABLE IV

| A (1) | B (2) | A + B (3) | $\overline{A+B}$ = C (4) |
|---|---|---|---|
| 0 | 0 | 0 | 1 |
| 0 | 1 | 1 | 0 |
| 1 | 0 | 1 | 0 |
| 1 | 1 | 1 | 0 |

The first three columns are identical to Table II, and column 4 is the inversion of the output yielded by an OR circuit.

Figure 4C:
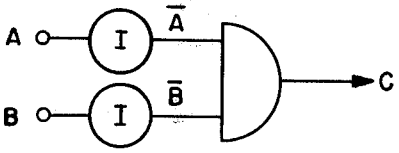

A NOR gate may also be instrumentated as shown in FIG. 4*c*. $\overline{A+B}=\overline{A}\cdot\overline{B}$, or stated "A or B notted" equals "A not and B not". For this equation to be true, A+B must equal A·B for all value of A and B. Truth Table V proves this relationship.

TABLE V

| A | B | $\overline{A}$ | $\overline{B}$ | A + B | $\overline{A+B}$ | $\overline{A}\cdot\overline{B}$ |
|---|---|---|---|---|---|---|
| 0 | 0 | 1 | 1 | 0 | 1 | 1 |
| 0 | 1 | 1 | 0 | 1 | 0 | 0 |
| 1 | 0 | 0 | 1 | 1 | 0 | 0 |
| 1 | 1 | 0 | 0 | 1 | 0 | 0 |

From this proof, it is easily seen that a NOR gate may also be functionally shown as illustrated in FIG. 4*c*, wherein inputs $\overline{A}$ and $\overline{B}$ pass through invertors yielding A and B, respectively, and the outputs of the invertors are applied to an AND gate, yielding $\overline{A}\cdot\overline{B}$.

Figure 4D:
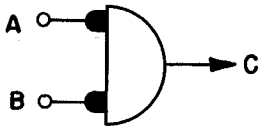

Another notation for an invertor feeding a logic gate is shown in FIG. 4*d* as a black circle adjacent to the vertical line forming a portion of the symbol for the gate.

As mentioned hereinbefore, the basic building block of the computer, of the present invention, is the NOR circuit, for the reason that many different logic functions may be performed by varying the inputs to the NOR circuit. Obviously, the NOR function itself may be performed.

$$\overline{A+B}=C \tag{7}$$

If a single input NOR gate is utilized, the output is an inversion of the input. $A=\overline{A}$ and the gate serves as an invertor.

If an OR function is desired, the output of the NOR may be applied to a second NOR gate as the only input thereto (the second gate functioning as an invertor) which would yield $$\overline{(\overline{A+B})}=A+B \tag{8}$$

If the AND function (a·B) is desired, inputs $\overline{A}$ and $\overline{B}$ are applied to a NOR and the output is $$\overline{(\overline{A+B})}=A\cdot B \tag{9}$$

This relationship is easily proven. Let $\overline{A}=P$ and $\overline{B}=Q$. In binary, if $\overline{A}=P$, $A=\overline{P}$ and if $\overline{B}=Q$, $B=\overline{Q}$. Substituted in the above equation, $$\overline{(\overline{P+Q})}=\overline{P}\cdot\overline{Q} \tag{10}$$

which relationship has been proven in conjunction with Truth Table V. Substituting $\overline{A}$ and $\overline{B}$ for P and Q yields $$\overline{P}\cdot\overline{Q}=\overline{A}\cdot\overline{B}=\overline{A}\cdot\overline{B} \tag{11}$$

Figure 5B:
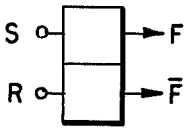
Figure 5A:
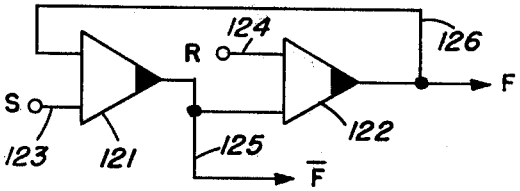

FIG. 5*a* illustrates a bistable multivibrator, hereinafter referred to as a flip-flop, composed of two NOR gates 121 and 122, the SET (S) terminal being 123 and RESET (R) terminal being 124; the output of gate 121 yielding the negative of the function ($\overline{F}$) and feeding the other input 125 of gate 122, and the output of gate 122 yielding the FUNCTION (F) and being fed back to gate 121 providing the other input 126 thereto. If an input appears at the SET terminal, the output 125 is a logical 0 and with no input to NOR 122, the output of that NOR yields a logical 1 or F, this being fed back to the NOR 121, so that the flip-flop remains with gate 121 yielding a 0 and 122 yielding a 1. When an input is applied to NOR 122 on RESET terminal 124, the output 126 becomes 0 and a 0 input to 121 on lead 126 yields an output on lead 125, which is a 1 on the $\overline{F}$, and a 0 on the F output of gate 122. The logci symbol for a flip-flop used hereinafter is shown in FIG. 5*b*. The F and $\overline{F}$ outputs may also be referred to as the set output and reset output, respectively.

MAGNETIC CORE

Figure 6:
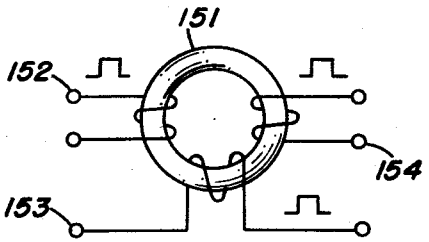
FIG. 6 shows a square loop magnetic core storage device.

The square hysterises loop magnetic core is one of the devices used for storage and delay in the present invention. A magnetic core may be a toroidally shaped element made of magnetic material which has a substantially square hysterises loop, and will remain magnetized in either a "clockwise" or "counterclockwise" direction along the toroid for an indefinite time period or until a pulse is applied thereto to change the direction of magnetism. Thus, the core may function as a binary element having two stable states (one direction of magnetism assigned a binary value of 1 and the other a binary value of 0) capable of storing a single bit or unit of information. Such a device is shown in FIG. 6, core 151 having two input windings, 152 and 153, and an output winding 154 thereupon. Assuming that a current in the clockwise direction is representative of a binary 1 and a current in the counterclockwise direction is indicative of a 0 and that the core is initially set in the 0 state, a positive input pulse on lead 152 would cause the core to switch from the 0 to the 1 state. Applying a pulse, the winding 163 would cause a reversal of magnetization and switch the core back to the 0 state, causing an output pulse to appear on winding 154 indicative of the switching action. If the core were in the one state and a pulse was applied to winding 152, no switching action would occur since the core was already set and no output would result. The core circuit shown in FIG. 6 may be used as a single bit delay, input coil 153 acting as a source of a shift pulse, since a 1 stored therein is not read out until another pulse is applied.

Figure 7:
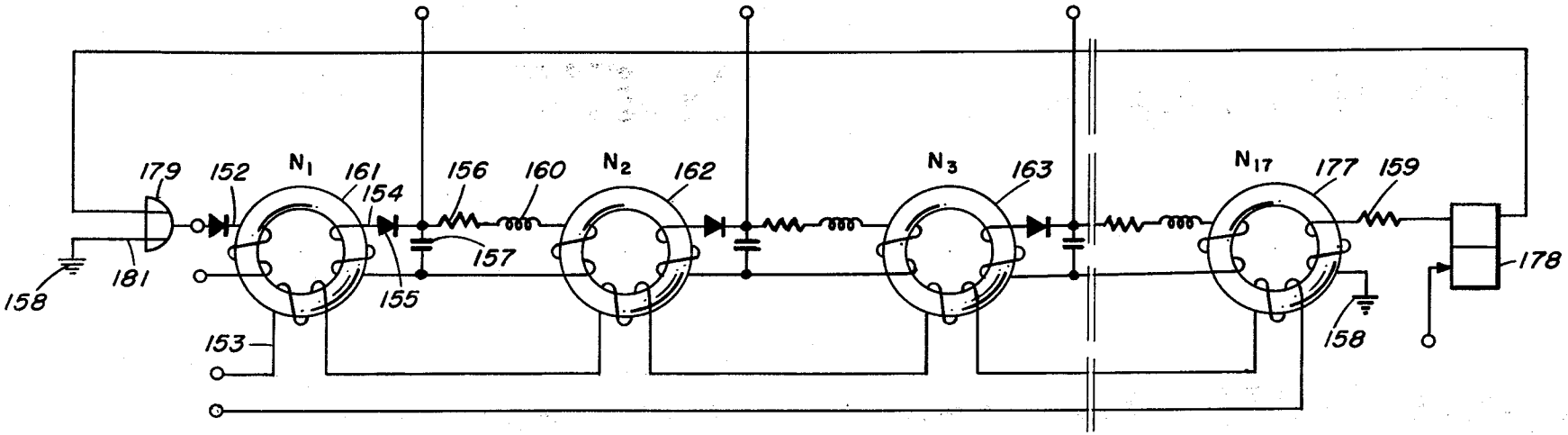
FIG. 7 illustrates a magnetic core shift register.

FIG. 7 shows a schematic diagram of a 17 bit, single core per bit, shift register. This circuit may be used as a delay for any of 1 to 17 bits or as a circulating memory.

The shift register is composed of 17 identical core stages cascaded together, only 4 of which are shown for simplicity. Each core 161 to 177 has an input or write winding 152, a shift or advance winding 153, and an output winding 154. The output winding 154 is connected in a loop with the input winding 152 of the next successive core with a series diode 155, a resistor 156, an inductor 160 and a capacitor 157. The output winding of the last core 177 is connected between ground 158 and through a resistor 159 to the set terminal of a flip-flop 178. The terminal of the flip-flop is directly connected to one input lead of an OR gate 179, the other input terminal of which is connected directly to ground 158. The output terminal of OR gate 179 is connected to the low side of input winding 152 of core 161. All of the shift pulse windings 153 are connected in series one with the other, thus a shift pulse appearing at one core will appear at all the others.

This register is driven by the OR gate which may be a NOR gate with the connector supply disconnected. If a write pulse appears at terminal 181 when the gate is conducting, a low impedance path to ground is available through the transistor causing a flow of current through diode 152. This sets the core 161 to the 1 state, or if the transistor is not conducting upon the appearance of a write pulse, the flow therethrough is modified and the core remains in the 0 state. A pulse applied at terminal 153 resets all the cores to 0 state. If any of the cores are in the one state upon appearance of a reset pulse, the change in flux across the output coil causes the capacitor following it to charge. This capacitor then discharges, setting a 1 in the next core. Thus, the information is shifted from core to core.

BINARY ADDITION

The truth table for binary addition is shown in Table VII.

TABLE VII

| A | B | S MSD | S LSD |
|---|---|---|---|
| 0 | 0 | 0 | 0 |
| 0 | 1 | 0 | 1 |
| 1 | 0 | 1 | 0 |
| 1 | 1 | 1 | 0 |

In Boolean notation, the sum may be expressed as $$(A+B)\,\overline{(A\cdot B)}=S \tag{12}$$

multiplying out, $$A\cdot\overline{A}+A\cdot\overline{B}+\overline{B}\cdot A+B\cdot\overline{B} \tag{13}$$

A·A and B·B are equal to 0 for all conditions because if A=1, $\overline{A}$=0, and if A=0, $\overline{A}$=1, then $$A\cdot\overline{A}=0 \tag{14}$$

Hence, equation (13) becomes $$A\cdot B+A\cdot B=S \tag{15}$$

which equation will satisfy the truth table. If A and B are both 0, then A=1 and B=1, substituting $$0\cdot 1+1\cdot 0=S \tag{16}$$

$$0+0=0 \tag{17}$$

If A=0 and B=1

$$1\cdot 1+0\cdot 0=S \tag{18}$$

$$1+0=1 \tag{19}$$

and the same result occurs if A=1 and B=0 If A=1 and B=1

$$1\cdot 1+1\cdot 1=S \tag{20}$$

$$1+1=1 \tag{21}$$

A more detailed explanation of the Boolean manipulation may be found in Chapter 10 of IRWIN, *Digital Computer Principles,* (D. Van Nostrand Company, Inc., Princeton, New Jersey, 1960, pp. 55 to 64.)

To mechanize equation (15), proven above, basic logic units may be used. Referring to FIG. 8*a*, the term $\overline{A}\cdot B$ is generated by AND gate 171 with an inverter 172 at the A input terminal, thus yielding an output of $\overline{A}\cdot B$. In a similar manner, the $A\cdot\overline{B}$ term is generated by gate 173 with an invertor 174 at the B input terminal. These terms are combined in OR gate 175 to yield the least significant digit (LSD). This, however, is only a portion of the addition. The most significant digit (MSD) must be generated also. Comparing the MSD column of truth Table VII with that of Table I indicates that an AND circuit gate may be used to generate this function.

Therefore, A and B are applied to AND gate 176 to produce the MSD, or carry digit.

If words of more than two bits are to be added, two of these circuits may be cascaded, the MSD, or carry output, serving as an input for subsequent bit addition stages. This is one of many types of adders that may be used in the present invention. A shorthand notation for an adder is shown in FIG. 8*b*.

DIGITAL DIFFERENTIAL ANALYZER

The computer of the present invention is of the incremental wired program type. In such a computer, computation is performed by computing and transferring incremental changes of the entire number or quantity being operated upon.

One of the major subunits used in this computer is the digital differential analyzer (DDA), integrator or adder, hereinafter referred to as a DDA, shown in FIG. 9*a*.

This is composed of two registers, the y register 181 and the accumulator, or r register 182, both of which may be magnetic core registers of the type referred to hereinbefore and shown in FIG. 7, and an addition circuit 183. The y register 181 contains the number y composed of N bits. Each time dy is pulsed, a 1 is added to the LSD in the y register, and each time a dx pulse appears, the contents of the y register are added to the contents of the accumulator. The y register is in no way affected by the addition. If the addition results in a carry from the MSD of the accumulator, a dz pulse appears on output lead 187.

The relationship between input and output pulses is determined by the equation $$dz = \frac{1}{r^n}\, y\, dx \tag{22}$$

where y is the value of the number in the y register, r is the radix of the number system used, and n is the number of digits in the registers.

Assuming the time rate of the computer to be dt, equation (22) becomes $$\frac{dx}{dt} = k\, y\, \frac{dx}{dt} \tag{23}$$

where $1/r^n$ will be a constant $$(1/r^n = K \tag{24}$$

Thus, the output rate is proportional to the value of y and the rate of dx pulses. For example, consider a register where y=500, n=4, and r=10

$$\frac{dy}{dt} = \frac{1}{10^3}(500)\frac{dx}{dt} \tag{25}$$

or $$\frac{dy}{dt} = \frac{1}{2}\ \frac{dx}{dt} \tag{26}$$

which means that output pulses will appear at one-half the rate of input pulses.

The functional symbol for a DDA is shown in FIG. 9*b*.

Any integral equation can be solved by interconnecting various DDA's.

To illustrate, a solution of a simple equation such as $$dy/y = dx \tag{27}$$

This equation may be solved with just one integrator, and hence just one integration.

Knowing that the solution is $y=e^x$, and clearing the fraction from the left side of equation (27), it becomes $$dy = y\, dx \tag{28}$$

Equation (28) is the equation for a DDA, so $$dy = dz \tag{29}$$

and then $$y = ke^x \tag{30}$$

Figure 9C:
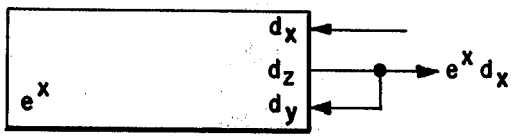

Thus, the DDA takes the form shown in FIG. 9*c*, where the dz output is connected to the dy input and $$y = e^x \tag{31}$$

To make $$k = \frac{1}{r^n} = 1 \tag{32}$$

the decimal point of the number is defined as being to the left of the MSD.

EQUATIONS

As stated hereinabove, the basic equation which controls the guided portion of flight of the missile is Vg=Vc−Vm (1) wherein Vg is equal to the velocity to be gained, Vc is equal to the computed or correlated velocity, and Vm is equal to actual velocity of the missile. Using a simplified scheme of guidance control, correlated velocity is defined as that velocity normal to a plane 45 degrees from the horizontal which will carry the reentry body to the target by free fall. There is no requirement for a fixed time of flight. The correlated velocity (Vc) is a velocity at any time (t) during the powered portion of flight and is a function of the missile position at that time. The target position at the time of launch is the velocity in the horizontal (Z) plane at time t and t itself. Thus, $$Vc = Vc\ (R,\ Rt,\ Vmz \text{ and } t) \tag{33}$$

R and Rt are positional vectors relative to some initial position and Vmz is the missile's velocity in the Z plane. Since Rt is a variable representative of the target position, this may be precomputed. Therefore, it yields $$Vc = Vc\ (R,\ Vmzt) \tag{34}$$

Deriving this equation with respect to time, we have $$\frac{dVc}{dt} = \frac{\partial Vc}{\partial R}\ \frac{dR}{dt} + \frac{\partial Vc}{\partial Vmz}\ \frac{dVmz}{dt} + \frac{\partial Vc}{\partial t} \tag{35}$$

The symbol ∂Vc/∂R represents a matrix of partial derivatives of a component of Vc with respect to missile positional changes. The quantity ∂Vc/∂Vmz is the partial derivative relative to changes in the missile's Z velocity. dR/dc is the time rate of change of position and may be broken down into three componenrts in the X, Y and Z planes, Vmx, Vmy and Vmz. The term (dVmz/dt) is missile acceleration in the Z direction, which equation may be represented as the output of an ideal accelerometer, plus the component of gravity along that axis. The missile that has attained Vc and then cutoff will continue to have such velocity during its free fall, since gravity alone is acting upon the missile. Therefore, equation (35) may be written as $$\frac{Gx}{Gy} = \frac{\partial Vc}{\partial R}\begin{Bmatrix} Vcx \\ Vcy \\ Vcz \end{Bmatrix} + \frac{\partial Vc}{\partial Vmz} Gz + \frac{\partial Vc}{\partial t} \tag{36}$$

The Vg factor may be defined as the difference between the Vc factor and the actual velocity in the X and Y planes $$\begin{Bmatrix} Vgx \\ Vgy \end{Bmatrix} = Vc - \begin{Bmatrix} Vmx \\ Vmy \end{Bmatrix} \tag{37}$$

The time derivative of equation (37) is $$\begin{Bmatrix} \frac{dVgx}{dt} \\ \frac{dVgy}{dt} \end{Bmatrix} = \frac{dVc}{dt} - \begin{Bmatrix} \frac{dVmx}{dt} \\ \frac{Vmy}{dt} \end{Bmatrix} \tag{38}$$

(dVmx/dt) may be expanded to the ideal output of the accelerometers and gravitational acceleration $$\frac{dVmx}{dt} = Atx + Gx \tag{39}$$

Similarly, $$\frac{dVmy}{dt} = Aty + Gy \tag{40}$$

Substituting in equation (38) and rearranging yields $$\frac{dVc}{dt} = \begin{Bmatrix} \frac{dVgx}{dt} \\ \frac{dVgy}{dt} \end{Bmatrix} + \begin{Bmatrix} Atx + Gx \\ Aty + Gy \end{Bmatrix} \tag{41}$$

By further substituting equations (41) and (37) into equation (36) we have $$\begin{Bmatrix} \frac{dVgx}{dt} + Atx + Gx \\ \frac{dVgy}{dt} + Aty + Gy \end{Bmatrix} = \frac{\partial Vc}{\partial R}\begin{Bmatrix} Vcx - Vgy \\ Vcy - Vgy \\ Vmz \end{Bmatrix} + \frac{\partial Vc}{\partial Vmz}(Atz + Gz) + \frac{\partial Vc}{\partial t} \tag{42}$$

$$\begin{Bmatrix} \frac{dVgx}{dt} + Atx \\ \frac{dVgy}{dt} + Aty \end{Bmatrix} = \frac{\partial Vc}{\partial R}\begin{Bmatrix} -Vgx \\ -Vgy \\ 0 \end{Bmatrix} + \frac{\partial Vc}{\partial Vmz} Atz \tag{43}$$

Rearranging equation (43)

$$\frac{dVgx}{dt} = -Atx - \frac{\partial Vcx}{\partial x} Vgx - \frac{\partial Vcx}{\partial y} Vgy + \frac{\partial Vcx}{\partial Vmz} Atx \tag{44}$$

and $$\frac{dVgy}{dt} = -Aty - \frac{\partial Vcy}{\partial x} Vgx - \frac{\partial Vcy}{\partial y} Vgy + \frac{\partial Vcy}{\partial Vmz} Atx \tag{45}$$

These are the functional equations solved by the computer. The equations (44) and (45) may be simplified by choosing specific steering equations, and since the Z velocity steering equation is independent of variance in trajectory, the last term in both of the above equations is fixed with respect to time.

The simplification of equations (44) and (45) is explained in co-pending application, Ser. No. 502,717 and a detailed description serves no advantage in the instant application. The simplified equations, and a further skew factor equation upon which the computer acts, take the form:

$$\Delta Vgx = -[Qxx\ Vgx\ \Delta t + Qxz\ Vgz\ \Delta t] - \Delta Vx \tag{46}$$
$$\Delta Vgy = -[Qyx\ Vgx\ \Delta t] - \Delta Vy \tag{47}$$
$$\Delta Vgzsk = -\Delta Vz + m\ \Delta Vx \tag{48}$$

Equations (46), (47), and (48) are fed into the computer which yields solutions to the pitch and yaw steering equations which have been chosen as follows:

$$\Delta\theta = K1\ Vgz + K2\ [\Delta Vz - SKU\ \Delta Vx] \tag{49}$$

and $$\Delta\cap = K3\,Vgy\Delta t - k3[\Delta Vy] \tag{50}$$

GENERALIZED FUNCTIONAL DESCRIPTION

Referring now to FIG. 10, a functional block diagram of the present invention, there is shown a computer clock 200 receiving a synchronization signal from the fire control system (not shown) and output leads PW, PS and PT which are connected to a pulse or bit time generator 400, the outputs from which, P1 to P17, are supplied to a word time generator 600. An output signal Z17 from the word time generator is transmitted to functional timing circuits 800. The timing circuits also receive inputs from the fire control system as shown.

The accelerometer decoder circuits 1000 receive input signals from the accelerometers on the stable platform.

Outputs from the decoders 1000 are fed to Q computation circuit 1200, a velocity to be gained (Vg) computation circuit 1400, pitch steering circuits 1600 and yaw steering circuit 1800.

The Q computation circuit 1200 also receives inputs from the timing circuit 800 and supplies output signals to the Vg computation circuit 1400 and the pitch circuit 1600. The Vg computation circuits also receive signals from the fire control. Outputs from the Vg circuits 1400 are fed back to the Q computation circuits 1200, and fed to the pre-arm circuits 2000, the cutoff circuits 2200 and the pitch and yaw steering circuits 1600 and 1800, respectively.

The pitch steering circuit 1600 receives an additional input signal from the timing circuit 800 and supplies output signals to the flight control autopilot, not shown. The yaw input circuit output signals are also transmitted to the flight control autopilot (not shown). the pitch and yaw circuits are connected to the timing circuit, as are the prearm and cutoff circuits.

The clock circuit 200 provides the basic timing signals necessary for operation of the computer. Clock pulses are used by the logic circuitry and shift registers throughout the computer. Synchronization pulses from the fire control unit, received by the clock, synchronize the clock with the fire control system's clock circuitry. The clock generates the following signals: a write pulse (Pw), which is a basic pulse in the computer, enabling information to be written into the delays and shift registers, and synchronizing the guidance computer with the fire control; the shift pulse (Ps) which functions to shift all of the information in the magnetic cores; the reset pulse (Pr) which resets all the "information" flip-flops in the computer; the uninhibited write pulse (Pn) occurring at the same rate as Pw which causes information to be written into a delay or first stage of a register; and a transfer pulse (Pt) generated immediately after Ps which causes transfer of information from stage to stage of the shift registers. These pulses are fed to various elements within the computer as will be disclosed hereinafter. The Pw, Ps and Pr signals from the clock 200 are fed to the pulse or bit time generator 400.

The pulse generator 400 produces a series of "bit" time pulses which control the sequence of events in the computer. The computer operates on a seventeen "bit" information unit or word. Hence, the pulse generator produces 17 identical pulses per second, designated P1 through P17. These pulses are also provided to various elements within the computer. Lead P1–P17 conveys these pulses to word-time generator 600.

The word time generator receives the P signals as a reference, and generates three word signals X, Y and Z, each of which is equivalent in time to 17 "P" signals. The computer operates on a 17-bit-per-word, three-word-per-frame timing basis. Each bit pulse is further identified by the particular word in which it appears. For example, bit time pulse 4 in word Y will be designated as Y4.

The functional timing circuit 800 generates timing signals of a special nature; that is, signals of a non-recurring nature. Timing in this network is based upon and begins with the start computation (SC) signal received from the fire control, and thereby this circuit provides a real-time basis for the computer.

By counting the number of times a pulse, which occurs at a known rate, occurs, elapsed time may be measured. The last pulse in the Z frame or word (Z 13) is utilized as a reference.

Signals generated by timing circuit are:

A Tc pulse generated at a predetermined time after the SC signal, which pulse initiates the guided flight mode by enabling the computer to generate steering command in the pitch and yaw steering circuits 1600 and 1800 and transmits these commands to the autopilot. The Tc pulse is also sent to the pre-arm circuit 2000, the operation of which circuit is inhibited until receipt of this pulse.

The next pulse generated by the timing circuit is the Tt pulse which prohibits the Vgz term from entering the Vg computation circuits 1400 for the remainder of the flight, increases the gain of the pitch command circuit and modifies the scaling and constants of the pitch equation, thereby allowing closer conformity to precomputed flight and modifying the positive pitch signal which prevent positive pitch excursions of the missile.

A Tco signal is also generated by these circuits which negates an inhibit signal generated within the cutoff circuitry, thereby preventing premature separation of the reentry body from the missile proper.

Additionally, the timing circuit 800, generates constant rate timing functions, designated as NPPS, Qyz Δt and 800PPS, the function of which will be discussed hereinafter.

The accelerometer decioder circuit 1000 samples the output of the stable platform and produces signals indicative of the direction and magnitude of change in velocity of the missile. These signals are designated at ΔV's and are in a form suitable for use in the computer. The signals are fed to the Q computation circuits, Vg computation circuits, and to the pitch and yaw steering control inputs.

The Q constants from fire control are gated to the Q computation circuit 1200 and stored therein.

The Q computation circuits 1200 are utilized to generate pulses at a rate proportional to the magnitude of the Q matrix quantities read into the computer from the fire control. These pulses generated by the Q circuits, modify the velocity to be gained signals (Vg) generated by the Vg computation circuits 1400.

The Vg circuits 1400 receive initial velocity to be gained quantities from the fire control, store these signals, and modify the Vg terms in accordance with the outputs from the Q circuits 1200 and the accelerometer decoder circuit 1000 output signals. The pulses (ΔV's) from the decoder 1000 modify the Vg terms and the Q pulses correct these terms both as a function of elapsed time and missile flight. The Q terms modify the Vg's to correct for unmprogrammed flight variations.

A functional block diagram of the Vg generator loop, FIG. 11, consists of the Q computation circuits 1200 and the Vg computation circuits 1400 along with special timing circuits. Input signals fed to the Q computation circuits are the Q and SKU signals which are fed to the real-time [R(t)] register 1201, signals from which are fed to and received by a timer 1202. The timer is connected to gates 1203 and 1204, the output of which is fed to a summer 1205.

Gate 1206 is fed ±ΔVx signals from the accelerometer decoder 1000 and gate 1207 is fed input signals from Q summer 1205. A Qxx register 1208 feeds Q summer 1205. The output of Q summer 1205 is fed to three registers, 1209, 1211 and 1213, which are connected in a series loop with the Q summer and are designated the QVgΔt, VgΔt and SKU registers, respectively. The output of register 1213 also is connected to gate 1206.

Other outputs of Q summer 1205 are connected to the input of the ΔVg generator 1401, which is part of the Vg computation circuit 1400, to which generator are also fed the outputs of the accelerometer decoder circuits 1000. The output of the generator 1401 is fed to the Vg adder or summer circuits 1402, which output is fed to a series loop of registers, 1403, 1404 and 1405, designated as Vgx, Vgy and Vgz, respectively. The output of the Vgx register is fed back to an input to the adder 1402 and to gate 1203 of the Q circuits 1200. The output of the Vgz register 1405 is fed to gate 1204. Outputs from this loop are taken from the Vgx, Vgy and Vgz registers, 1403, 1404 and 1405, and are fed to the pitch and yaw steering circuits 1600b and 1800, and to the prearm and cutoff circuitry 2000 and 2200.

The timer 1202 functions in conjunction with the Rt register 1201 to permit the Vg loop to operate in a time-shared real-time mode.

For every ΔVx signal received during X word time a skew (SKU) signal is added into register R(SKU) 1213. The carry output of Q summer 1205, if such signal is sensed at time X8, is considered to be an overflow of register R(SKU). An overflow is equivalent to a −ΔVz. This −ΔVz signal is the skew figure added to the Z acceleration bit. Physically, one register is sufficient for both storage of the SKU signal and the R(SKU) signal. SKU is a 9-bit word and R(SKU) is an 8-bit word. ΔVgz and ΔVgy consist of only acceleration bits. These equations are instrumented simply by gating the acceleration bits along with the overflow of register 1403; that is, the SKU overflow into the ΔVg generator 1401. The ΔV signals, along with QVgΔt signals, generate the appropriate ΔVg signals, which are added to the proper Vg signals in the Vg summer 1402. Equation (46) is reproduced here for convenience.

$$\Delta Vgx = -[Qxx\ Vgx\Delta t + Qxz Vgz\ \Delta t] - \Delta Vx \quad (46)$$

Generation of the last term; that is, −ΔVx has already been discussed. The remaining two terms are generated as a single output by combining these terms. Every other Y time, Vgx is added into register R(VgΔt) 1211. The Vgx term is gated by the (ΔtVgx) signal generated by the timer 1202. Immediately following addition of this term during Z time, Qxx is added into register 1209 for every overflow from R(VgΔt) register 1211. During reset time, receiving the addition into register 1213, Vgz is gated from register 1211. This term is always assumed to be negative. The overflow of register 1211 is the output which represents the first two terms in equation Qxx Vgx Δt −Qxz Vgz Δt. By addition of a Qxx into register 1209 for each overflow of register 1211, subtraction of Qxz Vgz Δt is accomplished.

At Tt time, the ΔV gz term is added to Vgz through the Vg summer 1402. A gating signal, generated via Q summer 1205, gates this constant and also serves to inhibit any ΔV signals which might be coincident in time with this gating signal. The Q summer 1205 is basically a digital differential analyzer, adding the proper inputs to the contents stored in its associated registers, 1209, 1211 and 1213, and updating these quantities.

The outputs from the Vg computation circuits are fed to the pitch and yaw steering circuits 1600 and 1800, shown in FIG. 10, which circuits solve the missile steering equations in a manner described hereinafter, and issue command signals to the missile flight control autopilot (not shown) which control the trajectory of the missile in the pitch and yaw planes.

The Vg outputs are also fed to the pre-arm and cutoff computation circuits 2000 and 2200.

In conjunction with the Vg signals, after a predetermined time of flight, upon receipt of a signal from the timing circuit, the circuit 2000 generates a pre-arm command signal which arms the missile.

When the Vg signals are less than a predetermined magnitude, the cutoff circuitry 2200 generates a command signal which results in separation of the re-entry body from the remainder of the missile.

DETAILED DESCRIPTION

Computer Clock

The computer clock 200, a block diagram of which is shown in FIG. 12, provides the basic timing for the guidance system. The clock may be divided into four functional units; the oscillator synchronization circuit 201, the oscillator 251, divide-by-three circuits 301, and driver and output circuits 351. A lead from the fire control is connected to the input of the oscillator synchronization circuit 201, the output of which circuit is connected to the oscillator 251. The output of the oscillator is connected to the divide-by-three circuitry and driver and output circuits 351 and the oscillator sync 201. The divide-by-three circuit is connected to the sync circuit 201, and to the driver and output circuits 351. The sync circuit 201 synchronizes the highly stable oscillator 251 by comparing sync pulses from the fire control with pulses generated by the clock 200. The output of the clock oscillator 251, a square wave, is applied to pulse generator divide-by-three circuit 301 and fed back to the sync circuit 201. The divide-by-three circuit 301 generates signals used throughout the computer, which signals will be discussed hereinafter. The driver and output circuit 351 provides write and timing pulses. Inputs thereto are a signal generated by divide-by-three circuit 301, and the erase signal from the fire control. The write pulse (Pn) is used to write all information into the magnetic core registers, with the exception of the pulse and word time generator. The Pw impulse is used for this purpose. The driver and output circuit 351 produces clock timing pulses from the phase 1 through 4, and 6 signals produced by the divide-by-three circuit. The oscillator sync circuit 201 compares the frequency of the fire control clock (not shown) with that of the guidance computer.

OSCILLATOR CIRCUIT

Referring now to FIG. 13 of the drawings, a block diagram of the oscillator 251, there is shown a first amplifier means or stage 252, having an external input lead 253 from the sync circuit 201. The output of amplifier 252 is connected to one terminal of a quartz cut crystal 254, and the other terminal is connected to another input to the amplifier 252. The output of amplifier 252 is also applied as an input to a second amplifier means or stage 255, the output of which second amplifier feeds pulse shaper 256. The output of stage 255 is also applied to a D.C. feedback means or network 257. The signal from the D.C. feedback means is fed back to amplifiers 252 and 255. Output 258 of pulse shaper 256 is fed to the driver and output circuits 351 and divide-by-three circuit 301.

In operation, the frequency determining device of the oscillator is the crystal 254, control for which is provided by a synchronization signal (hereinafter referred to as sync signal) received on lead 253 and the first amplifier means 252.

The D.C. feedback loop 257 controls the voltage output of amplifier stage 252 by limiting its gain. This circuit allows the oscillator to have a very fast starting time because, when the circuit is turned on, the feedback loop will not be limiting the output from amplifier means 252. With no D.C. feedback, the crystal 254 will have a high current, and amplifier stage 252 will have a large voltage output. However, this large voltage output will not be sustained, because the feedback network 257 will begin to bias amplifier 252 so as to reduce its gain. This reduction in gain will continue until the overall gain of the oscillator is equal to 1, the necessary closed loop gain for steady state operation. Thus, the D.C. feedback loop is the major controller of the output of amplifier 252 and the closed loop gain.

When the gain of the oscillator is reduced to 1, the D.C. feedback network 257 will be the controlling element. The feedback loop 257 can now be adjusted to control the level of oscillation and, thus, keep the crystal current at a low level during steady-state conditions. D.C. feedback is also used to regulate the bias of the second amplifier means 255 for added stability of operation.

Pulses on lead 253 from external equipment will enable the oscillator to maintain synchronization with other equipment by changing parameters which form part of amplifier stage 252 and are in series with the crystal 254.

Turning now to FIG. 14, a detailed schematic diagram, there is shown a source of D.C. voltage 261 having a resistor 262 in series with a lead or bus 263 from the positive side and a lead or bus 264 from the negative side of the source 261. A combination of a diode 270 and capacitors 265 to 267 are in parallel connection between leads 263 and 264.

A first NPN transistor 268, forming a portion of amplifier stage 252, having base, collector and emitter leads extending therefrom, **268*b*, 268*e* and 268*c*, is connected between the leads 263 and 264 in common emitter configuration. The base lead 268 is connected to the positive bus 263 via a resistor 269 and to the negative bus 264 via the combination of a resistor 271 in series with the parallel combination of a capacitor 272 and a resistor 273. The capacitor 272 and resistor 273 form a portion of the D.C. feedback network 257 as shown in FIG. 13. The collector lead 268*e* is connected to the positive bus 263 via a terminal point 274, an inductor coil 275 and a resistor 276 in series, and is connected to the negative bus 264 via terminal point 274 and capacitors 278 and 279 in series circuit relationship. The emitter lead 268*c* is tied to the negative bus 264 through a resistor 281. Between the emitter lead 268*c*, junction 274 and the base terminal 268*b* is a series loop of the precision cut crystal 254, a variable capacitor or varicap 282, and a capacitor 283. Also tied between the connection of the crystal 254 and the varicap 282 at the common junction 284, and the base terminal 268*b* is a parallel capacitor 285. Between the junction of varicap 282 and capacitor 283, and the negative bus 264, a biasing resistor 286 is connected, and between the junction of capacitor 283 and base terminal 286*b*, and the negative bus 264, is a capacitor 277. The sync lead 253*a* is connected to the junction point 284 via a terminal point 288 and series resistors 289 and 291, and the sync lead 253*b* is tied to the junction point 288 via the resistor 292, a fixed end of which resistor is tied to junction point 288. Between resistors 289 and 291, a capacitor 290 is tied to bus 264. The terminal point 288 is ited to the positive bus 263 through a variable resistor 293**.

Tied to the junction of capacitors 278 and 282 is the base lead **294*b* of an NPN transistor 294, via a coupling resistor 295. This transistor is also connected in the common emitter configuration and forms the second amplifier stage 255. Biasing of the base terminal 294*b* and collector terminal 294*c* is accomplished by connection to the positive bus 263 via resistors 296 and 297, respectively. The emitter terminal 294*c* is biased by resistor 298 connected to the negative bus 264**.

The output of the oscillator is taken from the collector terminal 294 over lead 299, and is also fed back over lead 280 through a diode rectifier 270 and resistor 263 to the base terminal **294*b*. D.C. feedback to transistor is accomplished from lead 280, diode 259 and resistor 273**.

The D.C. source 261, which is regulated by the network consisting of series resistor 262 and the parallel combination of diode 259 and capacitors 265 to 267, provides biasing voltages for the oscillator. The oscillator generates a fixed high frequency sine wave which is determined by the characteristics of the quartz crystal 254 and the effective lumped capacitance of capacitors 282, 283 and 285 in series therewith. The voltage across the varicap 282 is determined by the values of the resistors 293, 289, 291 and 286 and the voltage thereacross which biases the varicap. The varicap's impedance varies in accordance with the voltage appearing thereacross. Therefore, as the bias across the varicap changes, the effective capacitance of the network of capacitors 282, 283 and 285 varies to change the oscillating frequency of the crystal. The oscillator action may be likened to that of a conventional transistor oscillator with the collector base tuned circuit replaced by the crystal and capacitance. This replacement offers greater temperature stability and a high degree of accuracy.

With no sync signal appearing on leads **253*a* and 253*b*, the voltage at junction 288 is determined by the value of resistance, and the oscillator output may be adjusted by adjusting the wiper arm of resistor 293 to provide the proper bias to the varicap 286. To tune the crystal to its nominal frequency, the parallel combination of capacitors 283 and 285 is utilized. The tank circuit of resistor 276, coil 275 and capacitors 278 and 279** function to maintain the oscillator insensitive to spurious outputs from the crystal.

The base biasing resistors 269, 271 and 273 bias transistor 278 near cutoff value and make the biasing compatible with the D.C. feedback network 257 which includes the resistor 273. Emitter biasing of transistor 268 is provided by resistor 281 which establishes a high loop gain to insure fast starting action. The output of amplifier means 255 is taken from point 274 and coupled to the base of transistor 294 via coupling capacitor and resistors 278 and 295, respectively. The signal is amplified thereby and the output appears on lead 299. The emitter biasing resistor 278 and the collector load resistor 297 are picked to provide the necessary gain for feedback and compatibility with the following circuitry.

D.C. feedback to transistors 268 and 294 is provided by the path through diode 259 and either of resistors 271 and 260, limiting the gain of transistors 268 and 294 to provide an all-over gain of unity thereby stabilizing the device.

By sampling a portion of the output signal and comparing it with a signal with which the oscillator is synchronized and producing a sync signal, which, for example, may be pulsed D.C., capacitor 290 will be charged through the integrator action of the combination of capacitor 290 and resistor 299. The charge on the capacitor will discharge through resistor 291 and influence the bias on varicap 282, thus changing the frequency of oscillation of the device dependent upon the magnitude and sense of the sync signal.

THE DIVIDE-BY-THREE CIRCUIT

The divide-by-three logic circuit 301, a diagram of which is shown in FIG. 15, comprises NOR gate 302, through which is applied the output from the saturation amplifier of the oscillator 251. The output of gate 302 is fed to a triggered flip-flop 303. This circuit differs from the flip-flops described hereinbefore in that an input thereto via capacitors 304 and 305 will change the state of the device regardless of its previous state. Hence, differing in function from the conventional flip-flop in that a logic 1 input is the only signal that will cause a change of state.

Referring to FIG. 16 in conjunction with FIG. 15, assuming both flip-flops are in the set condition, the output of the oscillator 251 is divided by three; that is, the repetition rate of this circuit's output is three times as great as that of the oscillator. The divide-by-three circuit also produces various pulse trains that are fed to the driver and output circuits 351. These are called phase 1 to phase 6 signals. The phase 2 output of the divide-by-three circuit is the result of inversion of phase 1 input (the oscillator output) by gate 302. Triggered flip-flop 303 responds to the phase 2 input pulse and causes it to change state. The output phase 3 now becomes a logic 1 and phase 4 output becomes a logic 0. The leading edge of the phase 4 output, as it reverts to logic 0, is differentiated by the input capacitors 304 and 305 of flip-flop 306 causing this flip-flop to change state. The second phase to input 2 flip-flop again causes this flip-flop to change state. Phase 4 output does not affect flip-flop 306. The third input pulse causes a change of state. Phase 4 output is differentiated and causes flip-flop 306 to change state. Outputs phase 4 and phase 5 both now are at a logic 0 and enable gate 307 to produce a Pfc signal which resets flip-flop 303, immediately causing phase 3 signal to revert to a logic 0, and therefore requiring three input pulses. Divide-by-three function is accomplished essentially by the generation of Pfc during every third input pulse. This can be ascertained from the waveforms of FIG. 16.

The oscillator sync circuit 201 has three modes of operation, when no sync signal is received from the fire control, when the oscillator is generating signals that lag, those from the fire control, and when the oscillator signals are leading those from the fire control. During the fire control test, no signals are received over the sync lead. During this mode, the computer clock, with the oscillator free-running, is checked for proper frequency output and the sync circuit is inoperable. If any change in frequency occurs between the fire control and the guidance thereafter, the oscillator sync will cause a change of frequency in the oscillator. After launch of the missile, since no fire control signals are received, the oscillator returns to its free-running condition and hence, the sync circuit is inoperable.

SYNCHRONIZATION

The synchronization circuit as shown in FIG. 17 comprises five NOR gates, two flip-flops and two OR gates. An input lead from the fire control applies the sync signal to the single input NOR circuit 302, the output of which is applied as an input to NOR gate 303. The sync signal from the fire control is also applied to the "SET" terminal of flip-flop 304, and a signal generated by the word time generator, the XIT signal, the generation of which will be described hereinbelow, is applied to the "RESET" terminal of the flip-flop 304. Ø3 and Ø6 signals, generated by the divide-by-three circuit, are applied to the input terminals of NOR circuit 305, the output of which is applied to one input terminal of NOR gate 306, to the outer terminal of which a Pfc signal generated by the output circuitry is applied. The output of NOR gate 306 is applied to an input terminal of NOR gates 307 and 303. The output signal from gate 303 is applied to "SET" terminal of flip-flop 308 and to another input of NOR 307. The "F" or "1" output of flip-flop 304 is also applied to the "SET" terminal of flip-flop 308. The third input to NOR gate 307 is a Ø1 signal which is the output of the oscillator circuit 251. The output of gate 307 is connected to the "RESET" terminal of flip-flop 308. The "F" or "1" output terminal of flip-flops 308 and 304 are connected to single input OR gates 309 and 310, respectively, the outputs of which gates are applied to the input terminals **253*a* and 253*b* of the oscillator 251**.

The function of the synchronization circuit is to synchronize the oscillator with the sync pulse received from the fire control unit. When the sync signals are received by the fire control, NOR gate 310 produces a logical 0 and NOR gate 309 produces a logical 1. When the sync signal lags, the oscillator output signals both NOR gates 309 and 310, producing a logic 1. When the sync pulses lead the oscillator output, OR gate 310 produces a 1 output and 309 produces a 0.

OSCILLATOR SYNC CIRCUIT UNDER STATE 1

Refer to FIGS. 14, 17 and 18. The XIT pulse, which occurs during each X1 time, except the first time after erase, will reset flip-flop 304. Resetting the flip-flop will cause a logic 1 to be sent to OR gate 310 and the set side of flip-flop 308. A logic 1 applied to flip-flop 308 will set the flip-flop and cause a logic 0 to be applied to OR gate 309. OR gates 309 and 310 will invert the logic so that the output of OR gate 309 is a logic 0 while the output of OR gate 310 is a logic 1. Resistor 293 of the oscillator 251 will then have −10 VDC, logic 0, applied to it while the output from OR gate 310, the junction 288, is floating. Capacitor 290 will charge up through resistor 289 to the voltage present at the junction of 288. Once the capacitor is charged up, the voltage across it established by the adjustment of resistor 293 will determine the bias on the varicap 282. The capacitance of the varicap will determine the frequency at which the oscillator will operate. With the bias remaining constant, the oscillator will be in a free-running state and should be operating at the frequency to which it was initially calibrated. To determine if the free-running frequency is correct, fire control will check its frequency at this time.

OSCILLATOR SYNC CIRCUIT UNDER STATES 2 and 3

Refer to FIGS. 14, 17 and 19. Under State 2 and State 3, synchronization between the fire control clock and the guidance computer clock is defined as the leading edge of the fire control sync pulse being within ±0.9 microseconds of the leading edge of the computer clock pulse Pw. However, to facilitate the mechanization of the sync circuit, the oscillator sync circuit will generate a pulse that effectively moves the Pw clock pulse so a comparison can be made of the leading edge of the sync pulse and the trailing edge of the generated pulse. This waveform is produced in NOR gates 305 and 306 by Ø3, Ø6 and Pfc (refer to FIG. 16). Phase 3 and Ø5 are inputs to NOR gate 305 and produce the output shown. The output from NOR gate 305 and pulse Pfc are inputs to NOR gate 306. The output of NOR gate 306 has it trailing edge extended by Pfc to overlap the leading edge of clock pulse Pw to compensate for delays in the sync line receiver and divide-by-three gates. Therefore, in NOR gate 303, the trailing edge of the output of NOR gate 306 will be compared with the leading edge of the fire control sync pulse.

Under State 2, the fire control sync pulses overlap the output of NOR gate 306, and flip-flop 308 will be set. Flip-flop 308 can be set only during the overlap, because this is the one time when the outputs of NOR gate 306 and NOR gate 302 go to a logic 0 together. Flip-flop 308 will be reset when phase 1, gates 303 and 306 are 0, allowing flip-flop 308 to be set for 8 microseconds when an overlap is present. When flip-flop 308 is set, a logic 0 will be sent to OR gate 309. Also with the application of sync pulses from fire control, flip-flop 304 will be set. This will result in a logic 0 being sent to OR gate 310, except during XIT time. OR gate 310 will invert this logic 0, which will then place resistor 292 in a floating state. OR gate 309 also inverts its logic 0 input and causes the junction 288 to be floating. With both inputs to the varicap biasing network of the oscillator floating, capacitor 290 will charge up through 289 and 291, increasing the DC bias on the varicap. The increased DC bias will decrease the capacitance of the varicap 282 and increase the frequency of the oscillator. The result is that Pw is shifted with respect to fire control sync until there is no overlap between the outputs of gates 302 and 303, and State 3 is achieved. Therefore, with fire control sync pulses that lag Pw as inputs to the oscillator sync circuit, the oscillator will increase frequency causing the fire control sync pulses to lead Pw. As will be shown in the next paragraph, the oscillator sync circuit will again change the oscillator frequency and maintain the two systems in synchronization by comparing the incoming fire control sync pulses with pulses generated by the computer clock. This repetitive method of self-adjusting synchronization keeps the oscillator within the prescribed sync limits as long as the difference between the free-running frequency of the oscillator and the fire control sync is within the prescribed limits.

Under State 3, as a result of the increase in oscillator frequency that took place under State 2, the fire control sync pulses will not occur during the overlap period. Instead, the leading edge of the fire control sync pulse will lag the trailing edge of the output pulse from NOR gate 306 (see FIG. 20). Flip-flop 308 will be reset when the outputs of gates 306, 303 and phase 1 go to a logic 0. Resetting flip-flop 308 will send a logic 1 to OR gate 309. OR gate 309 will invert the logic 1 and cause the junction 288 to go to a negative voltage. Since this junction was floating when an overlap occurred, the voltage causes capacitor 290 to discharge, causing the oscillator to decrease in frequency.

Flip-flop 308 cannot be set as long as there is no overlap between fire control sync pulses and the output of NOR 306, because the outputs from NOR gates 302 and 306 will not go to a logic 0 together. Therefore, as long as there is an absence of an overlap, flip-flop 308 will not be set, and the frequency of the oscillator will decrease. The oscillator frequency will continue to decrease until an overlap is once again attained. Thus, the sync circuit causes the oscillator alternately to increase and decrease, eliminating the overlap and getting an overlap, while maintaining the phase between sync and Pw within tolerances. Upon the removal of fire control clock sync (at launch), XIT resets flip-flop 304 which sets flip-flop 308 and returns OR's 309 and 310 to State 1 (free-running frequency).

PULSE GENERATOR AND DRIVER

Pulse generator and driver 351, as shown in FIGS. 20 and 21, is composed of flip flop 352, the F lead of which is connected to emitter follower 353. The set signal applied to the flip-flop is the phase 6 signal from the divide-by-three circuit 301 and the reset terminal thereof receives the reset signal (Pr) which is the output of emitter follower 354, the generation of which will be disclosed immediately hereinbelow.

The phase 6 signal is shown applied to NOR gates 355, 356 and 359. The phase 4 signal is applied to NOR gates 355 and 359. Phase 1, 2 and 3 signals are applied to NOR gates 359, 355 and 356, respectively. The output of NOR gate 355 is connected to emitter follower 354 and the output of NOR gate 356 is applied to emitter follower 357, the output of which is applied to the transistorized amplifier stage 358.

Pulse generator 361 shown in FIG. 21, a portion of pulse generator and driver 351, is composed of NOR gate 362 with a dual input and NOR gate 363 with a single input terminal. The outputs of these gates are connected to emitter followers 364 and 365. The phase 5 signal is connected to the single input of gate 363 and one of the inputs of gate 362. The other input of gate 362 receives the erase signal (ED) from the fire control. When the erase signal is transmitted, gate 362 will have no output. Immediately thereafter, however, a write pulse will be produced. The emitter follower 364 matches the impedance of the NOR gate to those circuits within the computer which use this signal.

Similarly, the signal from NOR gate 363 is applied to emitter follower 365 matching impedance to the remainder of the circuits in the computer using this signal. The Pnc signal returns to the fire control and produces the write pulse used therein.

In operation, the Pr signal is produced by timed impulses, phases 2, 4 and 6, which gate NOR gate 355. This signal is amplified and impedance matched by emitter follower 354 and is used to reset flip-flops throughout the computer (an example of which is flip-flop 352). A shift pulse (Psc) is generated by applying phases 1, 4 and 6 signals to NOR gate 359. The transfer pulse (Pt) is produced by applying phases 3 and 6 signals to NOR gate 356. This signal is impedance matched and amplified by emitter follower 357 and amplifier 358, and is applied to core registers throughout the computer. Write pulse (Pw) is produced by flip-flop 352 which is set by the phase 6 signal, and is reset by application of the Pr signal to the reset terminal. Generation of these pulses, as described above, is simply a logic addition of the signals produced in the divide-by-three circuits and is illustrated in FIG. 22.

BIT TIME OR PULSE GENERATOR

The bit time or pulse generator 400, shown in FIG. 23, is a 17-bit magnetic core shift register 401 with a single pulse circulating therein and 17 flip-flops, examples of which are 402 and 403, connected to the output coil of each of the 17 cores to sense the output therefrom. When the pulse circulating in the register shifts from core to core, the flip-flop connected to the output of the core containing the pulse is set. Each flip-flop is reset by the Pr pulse applied to the reset terminal. Wave pulses produced by the bit-time generator are shown in FIG. 24. P pulses 2 through 10 are sampled by NOR gate 404, inverted by NOR gate 405, and applied to NOR gate 406 along with P pulses 11 through 17. The output of NOR gate 406 is applied to OR gate 407, along with an Xs pulse. Pw, Ps and Pt pulses are also applied to the shift register 401.

Assuming that a 1 is stored in a core of the register 401, the occurrence of the shift pulse (Ps) will initiate generation of the P pulses. Once the 1 is shifted to the 17th position, and upon occurrence of the next shift pulse, it is read out of the register. Obviously, if another 1 is not read into the register, bit pulse generation ceases. In order that this does not occur, a 1 is inserted into the first core at the time that the 17th core is read out. This is accomplished by the logic combination of NOR gates 404 to 406 and OR gate 407. This logic also insures that one and only one pulse is present in the computer.

With the exception of P1, each pulse, when it is generated, is sampled at the inputs to either gate 404 or 406. Gate 405 effectively senses the existence of a P pulse at 404 and applies this information to gate 406. When any one of the inputs to 404 is a logic 1 (when any one of the pulses P2 through P10 exists), a logic 0 is applied to gate 405. Gate 405 then produces a logic 1 which insures that gate 406 is disqualified. If a pulse higher than P10 exists, gate 404 will be conducting disqualifying gate 405, which will cause gate 406 to conduct. The application of an Xs pulse to gate 407 causes OR gate 407 to conduct. However, the existence of any pulse P10–P17 will disqualify gate 406. Only when P1 is generated will gate 405 be fully conductive and produce a logic 0. The special core pulse Xs is produced by and a logic 1 will be applied to OR gate 407 and inserts a core pulse into the first core of the register. It follows, therefore, the P1 is produced by the reading of the core pulse out of the last, or 17th, core of the register. The P pulse produced at the output of the first core is, thus, P2.

Since the first pulse to be produced upon the application of power cannot be predicted, it is necessary to provide means for synchronizing the generation of P pulses in the computer with the generation of similar pulses in fire control. This synchronization is accomplished by "forcing" a special core pulse into the first core of the register at a known time. This establishes a definite generation scheme. Xs is produced by the computer input circuit during the first bit of the 51-bit erase signal, ED, from fire control. If Xs occurs simultaneously with the normal generation of the core pulse as described above, it has no effect and the pulse generator can be said to be already in synchronization. If the two pulses do not occur simultaneously, two core pulses could exist in the register simultaneously. However, the last pulse to be inserted into register will determine the final usable P pulse sequence. Until the extra pulse is shifted out of the register, however, and only one core pulse remains, the generator will not be in synchronism. The maximum amount of time during which two core pulses can exist simultaneously is 16 bits. Since Ed is 51 bits long, the pulse generator will be in synchronism with fire control before the end of erase.

It should be noted that core pulses will be inserted into the register during the existence of ED. It is not possible to write into a register during ED with registers (other than those of the Word-Time Generator and Xs logic) used in other computer circuitry. The differences in the write-in circuitry are based upon the use of write pulses (Pw) which either are or are not inhibited by ED.

WORD-TIME GENERATOR

Figure 25:
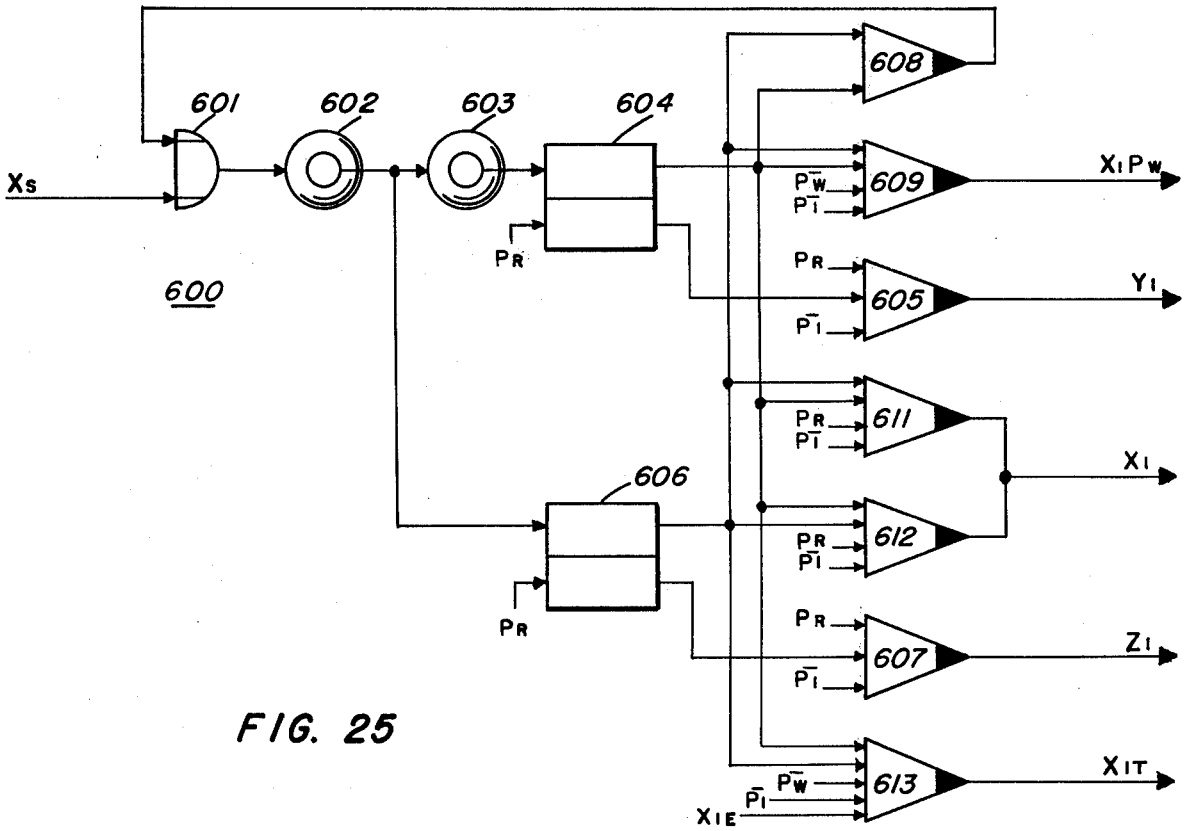
Figure 26A:
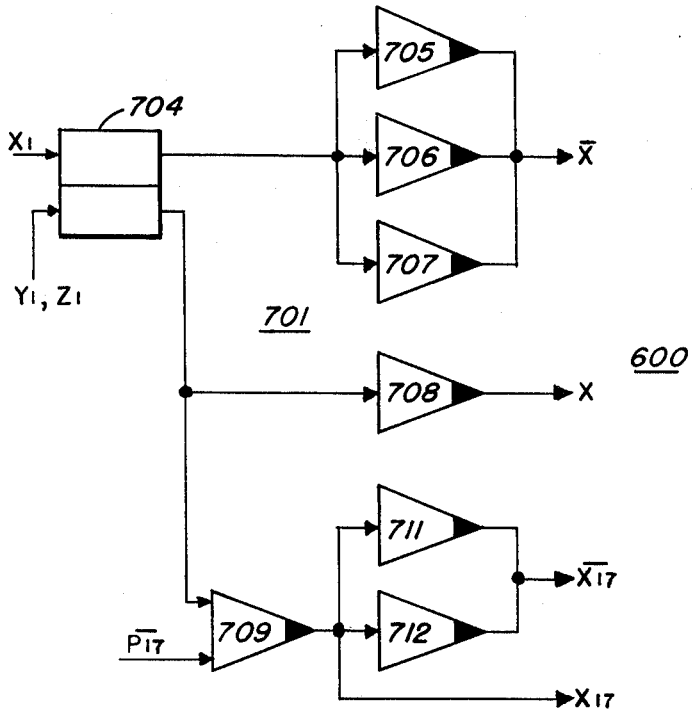
Figure 26B:
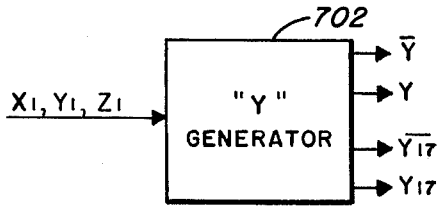
Figure 26C:
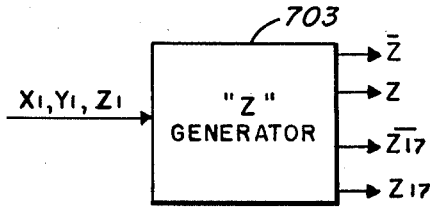

The word-time generator 600, the logic for which is shown in FIGS. 25 and 26, generates the X, Y and Z word-time signals. Each of these signals are 17 bits in length. The generator is composed of an OR gate 601 to which an Xs signal is applied. The output of OR gate 601 is connected to delay core 602, the output of the delay being connected in turn to delay core 603. The output of core 603 is connected to set terminal of flip-flop 604, the reset terminal of which has applied thereto a Pr signal. The $\overline{F}$ output of flip-flop 604 is connected to an input of NOR gate 605 to which a Pr and a P1 signal are also applied. The output of gate 605 yields a Y1 signal. Delay core 602 also supplies an input signal to the reset terminal of flip-flop 606. The set terminal of flip-flop 606 has a Pr signal applied thereto. The $\overline{F}$ output of flip-flop 606 is connected to the input of NOR gate 607 along with a Pr and $\overline{P1}$ signal. The output of gate 607 yields a Z1 output. The F terminals of flip-flops 604 and 605 are connected to the inputs of NOR gates 608, 609, 611, 612 and 613. The output of gate 608 is fed back to the input of OR gate 601. Gates 609 and 610 have $\overline{Pw}$ signals applied thereto. Gates 609 and 611 to 613 have Pr and $\overline{P1}$ signals applied thereto. The output of gate 609 yields an X1Pw signal. The output of gates 611 and 612 yield an X1 output signal. Gate 613 also has an Xie signal applied thereto. The output of this NOR gate is an Xit signal.

The Xs, or synchronization pulse, consists of a 1 to be written into core 602 through OR gate 601. This causes the 1 to be delayed one bit time. The output of core 602 sets flip-flop 606 and the output of core 603 to which the delayed 602 output is applied is delayed another bit time. This output from 603 causes flip-flop 604 to be set. The F outputs of both flip-flops 604 and 606 are fed to NOR gate 608 which feeds back to OR gate 601. With an absence of an F output from either flip-flop, a pulse is written back into core 602. This yields an output from delays 602 and 603 every third Xs pulse. With the pulses from 603 being delayed one bit time from those of core 602, a Y1 output is generated when a reset output of flip-flop 604 goes to 0. This is constant with P1 time. Similarly, a Z1 pulse is generated when the $\overline{F}$ output of flip-flop 606 goes to 0 again coincident with P1 time. When there is no output from the F terminal of either flip-flop 604 or 606, an X1 pulse is generated. This also coincides with P1 time. The Xit pulse is a timing pulse occurring at a rate of 1600 pps in every X1 time, with the exception of the first X1 time after an erase. The Xie signal inhibits this action. The P1 signal inhibits generation of all of these pulses. The output of NOR gate 609 is the same as that from gates 611 and 612 with the exception the Pw signal inhibits an output during Pw time.

The X, Y and Z generators, 701 to 703, a further portion of the word-time generator 600, as shown in FIG. 26, consist of three identical sets of logic circuitry. Only the X generation will be described in detail. The X generator 701 consists of a flip-flop 704, the F output of which flip-flop is connected to a set of three single input NOR gates 705, 706 and 707, which are connected in parallel. The $\overline{F}$ output terminal of flip-flop 704 is connected to a single input NOR gate 708 and to a branch comprising a double input, NOR gate 709, the output of which is applied to the combination of a set of two single input NOR gates 711 and 712 in parallel, and an output lead coming directly from the output of gate 709.

An X1 signal is applied to the set terminal of flip-flop 704 and Y1 and Z1 signals are applied to the reset terminal. Thus, the flip-flop is set at X1 and remains so set through 17 bit times. The $\overline{F}$ output is applied through NOR gate 708 to produce the function X. The F output is applied through the three inverted gates 705 to 707 to produce the $\overline{X}$ signal. The $\overline{F}$ output is also applied to gate 709 in conjunction with the $\overline{P17}$ signal to produce an X17 and $\overline{X17}$ output. Obviously, other signals can be produced by applying the P pulse and X pulse to a NOR gate; for example, X11 is produced by applying the X and P11 signals to a gate.

The functions Y, Y17, Z17 and their negations are produced in quite the same manner by the Y and Z generators simply by connecting the Y1 and Z1 outputs to the set terminals of flip-flop 220 in their respective generators.

FUNCTIONAL TIMING CIRCUITS

As shown in FIG. 10, the functional timing circuits 800 receive the erase signal (ED), the start computation signal (Sc), and the fire control inhibit signal (To) from the fire control. As a result of the erase signal, two pulses are created by the functional timing circuits. These are the Xs and Xie signals. The logic for the generation of these signals is shown in FIG. 27.

The erasee (ED) signal from the fire control is applied to the set input of flip-flop 801. The reset lead has a Pr signal and a To signal. The F output from the fire control is applied to the single terminal input OR gate 802, the output of which is connected to the input coil of core 803. The output of core 803 is applied to the set terminal of flip-flop 804. The reset terminal of flip-flop 804 has a Pr signal applied thereto. The F output of flip-flop 804 is connected to one lead of a three-input NOR gate 805. The $\overline{F}$ output of flip-flop 804, the F output of flip-flop 801 and a Pw signal are connected to the inputs of NOR gate 806. The $\overline{F}$ output of flip-flop 801 and a To signal are applied to the input of NOR gate 805 along with the F output of flip-flop 804.

The erase signal applied to flip-flop 801 is a train of pulses, 51 in number, occurring at a Pw rate, which train starts at the time the erase signal is generated. The erase signal enters the computer and is stored in flip-flop 801. This signal sets an 800 cps triggered flip-flop, clears all registers, and synchronizes timing within the computer. The To signal is applied to the reset terminal of the flip-flop and maintains it in the reset mode after time To. Core 804 serves to delay the erase signal by one bit time. OR gate 802 serves as an inverter. The Xs output from NOR gate 805 occurs during the first erase pulse; that is, all inputs to gate 805 are at 0 yielding a 1 output. The Xs pulse serves to synchronize the bit and word-time generators with the fire control.

The Xie pulse from gate 806 occurs one bit time after the 51 bit erase signal. Xie serves to inhibit the Xit signal and sets the 800 cps flip-flop only during the first bit following erase.

START COMPUTATION SIGNAL

The start computation signal (Sc), as used in the computer, is generated in logic circuitry, and is shown in FIG. 28. This circuit comprises a flip-flop 811 from which $\overline{F}$ terminal output signals are connected to a single NOR gate 812 and a double NOR gate 813. The Sc signal from the fire control consists of a train of 51 Pw rate pulses. Flip-flop 811 stores these signals. The reset terminal of the flip-flop is connected to a source of Pr and To signals. The F terminal output yields an $\overline{ScA}$ signal. The $\overline{F}$ output yields an Sc output. NOR gate 812 yields an $\overline{Sc}$ signal and double input NOR gate 817 has a $\overline{P17}$ signal applied to the other input lead and yields an $\overline{ScP17}$ output signal. The Sc function checks the computer prior to launch time and, at To time, insures that launch occurs simultaneously with To time in the fire control, and further checks the accelerometer timing.

The primary function of the timing circuit is to provide a time base of real-time for the computer. The measuring of time always begins at the point at which Sc is generated by the fire control. By counting the number of times a pulse of known frequency occurs, elapsed time is measured. The P17 pulse generated by the word-time generator circuitry 600 is the pulse that is used for this computation. Although the Rt or basic timing circuit is shown in block diagram form in FIG. 11, as part of the Vg computation loop, functionally this circuit performs basic timing and, hence, is described as a portion of the functional timing circuit 800 and is shown in that block in FIG. 10.

Referring now to FIG. 29, for a detailed description of the real-time generator 1202, there is shown a double input NOR gate 831 to which a Qxz $\Delta t$ and a $\overline{Y17}$ signals are applied, and NOR gate 832 to which an $\overline{Rt}$, $\overline{Sc}$, X17 and $\overline{Ct}$ signals are applied. The outputs of gates 831 and 832 are fed to OR gate 833 along with a Z17 signal. The output of OR gate 833 is applied to delay magnetic core 834 and to the set terminal of flip-flop 835. Reset pulse Pr and an $\overline{Sc}$ signal are applied to the reset terminal of flip-flop 835. The output of NOR gate 832, along with the output of another NOR gate 836, are applied to the input of a NOR gate 837. The inputs to NOR gate 836 are Rt and Ct signals. A flip-flop 838 has Q signals and the SKU signals from the fire control applied to the set terminal thereof, and a Pr, To and an X signal to the reset terminal. A NOR gate 839 has a $\overline{P12}$, an Sc, and an $\overline{X}$ signal applied as inputs thereto. An OR gate 841 has the outputs of NOR gates 837 and 839, and the set output of flip-flop 838 applied thereto. The output of OR gate 841 is applied to shift register 843, which is connected in series with shift register 844, which in turn is connected with shift register 845, which shift register feeds the F terminal of a flip-flop 842. A Pr signal is applied to the reset terminal of this flip-flop.

The Rt timing circuit 1202 is basically a coder. Z17 pulses are continually fed to OR gate 833 which functions as a carry signal generator. The delay 834 delays the signal one bit. Therefore, there is always a forced carry signal at X1 time in the output of flip-flop 835. Every X1 time, Z17 function adds one count to the contents of the Rt register. Since X1 occurs at a rate of 1600 pps, the count in the Rt register at the end of one second would be 1600. This register also functions as a double input adder with Ct being added to Rt gates 832, 836 and 837 from the input functions. The Ct and Rt signals negated pass through NOR gate 836 to provide an $\overline{Rt}$ $\overline{Ct}$ signal. Gate 837 provides the sum function. Because of the delay due to magnetic core 834, Ct is actually the carry from the previous bit of addition. Gate 839 loads the register with P12 which is equivalent to a count of 211 prior to Sc time. Gate 839 is inhibited at Sc time and normal accumulation proceeds as gate 832 and flip-flop 835 are enabled. By monitoring the Rt register 1202, the special timing pulses discussed hereinbelow are generated.

TC GENERATION

The Tc function is generated at 3.84 seconds after launch. No pitch or yaw commands are generated from To time or launch time until 3.84 seconds after launch. The Tc signal, the generation of which is shown in FIG. 30, is an enable signal which allows the transmission of the pitch and yaw commands. The circuiry is composed of a four input NOR gate 851 connected to a set terminal of a flip-flop 852. The F output of the flip-flop is connected to inverter 853.

The Rt register produces a count of 1600 pps, by predetermined calculation, and because of the initial count inserted into the Rt register, prior to launch. At the time a logic 1 appears at P14, an output from gate 851, which has $\overline{Rt}$, $\overline{Pw}$, $\overline{P14}$ and $\overline{X}$ signals applied thereto sets the flip-flop 852. The output of flip-flop 852 is inverted by NOR gate 853 producing a $\overline{Tc}$ signal.

TCO GENERATION

Tco is the cutoff enable signal, generation of which is accomplished by the circuitry shown in FIG. 31, a multiple input NOR gate 854 and flip-flop 855. Inputs to the NOR gate consist of $\overline{Rt}$,$\overline{Tt}$,$\overline{PW}$,$\overline{X}$ and $\overline{P16}$. Flip-flop 855 is reset by application of an Sc signal.

Prior to cutoff time, the missile cutoff signal is inhibited. Tco can be calculated by determining the time it takes for a logic 1 to appear in the Rt register at P17 and P16 times, and taking into account the number loaded into the register at launch, as in the case of generation of the Tc signal. At this time, the $\overline{Tt}$ signal enables gate 854. This gate generates an output when a 1 appears in the Rt register at P16 time. Flip-flop 855 is reset by the Sc signal, assuring that the flip-flop is in the reset stage state at launch.

The output of flip-flop 855, as will be further discussed hereinbelow, is applied to flip-flop 861 in the Tt generation circuitry of FIG. 32 to insure that only one Tt signal is generated. If not for the application of this signal and the flight lasted beyond one cycle, it would be possible for the Rt register to recycle causing a second Tt signal to be generated. A ΔVgzl signal would be gated into ΔVgzl register a second time.

GENERATION OF Tt

The circuitry, shown in FIG. 32, is that used by the generator Tt, or staged correction signals. Staging correction closes at 52.48 seconds in the embodiment shown.

A multiple input NOR gate 856 feeds input signals to multiple NOR gate 858 and through inverter 857 to gate 895. The output signals from NOR gates 858 and 859 are applied to the input of flip-flop 861, which flip-flop has a multiple set input terminal. The F signal terminal lead is applied to NOR gates 862 and 865. The output signal from NOR gate 864 is also applied to NOR gate 865. The output of gate 865 is ΔVgzl, the staging correction signal. Gate 862 output signal is applied to the set terminal of 863. A Z17 signal is applied to the reset terminal of flip-flop 861, and an $\overline{Sc}$ signal to the reset terminal of flip-flop 803.

Referring now to FIG. 32 for a description of the generation of the Tt pulse, the Tt signal is a predetermined function which establishes the time at which staging correction is made in the Vgz register. If the equation Rt=K(Tt) is false, during X time, flip-flop 861 is set yielding a Ttff signal output, K being a predetermined constant. Gate 862 is inhibited and yields no output during the Y sampling time. Thus, there is no Tt signal generated. The output of gates 858 and 859, both feed to the set side of flip-flop 861, and are effectively the logic for an exclusive OR gate. Therefore, as long as the contents of the Rt register disagree with the constant K, or prove the above equation to be false, flip-flop 861 will be set during X time. This, therefore, inhibits generation of the Tt signal.

A Z17 pulse resets flip-flop 861 which is set during X time, so that another comparison can be made between K and Rt during the next word frame. Agreement between K and Rt yields no output from either gate 858 or 859. Flip-flop 861 therefore remains set, enabling gate 862 to generate a signal which sets flip-flop 863 yielding a Tt signal.

STAGING CORRECTION SIGNAL

The staging correction signal ΔVgzl is a value inserted into the Vgz register during Z time when the Tt function occurs. P9 to P12 signals are applied to NOR gate 864, the output of which is applied to NOR gate 865 along with a Ttff and a $\overline{Z}$ signal. The output of this gate is the staging correction signal ΔVgzl. This signal is predetermined as are the Tt, Tco and ScA signals. FIG. 33 shows the circuitry which generates a Δt Vgx signal consisting of NOR gate 866 and flip-flop 867. Inputs to NOR gate 866 are a Ct pulse, $\overline{Pw}$, $\overline{X}$ and $\overline{P2}$ signals. The output of the NOR gate is applied to the input of flip-flop 867 and an X17 signal is applied to the reset terminal. The Δt Vgx signal gates Vgx into the Vg loop 800 times per second. A carry signal is generated during P2 time for every other addition at X1 time. Thus, Δt Vgx is generated every other frame time starting at X2 time and ending at Z17.

FIG. 34 shows the logic circuitry for generating Qxz Δt signal. This consists of a NOR gate 868 and flip-flop 869. Inputs to the NOR gate are a $\overline{Ct}$ signal, $\overline{Pw}$, $\overline{X}$ and a $\overline{T}$ signal. The output of NOR gate 868 is applied to the set terminal of flip-flop 869 and an X1 signal is applied to the reset terminal of the flip-flop. This signal, a wired-in constant, gates the Vgz signal into summer 1 as part of the ΔVgz equation. This also increases Qxx by one bit every 12.5 pps.

NCPS SIGNAL

The Ncps signal gates Vgz into the pitch instrumentation and Vgy into the yaw instrumentation. The logic circuitry for this is illustrated in FIG. 35, and waveforms at various points in the circuitry are illustrated in FIG. 36. The logic for generating this signal consists of NOR gate 871 inputs to which are $\overline{Ct}$, $\overline{X}$, $\overline{Pw}$ and $\overline{P6}$ signals, NOR gate 872, inputs to which are $\overline{Ct}$, $\overline{X}$, $\overline{Pw}$ and $\overline{P5}$ signals. The outputs of NOR gates 871 and 872 are both applied to the set terminals of flip-flop 873 and 874. An X1 signal is applied to the reset signal of both of these flip-flops. The flip-flop 873 reset terminal yields a Ts signal. The output of the reset terminal of flip-flop 874 is applied to the input of NOR gate 875 along with a Z17 signal. The output of NOR gate 875 is applied to the input of flip-flop 876. The reset terminal has applied thereto a Y10 signal. The output of flip-flop 876 is an Ncps signal.

Referring now to FIG. 36 in conjunction with FIG. 35, a carry of Cp is generated at time T5 when the count in the Rt register reaches a predetermined value. At this time, an output occurs from gate 872. Thus, this gate functions as a divide-by-16 circuit, since at P5 time, the count from Rt is $2^4$. Gate 871 functions as a divide-by-32 circuit, since a carry is generated by this gate when P6 count in the Rt register equals a $2^5$. If Ncps is 50 pps, gate 871 sets flip-flop 874. If Ncps is 100 pps, the output of gate 872 feeds flip-flop 874. Upon application of an output from the flip-flop 874 reset terminal, NOR gate 875, with a Z17 signal, is fed to flip-flop 876 which produces an Ncps signal lasting from time Z17 to time Y11.

ACCELEROMETER DECODERS

As shown and described in copending application, Ser. No. 502,717 for *Guidance System,* the accelerometer mounted on the stable platform senses velocity changes in the X, Y and Z axes. The accelerometer which senses the velocity change in the X axis is called the Y-PIGA (Pendulous Integrating Gyroscopic Accelerometer). The accelerometers which sense the velocity changes in the Y and Z plans are referred to as Y-PIPA and Z-PIPA (Pulsed Integrating Pendulous Accelerometers). The discreet increments of velocity sensed by the accelerometers are modified and used in the pitch and yaw starting control circuits. Decoders 1000 are utilized which convert the velocity changes sensed by the accelerometers into a signal suitable for use in the digital computer of the present invention. The flight equations utilize terms $\Delta V_x$, $\Delta Vy$ and $\Delta Vz$ to determine the pitch and yaw corrections to be made in the missile's flight. In order to discriminate between positive and negative velocity changes, the following convention is referred to: $\Delta V1x$, $\Delta V1y$ and $\Delta V1z$ represent positive velocity increments, $\Delta V2x$, $\Delta V2y$ and $\Delta V2z$ represent negative velocity increments, $2\Delta Vx$ represents a double increment of velocity in positive direction and in the X axis.

X AXIS PIGA DECODER

As shown in FIG. 37, two waves of signals are returned to the computer, an A wave and a B wave. Both of these are pulse returns having square wave amplitude modulation. Frequency of the envelope is proportional to the magnitude of acceleration. There is a 90° phase difference between the respective waves. When positive acceleration is sensed, the A wave lags the B wave in phase by 90 degrees. It is to be noted that the phase difference is completely independent of the modulation frequency. When the frequency of the modulation envelope increases beyond a predetermined scale factor, the sampler yields the squares of logic levels indicated by the $2\Delta Vx$ waveforms as shown in FIG. 37*c*.

Referring now to FIG. 38, which illustrates the X-PIGA decoder logic circuitry 1001, it is seen that the A wave is received by NOR gate 1005, other inputs thereto being Z and P12. The output of this NOR gate is connected to the set terminal of flip-flop 1006. The reset terminal receives a Z8 signal. The F output of this flip-flop is applied along with Y17 signal to the input terminals of NOR gate 1007, which in turn is connected to flip-flop 1008. The reset terminal flip-flop 1008 receives a Y1 signal. The B wave decoder logic 1002 (FIG. 38*b*) is of exactly the same configuration as the A wave logic circuitry 1001. An interrogation pulse is sent to the PIGA at computer times Z10 and Z11. A one bit delay causes the A and B pulses to occur between Z11 and Z13 times. Flip-flop 1006 stretches the incoming A wave pulse. Gate 1007 yields an output at Y17 times for each A input wave pulse. The output of gate 1007 sets flip-flop 1008 which yields a signal during Y1 time because of the application of the Y1 reset pulse applied to flip-flop 1008. Thus, the a2 signal from the F terminal of flip-flop 1008 is identical to the a1 signal from the F terminal of flip-flop 1006 with the exception of the fact that the a2 pulse is delayed. In a like manner, the $\overline{a1}$ and $\overline{a2}$ pulses emitting from the $\overline{F}$ terminals of flip-flops 1006 and 1008, respectively, are delayed. The a1, a2, b1 and b2 signals and their negations are fed to NOR gates shown in FIG. 39.

That portion of the X-PIGA decoder, shown in FIG. 39, consists of six NOR gates, 1003 to 1008, each of which is fed a different permutation of A and B output signals from FIG. 38. NOR gate 1009 is fed the output signal from NOR gates 1003 and 1004. NOR gates 1007 and 1008 feed input signals to NOR gate 1011. NOR gates 1003, 1004 and 1011 feed NOR gate 1012, along with a Z pulse and $\overline{P15}$ to $\overline{P1}$ signals. NOR gate 1013 is fed by NOR gates 1007, 1008 and 1009 output signals, and a $\overline{Z}$ and $\overline{P15}$ to $\overline{P1}$ signal. The outputs of NOR gates 1012, 1013, 1005 and 1006, along with a $\overline{Z17}$ signal are fed to NOR gate 1014. The output of NOR gate 1012 is a $\Delta V1x$ signal. The output of NOR gate 1013 is a $\Delta V2x$ signal, and the output of NOR gate 1014 is a $2\Delta Vx$ signal.

The a2 signal represents the logic of a1 during the previous sampling, as the b2 signal represents the logic state of b1 during the previous sampling.

Referring to the waveforms of FIG. 37 in conjunction with FIGS. 38 and 39, sampling is made during the times represented by the vertical dotted lines. In FIG. 37, it is seen that for positive increments of velocity, $\Delta V1x$, the following figures of logic level exist: a1 is equal to 0011; 0011; and b1 is equal to 0110, 0110. For negative increments of velocity, $\Delta V2x$, a1 is equal to 0110, 0110; and b1 is equal to 0011, 0011; which double increments of positive velocity $2\Delta V1x$ is equal to 0101010 and b1 is equal to 1010101.

Table VIII shows the logic levels that must exist in order that $\Delta V1x$ be generated.

TABLE VIII

| | | |
|---|---|---|
| a1 | 0011 | 0011 |
| b1 | 0110 | 0110 |
| a2 | 1001 | 1001 |
| b2 | 0011 | 0011 |

Table IX shows the logic levels for generation of $\Delta V2x$.

TABLE IX

| | | |
|---|---|---|
| a1 | 0110 | 0110 |
| b1 | 0011 | 0011 |
| a2 | 0011 | 0011 |
| b2 | 1001 | 1001 |

Table X shows the logic levels necessary for generation of $2\Delta Vx$.

TABLE X

| | | |
|---|---|---|
| a1 | 0101 | 0101 |
| b1 | 1010 | 1010 |
| a2 | 1010 | 1010 |
| b2 | 0101 | 0101 |

$\Delta Vx$ pulses are generated only when there is a relative change in the logic levels.

The Y and Z-PIPA decoders are shown in FIGS. 40 and 41. If there is no acceleration sensed along these axes, output signals from the accelerometers consist of symmetrical square waves. Thus, an equal number of $\Delta V2$ and $\Delta V1$ pulses are generated in the Y and Z channels. When an unequal number of pulses are generated, this is indicative of a sensing acceleration by these instruments, which allows a change to be made in the velocity to be gained. The decoders consist of two NOR gates 316 and 317 in series, the Y decoder 1003 having an $\overline{X}$ input and a $\overline{P15\text{-}1}$ input. Because of the delay in NOR gate 409, ΔV1y and ΔV2y are delayed one with respect to the other.

The Z decoder 1004 is of like configuration to that of the Y decoder 1003 with the exception that a $\overline{Y}$ input to gates 316 and 317 replaces the $\overline{X}$ information pulse to decoder 1003.

ΔVw GENERATOR

The ΔVw generator 1051 produces a 17 bit signal (ΔV1, ΔV2 or 2ΔVx) for each plus and minus increment sensed by the accelerometer decoders. The ΔVw generator logic circuitry, as shown in FIG. 42, comprises a NOR gate 1052 to which signals ΔV1x, ΔV1y and ΔV1z are applied. The output of NOR gate 1052 is applied to NOR gate 1053, to which input $\overline{To}$ and $\overline{P17}$ signals are applied, and NOR gate 1054 to which inputs $\overline{Pw}$ and $\overline{P17}$ are applied.The output of gate 1054 is a ΔV signal which is transmitted to the fire control. The output of NOR gate 1053 is the ΔV1 signal. This last-mentioned output is also applied to a multiple input OR gate 1055 to which the 2ΔVx signal and the ΔV1 signal (the letter from the fire control) are applied. The output of the OR gate 1055 is delayed in core 1056 one bit time and applied to the set terminal of flip-flop 1057. The $\overline{F}$ output of the flip-flop is applied to NOR 1058 along with a P17 pulse. The output of NOR gate 1058 is fed back and functions as a further input to OR 1055. A Pr pulse is applied to reset terminal of flip-flop 1057, the set output of which then is $\overline{\Delta V1w}$. This output is also available through NOR gate 1059 as a ΔV1w. During X, Y or Z word time, the input to gate 1052 is a ΔV1 pulse. These inputs are entered at time P17. Positive acceleration functions are applied to NOR gate 1053. The 2ΔVx pulses, as shown above, represent a double increment of acceleration in the positive X correction and are fed to OR gate 1055. Assuming a ΔV1 input during time P17, a 1 is written into delay 1056 and is shifted to set flip-flop 1057 during the next shift pulse. A logic 1 is again written into delay 1056 through NOR 1058. This is shifted out of the delay again and sets the flip-flop which has been reset by a Pr pulse in the meantime. Until P17 occurs, this action is reworked. When a P17 pulse occurs, NOR gate 1058 prevents any further write-in to core 1056 until another ΔV1 or 2ΔVx pulse occurs. The 17 bit output of the ΔVw generator is used in pitch and yaw summer networks.

The 17 bit output also occurs for a 2ΔVx input. The ΔV2w generator is like that described above with the following exceptions. The inputs to gate 1052 are ΔV2, ΔV2y and ΔV2z. The input to gate 1054 rather than a $\overline{P17}$ pulse is a P16 pulse. Rather than a ΔV1 from fire control applied to OR gate 1055, a ΔV2 pulse is substituted. The output from flip-flop 1057 further consists of an additional NOR gate 1061 which has a $\overline{Z17}$ input thereto. Thus, outputs from the ΔV2w generator are ΔV2, ΔV2w and $\overline{\Delta V2w}$ Z17. When there are no ΔV2 pulses being sensed, an output occurs from gate 1061 during Z17 time. This represents a value of 0 in the computer number system. The ΔV1 inputs are sampled and sent to the fire control at P17 time and the ΔV2 outputs are sensed at time P16.

Q COMPUTATION CIRCUITS

The purpose of the Q computation circuit 1200 is to generate pulses at a rate proportional to the magnitude of the Q matrix quantities programmed into the guidance computer from the fire control. The Q circuit output pulses are used to modify the velocity to be gained quantities generated by the Vg generator section. Portions of the Q computation network are partially contained within the functional timing circuits, in particular, the Rt timing register or basic timing register 1202, shown in FIG. 29. Shift registers therein are used to store Q matrix and SKU quantities received from the fire control.

One of these registers stores Qxx which is updated in the timing circuit at a rate of Qxz Δt. Each time a Qxz Δt timing gate pulse occurs, one bit is added to Qxx. This function is stored in the timing register for use in the Q computations.

The second register stores both the Qyx and SKU quantities, seven cores being used to store the SKU information, the next eight cores to store the Qyx information. The last two cores in the register indicate the polarity of these two quantities. At appropriate times, the Q and SKU quantities are gated into the Q generation circuitry and summed to various outputs from other circuits. The resulting summation is stored in the Q registers.

As shown in FIG. 29, the Q's from the fire control enter the computer at flip flop 838 set terminal, and are sent therefrom to OR gate 841. The SKU and Qyz is fed into register 843 during Y time and Qxx is fed into the register during Z time. Flip-flop 838 is inhibited during X time by application of the X pulse to the set terminal thereof. During this time, the constants of register 845, which is the Rt register, are recirculated. The number SKU+Qyz read into register 844 is recirculated without change. The number read into register 843 increases Qxx by one bit at a 12.5 pps rate after Sc time. Upon receipt of an Sc signal, the Rt timing register operation commences, thus generating Ct signals during X time. A Ct signal occurs at P8 time, or after a $2^7$ count is accumulated. This provides a divide-by-128 circuit which the Rt register is updating at a 1600 pps rate, resulting in the output of flip-flop 842 at a rate of 1600 pps divided-by-128. It is recalled from discussion of FIGS. 10 and 11 that the Vg loop solves the guidance equations which are reproduced hereinbelow.

$$\Delta Vgx = -[Qxx\ Vgx\ \Delta t + Qxz\ Vgz\ \Delta t] - \Delta Vx \quad (45)$$

$$\Delta Vgy = -[Qyx\ Vgx\ \Delta t] - \Delta Vy \quad (46)$$

$$\Delta Vgz = -\Delta Vz + m\Delta Vx \quad (47)$$

ΔVx, ΔVy and ΔVz are terms which represent the velocity sensed by the accelerometers. The Q terms in brackets in equations (45) and (46), and the term mΔVx term in equation (47) represent those terms to be discussed immediately hereinafter.

The Q adder 1205, as shown in FIG. 11, performs the functions now discussed. The X velocity to be gained term Vgx is gated into the Q adder and added upon itself, the result of which addition is stored in one of the Q registers. Each time the capacity of the storage register is exceeded, a gating pulse is produced and yielded to the Q computation circuit.

The term Qyx is gated under the Q adder and added upon itself at a rate determined by the gating pulse mentioned hereinabove. For each of these gating pulse terms produced, one summation of the Qyx term upon itself takes place. The resulting quantity is stored in a Q register. Each time this quantity exceeds a given value, a ΔVy term is passed to the Vg generator circuit. The ΔVy term can be either positive or negative depending upon the polarity which is programmed for the value of Qyx. If this Qyx term is a positive quantity, a ΔV1y term is gated to the Vg generator. If Qyx is a negative quantity, a ΔV2y term is gated to the Vg generator.

The Qxx quantity, the generation of which was discussed hereinabove, is gated into the Q adder also at the rate of occurrence of ΔVx pulse. For each ΔVx term produced, one addition of Qxx upon itself takes place. The inverse of ΔVgx is gated into the Q adder at a rate of QyzΔt and added to the quantity which represents the summation of Qxx Vgx Δt. These two summations comprise the total term, Qxx Vgx Δt+Qyz Vgx Δt which is stored in the Q register. Whenever this summation exceeds a given value, a pulse is generated and sent to the Vg generator circuitry. After Tt time, the Qxz Vgx Δt term is inhibited from entering the adder. As a result, the signal generated after time Tt will be caused by the Qxx Vgx Δt term only.

Each time a ΔV1x increment is sensed by the SKU term from the timing circuit, it is gated into the Q adder and added upon itself. For each ΔV1x produced, one addition of SKU to the previous SKU summation takes place. For each two ΔVx produced, twice the value of SKU is added to the previous SKU summation. The result in sum is stored in the Q register. If the summation exceeds the capacity of the register, a SKU overflow occurs and an appropriate signal is yielded to the Vg generator circuit. The value of SKU can be either positive or negative. This is determined by the SKU polarity bit which also determines the significance of SKU overflow as used in the pitch computation circuitry.

Turning now to FIG. 43, which shows a logic diagram of the input section of the Q summer 1205 shown in the function diagram of FIG. 11 as gates 1203, 1204, 1206 and 1207, there is shown flip-flop 1225 to the set terminal of which is applied a P1 signal, flip-flop 1226 to which an SKU signal is applied from register 1206, core 16, and flip-flop 1227 to which set terminal a signal from register 1206, core 17 is applied. Multiple input NOR gates 1227 to 1229 and 1231 to 1233 receive signals as shown in FIG. 43. Set output of flip-flop 1225 is applied to an input terminal of flip-flop 1231. The reset signal of flip-flop 1225 is applied to NOR gates 1232 and 1233. There is no connection from the set terminal of flip-flop 1226. The reset terminal of flip-flop 1226 is applied to NOR gate 1232 and the reset terminal of flip-flop 1227 is applied to NOR gates 1231, 1233 and 1234, respectively. The set terminal output of flip-flop 1227 is applied to NOR gate 1235. NOR gates 1234 and 1235 have applied thereto an $\overline{X17}$ signal also. The output from gates 1234 and 1235 are a +Qyz and a −Qyx signal, respectively. NOR gates 1227 to 1229 and 1231 to 1233 are fed into NOR gate 1236, the output thereof yields a $\overline{B}$ signal. This signal is also passed through an inverter 1237 yielding a B signal.

FIG. 44 indicates the logic circuitry used in the summer 1205 proper; NOR gate 1241 has an $\overline{X}$ and a $\overline{P7}$ signal applied thereto, NOR gate 1242 has a $\overline{B}$, C1 and R signal applied thereto, and gate 1243 has a $\overline{B}$, $\overline{C1}$ and an $\overline{R}$ signal applied thereto. Circuit 1244 has a B, C1 and an $\overline{R}$ signal applied thereto. NOR gate 1245 has a $\overline{C1}$ and an R signal applied thereto, and NOR gate 1246 has a B, $\overline{C1}$ and an $\overline{R}$ signal applied thereto. The outputs from these gates are applied to NOR gates 1247 to 1249 and 1251 and 1252, and OR gate 1253 in the following manner; output signals from gates 1244 to 1246 are applied to all other gates mentioned immediately above. Additionally, the output of gates 1242 and 1243 is applied to OR gate 1253, and the output of gate 1241 is applied to the input of NOR gate 1247. A P17 signal is also applied to gate 1247. NOR gate 1248 also has applied thereto a $\overline{Y17}$ and $\overline{Pw}$ signal. Gate 1249 has also applied thereto a $\overline{Pw}$, a $\overline{P17}$ and an $\overline{X}$ signal. Gate 1251 has a +Qyx signal and an X17 signal applied. The output of gate 1247 is fed to an OR gate 1255, magnetic delay core 1256, and flip-flop 1257. The output of OR gate 1253 is applied to shift registers 1209, 1211 and 1213, and to flip-flop 1258. The output of gate 1248 is applied to a flip-flop 1259, and the output of NOR gate 1249 is applied to flip-flop 1261. Signals from the rest output terminal of this last-mentioned flip-flop are applied to NOR gates 1262 and 1263 along with −SKU and $\overline{Y17}$ signals applied to gate 1262 and +SKU and $\overline{Y17}$ signals applied to gate 1263.

The numbers added in this summer are B; that is, the output of gate 1236 of FIG. 43, and the R output of flip-flop 1258 of FIG. 44 and their negations. Flip-flop 1257 is fed by delay bit 1256 and provides the carry from the previous bit to the summer. The B signal output of this summer represents several different functions occurring at X, Y and Z times. Therefore, one summer services all three shift registers 1209, 1211 and 1213.

X WORD TIME

During X word time, SKU+Qyx are gated to the summer by gates 1231 to 1233, which signals, through gates 1236 and 1238, yield this signal from the B output during X time. This sum is gated into shift register 1209 during X word time, 1211 during Y word time, and 1213 during Z word time.

Y WORD TIME

Circuit 1228 gates Vgx to the Q summer 1205 during Y time through gates 1236 and 1237.

Z WORD TIME

Qxx is gated to the summer via gates 1229, 1236 and 1237, yielding the Qxx Vgx Δt signal on the B output lead during Z time.

COMPUTATION DURING X WORD TIME

The computation during X word time develops the mΔVx term of equation (47) and the Qyx Vgx Δ term of equation (46). Binary numbers are gated into shift register 1213 which serves as an accumulator or memory. Overflows of the register are sensed to gate other logic to implement certain terms. The SKU+Qyx constants are stored in register 844 and are shifted out during X time. The least significant bit of SKU stored in core 17 is always written in as a 0.

The gating of SKU by ΔV1w to the Q summer 1205 is shown in FIG. 45. Assume the following value of +SKU being stored in shift register 844:

| Core Number | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| | 0 | 1 | 0 | 0 | 0 | 0 | 0 | 0 | 0 | 0 | 0 | 0 | 0 | 1 | 0 | 0 | 0 |
| Bit Times | 17 | 16 | 15 | 14 | 13 | 12 | 11 | 10 | 9 | 8 | 7 | 6 | 5 | 4 | 3 | 2 | 1 |

During the first bit time, a 0 will be read out of core 16. Another 0 will be read out during the second bit time. A 1 will be read out during the third bit time, and a 0 will be read out during the fourth bit time. Thus, the binary number 0100 is read to the Q summer through flip-flop 1226. The binary number from core 17 will be 1000, or twice the value. Gate 1232 is inhibited by P7, since this represents the least significant bit of Qyx and is not a part of SKU. The gate is also inhibited by ΔV2w to prevent gating of the contents of gate 1232 under a 2 ΔVx condition.

The function 2SKU is available so that if SKU is gated into the summer as a result of ΔV1x, twice the value should be gated into the summer for a 2ΔVx. Gate 1233 is inhibited by P1. This gate output is the least significant bit of SKU, and is not used. Since both ΔV1w and ΔV2w are generated by a 2ΔVx condition, a value of 2SKU is gated by a 2ΔVx signal.

The SKU additions processed by summer 1 are accumulated by shift register 1213. The three inputs that feed carry NOR gate 1247 also feed gate 1248. The logic output of gate 1248 therefore represents the carry output. However, gating at X7 time restricts the carry function sensing to a carry at X7 time. Assuming that the first seven bit positions of shift register 1213 are occupied, the addition of another bit will generate a carry at P7 time, thus yielding an output or an overflow signal from gate 1248. Notice that the carry gate 1247 is inhibited at X7 time by gate 1241, since it is necessary to prevent the SKU overflow from being added to Qyx which is also stored in shift register 1213. The SKU overflow signal from gate 1248 sets flip-flop 1259 to produce a ΔVzx signal which is used in the pitch section. The ΔVzx signal is fed to gates 1262 and 1263 where gating by the sign of SKU is accomplished. The selection of −SKU (used for long-range shots) causes the missile to skew the coordinates below the 45° reference, while the selection of +SKU (which may be used for short-range shots) causes the missile to skew the coordinates above the 45° reference. The sign of SKU is stored in bit 16 of shift register 844. The implementation of the sign of SKU is shown in FIG. 45.

FIG. 45 shows the SKU sign circuitry to consist of a NOR gate 1271 and a flip-flop 1272 in series. $\overline{Rt}$, $\overline{Pw}$, $\overline{Y}$ and a PIGA signal are fed to the gate, the output of which is fed to set terminal of the flip-flop. The reset terminal has applied thereto an X17 signal. The set output of flip-flop 1272 yields a +SKU and the reset yields a −SKU signal.

A plus SKU yields a +SKU output, and a negative SKU yields a −SKU output. These outputs are gated into gates of 1262 and 1263. If +SKU is selected, gate 1263 will be inhibited. Gate 1262 will be enabled, yielding a −Qz output. With −SKU selected, gate 1262 will be inhibited and gate 1263 will be enabled, yielding a +Qz output. The +Qz and −Qz outputs are the outputs representing the mΔVx term. These signals are processed by the ΔVg generator.

Qyx Vgx Δt COMPUTATION

The Qyx Vgx Δt term of the equation is implemented by using Vgx Δt overflows from shift register 1211. This overflow gates Qyx into shift register 1213, with Qyx overflow sensing of this register by gates 1251 and 1252, the outputs of which represent Qyx Vgx Δt. The gating of Vgx to the Q summer occurs during Y time, and overflow sensing by gate 1248 produces a Vgx Δt signal from flip-flop 1259. This signal gates Qyz to the Q summer through gate 1231.

Gate 1231 is inhibited by Pl through P7 to gate out the SKU word, and is inhibited by P16 and P17 to gate out the sign of SKU and the sign of Qyx. The Qyx additions processed by the Q summer are accumulated by shift register 1213. As the outputs of gates 1251 and 1252 represent the carry output at X17, the presence of an output indicates that the Qyx accumulation has overflowed the capacity of shift register 1213. Carry gate 1247 is inhibited by P17 to inhibit additions resulting from overflows which occurred during the previous word times.

The sign of Qyx is produced by gates 1234 and 1235. With +Qyx selected, flip-flop 1227 is set, inhibiting gate 1235 and enabling gate 1234. This results in a +Qyx signal from gate 1234. With −Qyx selected, flip-flop 1227 is reset, inhibiting gate 1234 and enabling gate 1235, yielding a −Qyx.

The function +Qyx connects to gate 1251. This gate produces an output only when −Qyx is selected, yielding an output −Qy respresenting a minus Qyx overflow. Gate 1252 will yield a +Qy output with +Qyx selected representing a plus Qyx overflow.

The +Qy and −Qy outputs are the outputs representing the Qyx Vgx Δt term. These signals are processed by the ΔVg generator to be discussed later.

COMPUTATION DURING Y WORD TIME

Computation during Y word time consists of gating Vgx to the Q summer through gate 1228 by Δt. The gating of Vgx and overflow sensing was explained in the previous section.

COMPUTATION DURING Z WORD TIME

Two separate quantities are gated into the summer during Z word time by gates 1227 and 1228. This is essentially a time multiplexed arrangement. ΔThe Δt waveform and the Qxz Δt waveform are generated as was shown in FIGS. 33 and 34.

The Δt gating of Vgx to the Q summer from gate 1228 occurs during all odd frames. An overflow in shift register 1211 can result after such an addition. This overflow ($\overline{Vgx}$ $\overline{\Delta t}$) would extendfrom Y17 of an odd frame X17 of an even frame. As a result, gating of Qxx to the Q summer from gate 1229 during Z time will occur only during an odd frame. $\overline{\Delta xz}$ $\overline{\Delta t}$ is an enable signal only during even frames. In this manner, the quantity [Qxx Vgx Δt+Qxz Vgz Δt] is stored in register 1209. The overflow sensing of this register is accomplished by sensing the delayed carry from flip-flop 1257. Although sensing of gate 1263 is done at Z17 time, it is the carry from the sixteenth bit addition that is being sensed. An arbitrary designation of Fo represents the above expression for convenience. This signal is processed by the ΔVg generator.

GENERATION OF ΔVg

The ΔVg computation circuit is supplied with initial velocity to be gained quantities, one for each of the computing axes. These are the ΔVg quantities received from the fire control.

The purpose of the ΔVg computation circuit is to modify the missile's actual change in velocity termed as functions of:

The output of the accelerometer computation circuit, ΔV1w and ΔV2w pulses which represent the changes in a missile velocity; and the output of the Q computation circuit which represents a modifying effect varying in a predictable manner as the time of powered flight progresses.

The output of the ΔVw circuit is used in the ΔVg computation circuit to modify the value of the velocity to be gained terms. The Q quantities correct velocities to be gained as a function of both lapse time of flight, and performance of the missile. The Q terms effects the ΔVg computation circuit in such a way as to correct the trajectory for unprogrammed flight variations such as non-standard missile thrust.

The ΔVg computation circuit consists, in fact, of two separate and distinct circuits, the ΔVg adder and the ΔVg generator. The adder circuit is composed of a full binary adder with three 17 bit serial shift registers to store the adder sum.

The initial velocity to be gained and missile motion terms are read into the guidance computer from the fire control, through the ΔVg adder, into these registers. These three velocity terms are then recirculated through the adder where each may be modified by addition or subtraction of the velocity and, the Q computation increments recieved from the ΔVg generator. Each modified velocity term is returned to the series registers for storage and recirculation. The adder has a special carry inhibit function to keep information from being carried from one velocity term to another.

In equations $$\Delta Vgx = -(Qxx\ Vgx\ \Delta t + Qxz\ Vgz\ \Delta t) - \Delta Vx \quad (45)$$

$$\Delta Vgy = -(Qyx\ Vgx\ \Delta t) - \Delta Vy \quad (46)$$

$$\Delta Vgz = -\Delta Vz + m\Delta Vx \quad (47)$$

the remaining terms are the ΔVx, ΔVy and ΔVz, the signals from the accelerometers. The ΔVg generator 1401, shown in FIG. 46, combines these signals and generates signals for suitable use in the Vg summer 1402. This summer uses the ΔVg's to change the Vg's signals incrementally. The ΔVg generator 1401 combines the output of gate 1263 which represents [Qxx Vgx Δt+Qxz Vgx Δt]. The ΔVg generator 1401 yields output signals represented by ±Qy, ±Qz, ΔVx, ΔVy and ΔVz in binary form, changing the Vg's increment. The increments of ΔVg are only ±1 and ±2. The conditions under which this occurs are as follows:

(1) A ΔV1 signal by itself, which is a positive increment, will generate a −1 to reduce the stored Vg.

(2) A ΔV2 signal by itself, which is a negative increment, will generate a +1 to increase the stored Vg.

(3) A 2ΔVx signal by itself, which is a douple positive increment, will generate a −2 to decrease the stored Vg.

(4) The convention for the Q's is such that a +Q is equivalent to a +1, and a −Q is equivalent to a −1. A −Q, which represents a (−Qy) or (−Qz), cannot exist along during flight, since the PIPA's will always be generating either a ΔV1 or a ΔV2.

TABLE XI

| | ΔVg Generation | | |
|---|---|---|---|
| Function | Generate | ΔVg | NOR gates |
| ΔV1 | −1 | P1, P2-17 | 1414, 1415 |
| ΔV2 | +1 | P1 | 1416 |
| 2ΔVx | −2 | P2-17 | 2ΔVx to 1419 |
| +Q | +1 | P1 | 1417 |
| ΔV1(−Q) | −2 | P2-17 | 1414 |
| ΔV2(+Q) | +2 | P1, CVgP1 | 1411, 1418 |
| 2ΔVx(+Q) | −1 | P1, P2-17 | 2ΔVx, 1417 |
| ΔV1(+Q) | 0 | — | — |
| ΔV2(−Q) | 0 | — | — |

Turning now to FIG. 46, there is shown NOR gate 1411 to which a ΔV1 signal is applied and ΔV1 signal from fire control, NOR gate 1412 to which ΔV2 signal and ΔV2 signal from fire control are applied, and NOR gate 1413 to which an Fo, +Qy and +Qz signals are applied. The Vg's from the fire control are applied to the set terminal of a flip-flop 1423. The reset terminal thereof has To and Pr signals applied. NOR gates 1414 and 1415 have the following signals applied thereto:

$\overline{P17}$, Fo, +Qy, +Qz, Ytt and $\overline{P17}$, Fo, ±Qy, ±Qz, respectively, and the output of gate 1411. The output of NOR gates 1412 and 1413 are applied as input signals to NOR gates 1416, 1417 and 1418. NOR gate 1416 also has applied thereto a P17, −Qy and −Qz signal. NOR gate 1417 has applied thereto a P17, ΔV1 and ΔV1 signal from the fire control.

The output of gate 1414 and a 2ΔVx signal is fed to the input of an OR gate 1419, delay core 1424 and flip-flop 1425. The reset terminal output of flip-flop 1425 is applied to NOR gate 1426 along with a P16 signal. The output of NOR gates 1426 is fed back and applied to another input terminal of OR gate 1419. The set output of flip-flop 1425 is applied to the input of an OR gate 1421 along with output signals from NOR gates 1415, 1416 and 1417 and a ΔVgz1 signal.

The output of OR gate 1421 is fed to a single bit delay core 1427, the output of which core is applied to the set terminal of a flip-flop 1428 along with the output from the set terminal of flip-flop 1423. The reset terminal of flip-flop 1423 has applied thereto a Pr signal.

Logic circuitry for the Vg summer 1402 is shown in FIG. 47. NOR gate 1451 has a CVg output and $\overline{Vgx}$ signal applied. NOR gate 1452 has a CVg signal, $\overline{Vgx}$ and ΔVg signal applied as inputs. The input to NOR gate 1453 consists of $\overline{CVg}$, Vgx and ΔVg signals. Gate 1454 has CVg, Vgx and ΔVg signals applied thereto and NOR gate 1455 has input signals of $\overline{CVg}$, $\overline{Vgx}$ and $\overline{\Delta Vg}$. Signals from NOR gates 1451 to 1453 and a P17 signal are applied to NOR gate 1456, which output signal is applied to OR gate 1457 along with the output signal from gate 1418 of FIG. 46. The output of gate 1457 is applied to magnetic core 1458 and set terminal of flip-flop 1459.

Output signals from gates 1452 to 1455 serve as input signals to OR gate 1461. From OR gate 1461 these signals are applied to shift register 1405. The output signal from shift register 1405 is applied to the set terminal of flip-flop 1462 and applied to the input terminal of shift register 1404. The output of shift register 1404 is applied to the set terminal of flip-flop 1463 and to shift register 1403. The output of shift register 1403 is applied to the set terminal of flip-flop 1464.

Additionally, an output signal from core 15 of register 1403 is applied to flip-flop 1465. Reset output terminal of this flip-flop is connected to the input of NOR gate 1466 along with a $\overline{Pw}$ signal. All the flip-flops have a Pr signal applied to their reset terminals.

The operation of the Vg summer 1402 is similar to that of the Q summer. An erase signal applied to the computer erases the shift registers 1403 to 1405. New values of Vgo's are read therein through input flip-flop 1423 of FIG. 46 to produce ΔVg's from flip-flop 1428. In addition, ΔVg's are read in from fire control. With the initial conditions established, the ΔVg's modify the stored Vg's. The following convention is used for the multiplexed Vg terms. Vgy, z, x represent Vgy during X time, Vgz during Y time, and Vgx during Z time. Similarly, Vgz, x, y represent Vgz during X time, Vgx during Y time, and Vgy during Z time.

The generation of the ΔVg signals is described in the following paragraphs.

A ΔV1 signal by itself will cause a P17 output from both gate 1414 and gate 1415. P17 pulses applied to OR 1419 and OR 1421 produce P1 and P2–17 from flip-flop 1428.

A ΔV2 signal by itself will cause a P17 output from gate 1416. A P17 pulse applied to OR gate 1421 produces a P1 pulse output from flip-flop 1428.

A 2ΔVx signal by itself will cause a Z17 output from OR gate 1419, thereby producing P2 through 17 from flip-flop 1428.

A +Q by itself will cause a P17 output from gate 1417. This pulse applied to OR gate 1421 will produce a P1 pulse from flip-flop 1428.

ΔV1 and −Q will cause a P17 output from gate 1415. This P17 pulse applied to OR gate 1419 will produce P2 through 17 from flip-flop 1428.

The generation of P2 through P17 pulses is accomplished by applying a $\overline{P17}$ pulse to OR gate 1419 through NOR gate 1414. Delay 1424 delays the pulse to P1 time and flip-flop 1425 feeding gate 1426 allows the generation of a train of pulses through time P16. The output of flip-flop 1425 is a train of pulses occurring from P1 through P16 when a P17 pulse is applied to OR gate 1419. The P1 through P16 train of pulses applied to OR gate 1421 is delayed by core 1421 to produce a P2 through P17 train of pulses from flip-flop 1428. A P1 pulse is generated by applying a P17 pulse to OR gate 1421 through NOR gate 1416. Delay core 1427 delays the pulses to P1 time producing a P1 pulse from flip-flop 1428.

ΔV2 and a +Q will cause a P17 output from both gate 1414 and gate 1418. The P17 output of gate 1414 produces P1 from flip-flop 1428. The P17 output of gate 1418 is applied to OR gate 1457 to be delayed one bit by core 1458. The resulting CVg P1 output is summed in the Vg summer along with the ΔVg P1 output of flip-flop 1428. The net effect of the CVg P1 being summed with the ΔVg P1 is to produce a P2 pulse as required. For example, assume a Vg value of +3 stored in summer 2, and a ΔVg of +1 as represented by the P1 pulse from flip-flop 1428. The CVg pulse causes:

| | | |
|---|---|---|
| CVg | (+1) | 0.0000000000000001 |
| Vg | (+3) | 1.0000000000000011 |
| ΔVg | (+1) | 0.0000000000000001 |
| New Vg | (+5) | 1.0000000000000101 |

2ΔVx and a +Q will cause a Z17 output from OR gate 1419 and a P17 from gate 1417. Thus, both a P1 and a P2 through 17 pulse train will be produced from flip-flop 1428.

The signal ΔVgzl fed into OR gate 1427 represents a large increment of velocity which is to be added to the Vgz register at Tt time. The Ytt inhibit placed on gate 1414 prevents the generation of P1 through 16 pulses from flip-flop 1425 which would mask the ΔVgx1 signal by generating a small negative increment instead of the large positive increment.

STEERING COMMAND CIRCUIT

The function of the steering command circuits, the pitch steering circuits 1600 and yaw steering circuits 1800, is to solve the missile steering equations and to issue signals to the missile flight control electronics which control the trajectory of a missile in the pitch and yaw planes. The Tc signal generated within the functional timing circuit 800 inhibits the generation of steering commands until a predetermined time after the missile launch; thereby allowing roll orientation and vertical stabilization of the missile before the guided portion of flight begins. Further, steering commands are inhibited from leaving the computer after the cutoff signal has been generated.

The logic used in both the pitch and yaw steering circuits is quite similar. The computation involved in solving the steering equations is:

Input circuits which generate various scaling and threshold constants and receive accelerometer information (ΔVw), velocity to be gained quantities (ΔVg), signals from the functional timing circuits, and skew information (SKU) from the Q computation circuits. These terms are combined and form the addend to a control adder;

The control adder is a full binary adder with special features to allow for solution from the steering equations;

Holding logic holds the control register in saturation if the sum of the quantities being added is greater than the storage capacity of the register in which the sum must be held; and Threshold comparative circuits continuously sample the contents of the control adder register to determine if the register quantity is greater in magnitude than a predetermined constant. If the register quantity is positive and greater in absolute magnitude than this constant, positive steering command is generated. If the register quantity is negative and greater in magnitude than the constant, negative steering command is generated.

PITCH STEERING CIRCUIT

The pitch computation must pitch the missile down range toward the target and fix missile thrust vector above or below the X axis by a predetermined angle of skew.

Recalling the pitch steering equation:

$$\Delta\theta = K1\ Vgz\Delta t + K2\ [\Delta Vz - SKU\ \Delta Vx] \quad (48)$$

Assuming prelaunch initial condition to be a negative Vgz and a negative SKU quantity, when the missile is launched, the Z PIPA is sensing negative acceleration. Negative Z velocity increments cause the scaling quantity constant K2 to be added to the contents of the pitch register and also cause the magnitude of Vgz to be reduced.

At the same time, the inverse of Vgz is being added to the pitch register causing positive addition to the register.

The initial high rate of missile acceleration holds total quantity in the pitch register negative causing the threshold comparator to issue negative pitch steering commands. Negative steering commands pitch the missile over and cause the K2 scaling factor terms to be summed with the contents of the register.

This process continues throughout powered flight; however, each time the missile pitches down, the rate of negative Z velocity increments sensed is decreased. Also, as the missile approaches the pitchover angle of predetermined magnitude from the vertical, the magnitude of the ΔVgz term will be reduced and the rate at which the Z velocity increment sum or K2 with the contents of the pitch register will have been reduced nearly to 0. If the SKU quantity read into the computer had been equal to 0, the missile would pursue a direction of thrust in pitch which would bring it, soon after staging, to a path which is approximately perpendicular to the sensitive axis of the Z PIPA.

When the first stage of the missile separates from the second stage, a momentary reduction of forward acceleration occurs. During this period, K2 will be added to the contents of the pitch register at a very slow rate. However, the inverse quantity ΔVgz will continue to be summed at the same rate as has been before. Therefore, the contents of the pitch register become a positive quantity allowing positive pitch steering commands to be generated. If this condition is not corrected, a positive pitch change of the missile will occur upon second stage ignition. To prevent this situation, the guidance computer adds a positive quantity of ΔVz to the ΔVgz at time Ttx, driving the ΔVgz approximately to 0. Furthermore, the contents of the pitch register is reduced to 0 at this time.

The SKU quantity inserts a factor into the pitch computation causing the missile to assume a pitch angle such that the Z acceleration sensed offsets this factor. The initial condition of SKU was negative. Therefore, the missile will pitch down below its ideal SKU trajectory. The Q computation circuitry sums the SKU quantity upon itself each time a positive increment of X velocity occurs. This causes SKU overflows to occur at a rate proportional to the acceleration sensed along the X axes. Each time an overflow of a negative SKU quantity occurs, a quantity equal to the magnitude of the scaling constant K2 is added to the contents of the pitch register. This condition pitches the missile down below the X axes causing a majority of positive increments from the Z accelerometer to occur. Positive Z acceleration allows the constant K1 to be summed with the negative contents of the pitch register. Therefore, with ΔVgz quantity approximately 0, the missile pitches down to an angle which will cause positive Z accelerometer pulses to occur at a rate approximately equal to the SKU overflow.

SKU overflow terms are also coupled into the ΔVg generator. ΔVgz is modified by negative summation of the positive Z accelerometer pulses. Each time an overflow of the negative SKU quantity occurs, a positive term is added to the ΔVg term. This cancels the negative summation. Thus, ΔVgz as received by the pitch computation appears unmodified by new trajectory accelerations.

INPUT LOGIC

Turning now to FIGS. 48*a* and *b*, the pitch input logic section 1601, there is shown in FIG. 48*a* NOR gate 1602 to which is applied P11, P17 and $\overline{Tt}$ inputs. NOR gate 1603 has P9, P10, P13 and Tt signals applied thereto. NOR gate 1604 has P8, P9, P12 and Tt signals applied thereto. NOR gates 1605, 1606 and 1607 have P7, P9 and Tt signals; P12, P13, P14, P17 and Tt signals; and P6, P8 and Tt signals, respectively, applied thereto. The output signals from the above-mentioned NOR gates are labeled for convenience as follows: NOR gate 1602, $+\overline{K1}\ \overline{Tt}$; NOR gate 1603, $2\overline{(K2)}\ \overline{Tt}$; NOR gate 1604, $+\overline{K2}\ \overline{Tt}$; NOR gate 1605, $2\ \overline{K2}\ Tt$; NOR gate 1606, $+\overline{K1}\ \overline{Tt}$; and NOR gate 1607, $+\overline{K2}\ Tt$.

NOR gates 1608 and 1609, and 1611 to 1618 have input signals fed thereto as shown in FIG. 48*b*.

The output of NOR gate 1609 is applied to input of a NOR gate 1611 along with a $\overline{Z}$, ΔVzx, $\overline{\Delta V2w}$ and P17 signals. A NOR gate 1621 has applied thereto a $+\Delta\theta$ signal and the output signal from NOR gate 1613. The output of NOR gate 1614 is applied to a NOR gate 1622 along with the following signals: $\overline{\Delta Vzx}$, ΔV1w, +SKU, P17 and $\overline{Z}$. The output of NOR gates 1608, 1611, 1612, 1615 to 1619 and 1621 to 1622 are applied to a NOR gate 1623, the output signal of which gate is applied to a NOR gate 1624 yielding a Bp output signal. The output of gate 1623 yields a $\overline{Bp}$ signal. The output of gate 1613 is a $-\overline{K1}$ signal.

The constants used in implementing the pitch steering equation are fed into the pitch input section of FIGS. 48*a* and *b* to the pitch adder of FIG. 49. In addition, Vgz is also an input and is complemented by NOR gate 1608 so that $\overline{Vgz}$ rather than Vgz is gated to the adder. The output function Bp, which is tied to the adder shown in the pitch command summer section, is in the form of a 17 bit binary word and represents $\overline{Vgz}$, ±K1, ±K2 or ±2K2 during the appropriate word time. However, at a time when information is not gated into the adder, the function Bp represents binary 0 or a 1 in the 17th bit position, and zeros in bits 1 through 16.This is specified as machine 0. The K2 constant is added to Rcp (the contents of the pitch sum register, to be explained hereinbelow) by the occurrence of a ΔVz pulse from the accelerometer decoder section. The ΔVz pulse, however, must be transformed to a ΔVw signal, which is a train of 17 pulses, each of one bit time duration, to gate a 17 bit constant. The K1 constant is added to Rcp whenever a pitch command is generated. The value of Rcp is reduced by K1 each time a positive pitch command occurs as an output. However, +K1 is added to Rcp whenever a negative pitch command is generated.

If a +SKU overflow and a ΔV1w pulse occur simultaneously (ΔV1w representing ΔV1z) then +K2 is added to Rcp. The function −2K2 is added by the coincidence of ΔV2w and −SKU.

The complemented value of Vgz, Vgz, is added to Rcp at a fixed rate of 50 additions per second, the pulse rate of the NCPS signal.

The K2 constant is inserted through gate 1609 from gate 1604 prior to Tt time, and from gate 1607 after Tt time. The output of NOR gate 1609 represents −K2 and is tied to NOR gate 1619. The output of NOR gate 1619 then is −K2 whenever a ΔV2w pulse train occurs within the computer at a time when an SKU overflow (ΔVzx) pulse is not present. Actually, this value of −K2 is one bit less than the actual value of −K2, for to find the negative of a given binary number it is necessary to complement the number and add one. However, the value of −K2 generated in this fashion is accurate enough for the instrumentation.

The output of NOR gate 1611 represents the constant +K2 and it occurs whenever a ΔV1w signal occurs in the computer without an SKU overflow.

$\overline{Vgz}$ is the function output of NOR gate 1608 during X word time and occurs at a rate governed by the NCPS signal.

The proper K1 constant is gated in a manner similar to K2 by the presence of a plus or minus pitch command (±Δθ) through NOR gates 1612, 1613 and 1614. However, the value of −K1 occurring as an output of NOR gate 1613 is the true value.

The K2 constants from NOR gates 1604 and 1607 have no sign bit. A P17 pulse fed to NOR gate 1619 inhibits the output of this gate so that −K2 has the correct sign. The output of NOR gate 1611 has no sign bit included. The sign is inserted as an input to gate 1623 at P17 time from gate 1618. The value of ±2K2 is gated similar to the K2 constant through NOR gates 1614, 1615 and 1622. NOR gates 1616 and 1617 supply sign bits. The output of NOR gate 1616 is a sign bit during X17 time for the +2K2 constant whenever it is gated into the adder. It also supplies a sign bit for the binary representation of 0 to the adder when a ΔV2w signal and a +SKU overflow occur simultaneously. NOR gate 1617 has an output during each X17 time that $\overline{Vgz}$ is not added to Rcp. This results in the generation of binary 0 to the adder. It is necessary to add binary 0 to Rcp whenever information is not gated, since the gating of all zeros, 1 through 17, results in the summation of Rcp and a negative maximum number.

The output of NOR gate 1622 is −2K2 and this occurs during flight when a ΔV2z and a −SKU overflow occur simultaneously. Under these conditions, the ΔV1w and +SKU inputs represent logic zeros (as well as the $\overline{\Delta Vzx}$ signal) so that the NOR gate is enabled. NOR gate 1615 has +2k2 as an output whenever ΔV1w and SKU overflow pulses occur simultaneously. Under these conditions, the ΔV2w and −SKU inputs represent logic zeros as well as the $\overline{\Delta Vzx}$ signal.

The inputs +SKU and −SKU mentioned above are levels from the sign of SKU flip-flop described hereinbefore. The convention adopted is that if the function output of the flip-flop (designated +SKU) contains a logic 1, then the SKU word initially stored by fire control is positive. If the function output contains a logic 0, then the word is negative.

The constants gated into the adder as a function of ΔV pulses and SKU overflows (ΔVzx) are listed in Table XII.

TABLE XII

| V pulse | SKU Overflow | Constant Gated | NOR gate |
|---|---|---|---|
| ΔV1w | None | +K2 | 1611, 1618 |
| ΔV2w | None | −K2 | 1619 |
| ΔV1w | +SKU | +2K2 | 1615, 1618 |
| ΔV1w | −SKU | Binary 0 | 1618 |
| ΔV2w | +SKU | Binary 0 | 1616 |
| ΔV2w | −SKU | −2K2 | 1622 |
| None | None | Binary 0 | 1618 |
| None | +SKU | +2K2+Z17 | 1615, 1618 |
| None | −SKU | −2K2 Z17 | 1622, 1618 |

The following conditions can exist during fire control test problems:

The upper portion of Table XII shows the values of K2 gated into the adder during flight, since the instrumentation makes ΔV pulses always present. The ΔV1w signal represents ΔV1z while ΔV2w represents ΔV2z. Column two contains the polarity of the SKU overflow when it occurs. The third column contains the value and polarity of the constant that is gated into the adder, and the fourth column lists the NOR gate used. In addition, the lower portion of the table shows combinations that may occur during fire control check out, namely, the adding of ±2K2 containing a positive sign bit Z17.

The NOR gates which gate the constants to the adder are all tied to NOR gate 1623, so that during each word time a binary number representing either information or 0 will be gated through 1623. The logic lets only one gate at a time feed 1623 and the other outputs will be logic zeros. The output of 1623 is inverted so that NOR gate 164 inverts the number back to its original state. The function output of 1624 is designated Bp and is tied to the adder to be summed with the contents of Rcp.

PITCH ADDER CIRCUIT

The adder section 1631 of the pitch command network is shown in FIG. 49. This section is composed of NOR Gate 1632 to which Cp and Rcp gate signals are applied, gate 1633 to which $\overline{Cp}$, Rcp and Bp signals are applied, gate 1634 to which $\overline{Rcp}$, Bp and Cp signals are applied, gate 1635 to which are fed $\overline{Bp}$, Rcp and Cp signals and NOR gate 1636 to which $\overline{Rcp}$, $\overline{Bp}$ and $\overline{Cp}$ signals are fed. The output of gates 1632 to 1634 are fed to the inputs of NOR gates 1637 to 1639 and 1641. The output of gates 1635 and 1636 are also fed to the input of gate 1641. $\overline{Pw}$ and $\overline{X17}$ signals are also applied to gate 1639, P17 signal to gate 1638 and $\overline{P17}$ signal to gate 1635. Additionally, a NOR gate 1642 has +Δθ, −Δθ, $\overline{Y}$ and $\overline{P16}$ signals applied thereto. The output of gates 1642 and 1637 are applied to the input of an OR gate 1643, magnetic core 1644 and flip-flop 1645. The outputs of this flip-flop are Cp and $\overline{Cp}$ signals. The output of gate 1638 is applied to a NOR gate 1646 along with a $\overline{Pw}$ and an $\overline{X17}$ signal. The output of this gate is designated $\overline{Cp}$ X17. The output of gate 1639 is designated Cp X17. The output of NOR gate 1641 is designated $\overline{R}$. This signal along with an $\overline{Sc}$ and P17 signal are applied to NOR gate 1647. The output of this gate is designated $\overline{R}$. The output of gates 1638 and 1647 are applied to an OR gate 1648 along with an Sc P17 signal and the output of the OR is applied to shift register 1649. The output of the shift register is connected to multiple input flip-flop 1651. Other inputs to the set terminal of this flip-flop are Scp and Ytt signals and applied to the reset terminal are Ttff, $\overline{P17}$, Z, and $\overline{Scp}$ signals. The output of the set terminal of flip-flop 1651 is designated Rcp and the output of a NOR gate 1152 attached to the set terminal is designated $\overline{Rcp}$.

The adder section performs the summation of Bp and Rcp, and accumulates the sum in accumulation register Rcp 1649. The adding is done serially so that the inputs to the adder are Bp, Rcp, and a delayed carry from the previous bit addition. In the addition of three binary bits, a sum of 1 occurs when either of the bits is a 1 or all three are ones as shown by the logic expression below.

$$S = Rcp\ \overline{Bp}\ \overline{Cp} + \overline{Rcp}\ Bp\ \overline{Cp} + \overline{Rcp}\ \overline{Bp}\ Cp + Rcp\ Bp\ Cp$$

The first term of the above logic expression is the output of NOR gate 1634. The second term is the output of NOR gate 1635, the third term is the output of NOR gate 1633, and the fourth term is the output of NOR gate 1641, which in turn is fed to gate 1647. The output of 1647 then represents the sum which is written into the Rcp register 1649 through OR gate 1648. The inputs to NOR gate 1647 are also P17 and $\overline{Sc}$. The P17 pulse inhibits the output of 1647 so that no sign bit summation occurs. If the addition of Rcp and Bp results in a negative value, then a 0 is written in the Rcp sum register 1649. However, if the sum is positive, a 1 is written in at P17 time from the output of NOR gate 1638 ($\overline{Cp}$ P17). The $\overline{Sc}$ input to 1647 inhibits the output of the adder, except during checkout of the computer or inflight operation. The adder output of gate 1647 (R) and its complement from gate 1641 are fed to the comparator section. The $\overline{Sc}$ P17 input to OR gate 1648 writes a 1 during P17 time prior to computation so that the Rcp register contains the representation of binary 0. This is necessary for correct sign bit instrumentation. However, this pulse is removed during computation.

Two NOR gates 1633 and 1634, have outputs which are also tied to the carry generation circuit. This instrumentation reduces the number of gates needed in the adder. Whenever the addition of Rcp and Bp results in a carry, this carry bit occurs as an output of NOR gate 1637. The gate is inhibited at P17 time, however, since this would be a carry from sign bit addition. The carry pulse is fed to OR gate 1643 and is delayed one bit time by the one bit magnetic core shift register 1644. The delayed carry (Cp) is then fed back to the summer one bit time later. A carry is generated whenever any two o the three inputs to the adder contain logic ones or whenever all three inputs represent logic ones as shown by the carry expression below.

$$\text{Carry} = Rcp\ Bp\ \overline{Cp} + \overline{Rcp}\ Bp\ Cp + Rcp\ \overline{Bp}\ Cp + Rcp\ Bp\ Cp$$

In simplifid form this would be:

$$\text{Carry} = Rcp\ Bp + Rcp\ Cp + Bp\ Cp$$

NOR gate 1639 senses a carry during X17 time. Gate 1646 produces an output during the time that a carry is not present. In the comparator section, two flip-flops indicate the magnitude of Rcp with respect to K1. Sometimes both flip-flops are set at the end of the comparison. IF the comparison is between two positive number, then the output of NOR gate 1639 (Cp X17), which is a carry from the sign bit addition, will reset the negative flip-flop. If the comparison is between two negative numbers, the output of NOR gate 1646 ($\overline{Cp}$ X17) will reset the positive flip-flop.

NOR gate 1638 senses for a carry every P17 time. If the summation of Rcp and Bp involves two positive numbers, or one positive and one negative number, whereby the sum is equal to 0 or greater, a carry will be generated ($\overline{Cp}$ P17) and stored in the sign bit position of Rcp. The adder performs a bit-by-bit addition of the binary words including the sign bit, so that the proper sign bit must be determined and inserted in the sum register. Shift register 1649 (designated Rcp) is a 17 bit magnetic core shift register which holds the accumulation of Rcp and Bp during computation.

During every X word time, Rcp, Bp and Cp are compared in gates 1632 to 1639 and 1641. The results are stored in shift register 1649. If the sum is greater in magnitude than the constant K1, a pitch command is generated and the value of K1 is added to or subtracted from Rcp (depending upon whether the command is positive or negative). A positive pitch command gates −K1 into the adder, while a negative pitch command gates in +K1. The output of the shift register sets flip-flop 1621 each bit time that a logic 1 is present. The function output Rcp is fed back to the adder to be summed with Bp. The output of NOR gate 1642 is a pulse during Y16 time whenever a pitch command is not generated. This pulse is delayed one bit time to set carry flip-flop 1645 at Y17 time. As a result, the representation of binary 0 is added to Rcp.

The pitch command is set at a maximum rate of 50 commands per second. In order to sense an overflow in the Rcp register during the period of pitch commands in R generator, the overflow detector shown in FIG. 50 forms a part of this subject. The overflow detector is made up of NOR gates 1653 and 1654 to which are applied $\overline{Bp}$, $\overline{Cp}$, $\overline{Rcp}$, $\overline{Pw}$, and $\overline{P17}$ signals and Bp, Cp, Rcp, $\overline{Pw}$ and $\overline{P17}$ signals. The output of NOR gate 1653 is applied to the input of NOR gate 1655 and the set terminal of flip-flop 1656. Likewise, the output of NOR gate 1654 is applied to the input of NOR gate 1655 and the set terminal of flip-flop 1657. Other inputs to the NOR gate 1655 are $\overline{Pw}$ and $\overline{P17}$; the output of this NOR gate is applied to the reset terminal of flip-flops 1656 and 1657. Flip-flop 1656 yields an Scp signal and flip-flop 1657 yields an $\overline{Scp}$ signal. Consider the situation when Rcp is about to overflow in the positive direction. NOR gate 1656 senses this condition, by sampling the sign bits of $\overline{Rcp}$ and $\overline{Bp}$. Since the addition involves two positive numbers, Rcp and Bp are each a logic 0 during P17 time. In order for Rcp to overflow, there must be a carry generated in the 16th bit addition. The Cp input contains a logic 0 during P17 time, since the 16th bit carry is delayed one bit time. The output of NOR gate 1653 sets flip-flop 1656, which in turn holds Rcp flip-flop 1651 (FIG. 49) at 1 until the overflow condition ceases. When the overflow condition has passed (after Rcp is reduced by the addition of a negative number), the output of NOR gate 1655 resets flip-flop 1656. Since the overflow condition is sensed at P17 time (after the summation), it is possible to arrive at the wrong comparison in the comparator if the overflow occurs during X word time. To prevent this wrong comparison the Scp signal, which is the function output of flip-flop 1656, sets a positive flip-flop in the comparator section.

The same analysis applies in the case of a negative overflow. NOR gate 1654 senses the sign bits of Rcp and Bp during P17 time, and in the case of a negative overflow carry bit, will not occur from the 16th bit addition. When all of the inputs to NOR gate 1654 are at logic 0, an output will occur to set flip-flop 1657 which has the $\overline{Scp}$ function as its output. Scp then is used to hold the Rcp flip-flop 1651 in a reset condition, which allows all zeros to be read into the Rcp register until the overflow condition ceases. The $\overline{Scp}$ function also sets a negative flip-flop in the comparator section. This indicates that Rcp is more negative than −K1, regardless of the comparator output, which might be wrong if the comparison is made during an X word time when an overflow has occurred.

At Tt time, the constants which implement the pitch equation are switched so that the Rcp register is reset to 0 to prevent $\Delta\theta$ signals from being generated. The Ytt signal sets the Rcp flip-flop 1651 and holds it set for 17 bit times. This action causes all ones to be written into Rcp 1649. During the following Z word time, the input to the reset terminal holds the Rcp flip-flop 1651 reset for a period of 16 bit times. This allows 16 zeros to be written into Rcp so that the number contained is binary 0. The input to the reset is inhibited during Z17 time by the P17 input. This is also inhibited by Ttff at all times, except during the first Z word time following Tt.

PITCH COMPARATOR AND SIGNAL GENERATOR

The pitch comparator and pitch signal generator compares the contents of Rcp with the wired-in constant K1. The result of this comparison causes a pitch command to be generated whenever the magnitude of Rcp is greater than K1, and a $\overline{Ts}$ gating signal is present. The logic for this section is shown in FIGS. 51*a* and *b*.

This unit is comprised of NOR gate 1661 to which the following inputs are applied: $\overline{R}$, $-\overline{K1}$, P17, $\overline{X}$ and $\overline{PW}$; NOR gate 1662 to which the following inputs are applied: R, $+\overline{K1}$ Tt, $+\overline{K1}$ $\overline{Tt}$, $\overline{Pw}$, $\overline{X}$ and P17 NOR gate 1663 to which the following inputs are applied: $\overline{R}$, $+\overline{K1}$ Tt, $+\overline{K1}$ $\overline{Tt}$, $\overline{Pw}$, $\overline{X}$ and P17 and NOR gate 1664 to which the following inputs are applied: R, $-\overline{K1}$, $\overline{P17}$, X and Pw. The output of NOR gate 1661 is applied to set terminal of flip-flop 1665 along with an Scp signal. The output of NOR gate 1662 and a $\overline{Cp}$ X17 signal is applied to the reset terminal of this flip-flop. The reset output of this flip-flop is applied to NOR gate 1666 along with a $\overline{Ts}$, $\overline{Tc}$, $\overline{Y}$ and a cutoff signal. The output of this NOR gate and a $+\Delta\theta$ signal from the fire control are applied to an impedance matching circuit 1667. The output of this circuit consists of a $+\Delta\theta$ signal to the autopilot, and a $+\Delta\theta$ signal through an inverter 1668.

The output of gate 1663 is applied to the reset terminal of flip-flop 1671 along with a Cp X17 signal, and the output of NOR gate 1664 and an $\overline{Scp}$ signal are applied to the set terminal. The reset output terminal of this flip-flop is applied to NOR gate 1672 with the following signals: $\overline{Ts}$, $\overline{Tc}$, $\overline{Y}$ and a cutoff signal. The output of NOR gate 1672 and a $-\Delta\theta$ signal from the fire control are applied to output impedance matching circuit 1673. The outputs from this circuit are of the same type as those from circuit 1667.

The gating signal (Pw) limits the maximum output rate to 50 commands per second. The NOR gates used for the comparison are 1661 to 1664. These gates perform a bit-by-bit comparison of Rcp and K1, excluding the sign bit, and control the final states of plus and minus flip-flops 1665 and 1671, respectively, at the end of the comparison.

When the number contained in the Rcp register is positive and greater than K1, the positive flip-flop 1665 will be set at the end of X word time. If the value of Rcp is more negative than $-$K1, i.e., if the condition Rcp $-$K1 is true, then the minus flip-flop 1671 will be set at the end of the comparison. A comparison is not made during Y or Z word times.

A positive pitch command ($+\Delta\theta$) occurs at the output of NOR gate 1666 during Ts time if the positive flip-flop is set. A negative command ($-\Delta\theta$) will be generated by NOR gate 1672 if the negative flip-flop is set. The commands are generated during the Y word time following the comparison. Two K1 constants are shown as inputs to the comparator gates; namely, K1 prior to Tt time, and K1 after Tt time. Only one constant will be present at a time, since the other will be a logic 0.

There are many combinations of numbers which result in both flip-flops being set at the end of the comparison. For example, consider a comparison between two positive numbers such that both the plus and minus flip-flops are in the set condition at the end of the comparison. Obviously, the minus flip-flop should be reset, as the comparison involves positive values. The signal Cp X17, which is a carry from the sign bit addition, will be present during X17 time to reset the minus flip-flop 1672. If the same situation occurs during the comparison of two negative numbers, then the Cp X17 pulse will reset the plus flip-flop 1665, since the signal is generated at X17 time when a carry from the sign bit addition is not present. Both of the above signals are generated in the pitch command summer section as shown in FIG. 49.

Two additional signals may also control the final state of the flip-flops: the Scp and $\overline{Scp}$ levels. These signals are generated in the Rcp overflow detector circuit shown in FIG. 50. If the addition of two positive numbers results in an Rcp register overflow, then the Scp signal is generated to set the plus flip-flop, indicating that Rcp K1. This is necessary since the overflow condition is sensed at the end of the addition, while the comparison of Rcp and K1 is performed during the addition. At the end of the particular word time that an overflow condition occurs, the sum register will contain a remainder which may be less than K1 constant. However, during the following word time, the Rcp register will hold a value equal to either the maximum positive or some reduced value. The maximum positive value is written into Rcp by the Scp signal applied to the set side of the Rcp flip-flop 1651. This acts as an overflow inhibit by preventing the contents of the Rcp register 1649 from overflowing to the opposite extreme of the number range, a situation which would result in the generation of pitch commands having the wrong polarity. The maximum positive value of Rcp is maintained until the summation of Rcp and a negative Bp occurs to reduce the sum, thereby removing the overflow inhibit. The addition of Rcp and 0 will also lift the overflow inhibit.

The $\overline{Scp}$ signal is generated in a similar manner when the addition of two negative numbers results in a negative Rcp overflow. The $\overline{Scp}$ signal then sets the minus flip-flop, indicating that Rcp $-$K1.

Pitch commands will not be generated prior to Tc time due to the $\overline{Tc}$ signal applied to NOR gates 1666 and 1672. NOR gate 1666 generates plus pitch commands ($+\Delta\theta$) after Tc time whenever the plus flip-flop is set and a $\overline{Ts}$ signal is present. NOR gate 1672 generates negative pitch commands whenever the minus flip-flop is set, during Ts time and after Tc time. Pitch commands occur at outputs of matching devices 1667 and 1673, and are fed to the autopilot and telemetry sections. The commands are also fed back to the pitch input section to gate $\pm$K1 into the adder to effectively reduce the contents of Rcp. The cutoff signal, when generated, prevents the generation of commands by inhibiting NOR gates 1666 and 1672.

YAW STEERING COMMAND CIRCUITS

The yaw computations must steer the missile in the yaw plane. The function is accomplished by having the yaw computation solve the yaw steering equation which is again reproduced below:

$$\Delta = K3\ Vgy\ \Delta t - K4\ \Delta Vy \quad (49)$$

The current value of Vgy is gated into the adder by occurrence of pulses on the Δt line so that Vgy is added to Rcy (the contents of the sum register) at a rate of 50 additions per second in the computer. In addition, the constant K4 is added to Rcy by the occurrence of ΔVy pulses. The convention is that −K4 is added when acceleration is sensed in the positive Y direction (ΔV1y) and +K4 added when the acceleration is negative (ΔV2v).

The Rcy sum is compared with the K3 constant during every Y word time. When the magnitude of Rcy is equal to or greater than K3, a yaw command (ΔU is generated. This command is then sent to the autopilot causing the missile to turn through a predetermined angle. In addition, the value of K3 is added to or substracted from the contents of Rcy depending on whether the command is negative or positive. If the yaw command is positive, K3 is substracted from Rcy, if negative, then the value is subtracted from Rcy, if negative, then the value of K3 is added to Rcy.

The value of Vgy in feet per second is equal to some number in the Vgy register times the scale factor. The value of Vgy needed to generate one yaw command for each Δt pulse is equal to the constant K3. If Vgy is equal to a binary 1, a yaw command is generated for every K3 Δt pulse.

The constants for the implementation of the yaw steering equation are fed into the yaw command input section as shown in FIG. 52. Inputs to NOR gate 1825 are P8 and P17, and inputs to gate 1802 are P9, P10 and P17. The output of NOR gate 1825 is fed to a NOR gate 1819 along with a $\overline{\Delta V2w}$ and a $\overline{Y}$ signal to a NOR gate 1814 with a P1 signal. The output of NOR gate 1814 is fed to NOR gate 1803 with a $\overline{\Delta V1w}$ and $\overline{Y}$ signal. The outputs of gate 1802 are fed to NOR gate 1803 with a −ΔU signal and to gate 1813 along with a P1 signal. The output of gate 1813 is applied to gate 1821 with a +ΔU signal. The output of gate 1813 is designated as −K3. The outputs of gates 1819, 1822, 1803 and 1821 along with the outputs of gates 1808, 1818 and 1817 are applied to the inputs of NOR gate 1823. The inputs to gates 1808, 1818 and 1817 are $\overline{Vgy}$, $\overline{X}$, $\overline{NCPS}$; $\overline{\Delta V1w}$, $\overline{Y17}$; and NCPS, $\overline{X17}$, respectively. The output of gate 1823 is designated as a $\overline{By}$ signal. This is applied to inverter 1824 yielding a By signal. In addition, $\overline{Vgy}$ occurs as an input to NOR gate 1808 so that the value of Vgy is gated to the adder during X word time at a rate of 50 additions per second.

NOR gates 1816, 1819 and 1822 gate ±K4 into the adder. The output of NOR gate 1816 is −K4 due to the P1 inhibit as an input (as explained earlier). The ±K4 constants are gated by the ΔVw inputs to NOR gates 1819 and 1822 during Y word time. If a ΔV1w pulse (representing ΔV1y) is present as an input to NOR gate 1819, the value of −K4 is gated to the adder, while +K4 is gated whenever a ΔV2w pulse is present. The ±K3 constants are gated in a similar fashion by NOR gates 1803, 1813 and 1821.

The gating is such that −K3 is added during the time that a +ΔØ command is generated while +K3 is added by the presence of a −ΔØ command. The ΔVy pulses are always present during flight, but are not always present during fire control testing. During a particular Y word time when ΔV pulses may not be present to gate ±K4 (ΔVw representing ΔVy), the binary representation of 0 as shown below must be gated to the adder.

1. 0 0 0 0 0 0 0 0 0 0 0 0 0 0 0 0

The output of NOR gate 1818 is the binary representation of 0 during a Y word time when acceleration pulses are not sensed. NOR gate 1817 generates the binary 0 during a time that Vgy is not added, since Vgy is gated at a 50 additions per second rate, while the X word gating signal occurs at a 1600-pps rate. The NOR gates mentioned above, which gate information to the adder, are all tied to NOR gate 1823. However, gates 1818, 1817, 1819, 1822, 1803 and 1821 will have a logic 0 output during Y time. The output of NOR gate 1824, By, is tied directly to the adder as shown in FIG. 53.

YAW COMMAND SUMMER SECTION

The yaw adder and its associated Rcy register are of exactly the same configuration and perform the same function as the pitch command summer section shown in FIGS. 49 and 50 to include the inputs applied thereto and the outputs derived therefrom. The yaw adder section and yaw overflow detector which comprise the summer are shown in FIGS. 53 and 54. In view of the discussion of FIGS. 49 and 50, no further discussion is deemed necessary here.

Note that yaw elements although labeled with reference numerals in the 1800 series have the same last two digits as their counterparts in the pitch circuits (i.e., 1651 is the Rcp flip-flop and 1851 is the Rcy flip-flop).

YAW COMPARATOR AND YAW SIGNAL GENERATOR

Figure 55B:
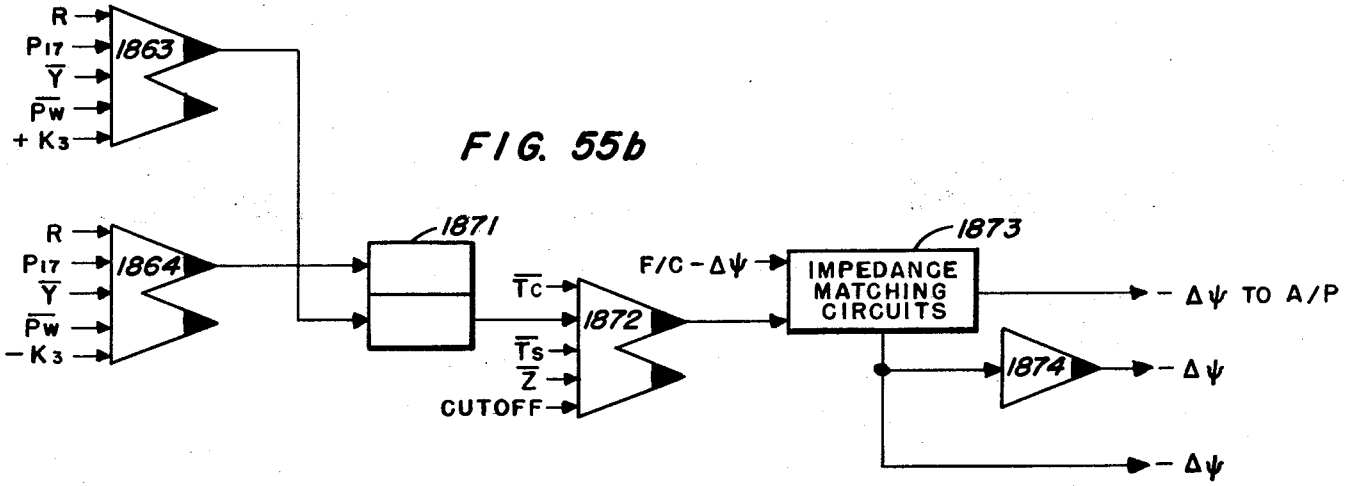

This circuitry, as shown in FIGS. 55*a* and *b*, compares the contents of the Rcy register 1849 with the wired-in constant. K3 generates a yaw command whenever the magnitude of the Rcy is greater than K3. To limit the output command rate to 50-pps, a Ts gating signal occurs. Recalling the yaw equation, $$\Delta Ø = K3\ Vgy\ \Delta t - K4\ \Delta Vy \quad (49)$$

the yaw comparator and signal generator are of identical configuration as the pitch comparator and signal generator shown in FIGS. 51*a* and *b* and disclosed hereinabove. This circuitry is shown in FIG. 55 to indicate the inputs applied thereto and the output signals derived therefrom.

PRE-ARM LOGIC

A pre-arm signal is generated by the pre-arm circuit 2000 activating the arming circuits of the warhead when:

(1) Vgx, Vgy and Vgz each are below a certain magnitude;

(2) Tc had occurred; and (3) the safe-to-arm inhibit signal has not occurred.

The logic circuitry to accomplish this result is shown in FIG. 56 wherein flip-flop 2002 receives the signs of the Vg signals from the Vg generator. The reset output of the flip-flop is connected to an input to a NOR gate 2003 along with a $\overline{P10}$ signal. A flip-flop 2004, to which a $\overline{P10-11}$ signal and a Y signal are applied, is connected to the set terminal of a flip-flop 2005 along with the output of NOR gate 2003. The set output of flip-flop 2005 is a −Vg signal and the reset output is a +Vg signal. A flip-flop 2006 has X17, Z17 and P1 signals applied to the set terminal thereof and a P11 signal applied to the reset terminal. The output of flip-flop 2006 and set output of flip-flop 2005 is applied to the input of a NOR gate 2007 along with a Vgz and $\overline{Pw}$ signal. The output of flip-flop 2006 is also applied to a NOR gate 2008 with the reset output of flip-flop 2005 with a $\overline{Vgz}$ and a $\overline{Pw}$ signal. The outputs of gates 2007 and 2008 are applied to the set terminal of a flip-flop 2009 and an X1 signal applied to the reset terminal thereof. The set output of flip-flop 2009 is applied to a NOR gate 2011 along with a Z17 signal and a $\overline{Tc}$ signal applied to the reset terminal of a flip-flop 2012 with the output of gate 2011 connected to the set terminal of the flip-flop. A safe-to-arm signal, originating at the stable platform, is applied to the set terminal of a flip-flop 2013 and an Sc signal applied to the reset terminal. The reset output terminal of flip-flop 2012 and the set output of flip-flop 2013 are connected to a NOR gate 2014 along with $\overline{Tc}$ and $\overline{Pw}$ signals. The output of gate 2014 is the pre-arm signal that is sent to the missile electronics.

The pre-arm logic is designed so that the Vgx register is continuously sensed throughout powered flight for the condition when bits 11–16 of Vgx are all zeros. The Vgx functions contain no sign bit; therefore, sign bit sensing is not necessary (Vgx is always positive).

Vgy and Vgz can be either negative or positive. Therefore, sign bit sensing is necessary. To determine if a particular Vg word is correct for the generation of a pre-arm signal, the sign bit is checked during a particular P17 time to determine if the word is positive or negative. During the following P1 through P16 bit times, the corresponding bits are checked for magnitude. A positive Vg word has the proper magnitude to generate a pre-arm signal if bits 11 through 16 are all ones.

If Vgy or Vgz is positive, the sign bit (bit 17) contains a 1, and, if it is negative, the sign bit contains a 0. The logic is designed so that Vgx is sensed as a positive word. When all three Vg words are correct, a pre-arm signal is generated if conditions (2) and (3) above are also true. Condition (2) is true after Tc time and condition (3) is true as long as a gimbal limit signal has not occurred. A gimbal limit signal is generated when a gimbal drive error signal exceeds a predetermined level. If this occurs, the pre-arm signal is inhibited.

Flip-flop 2002 shapes the signal from core 10 of shift register 1405 (FIG. 49). NOR gate 2003 senses the Vg sign bit during P10 time and generates a pulse to set flip-flop 2005, if the Vg word is positive. At the first shift pulse at the beginning of a new word, which occurs during a P1 time, the information stored in core 1 is shifted out. The P17 sign bit information is shifted out of core 1 during P1 time. The P17 sign bit information is shifted out of core 10 during P10 time. Since flip-flop 2005 is continuously reset at P2 time, the absence of a sign bit in the Vg word leaves flip-flop 2005 in the reset state, which is the condition representing a negative Vg word. Since the Vgx word is read out of the shift register during Y time, and since the Vg word should be treated as a positive entity, flip-flop 2005 is always set during Y10 time.

If flip-flop 2005 is set during a particular P10 time, it inhibits NOR gate 2007 during P10−1 time. However, it does enable NOR gate 2008 which performs the Vg magnitude check of positive numbers. If flip-flop 2005 remains reset as a result of the absence of a positive sign bit, gate 2007 will be enabled to perform the Vg magnitude check of negative numbers, and gate 2008 will be inhibited. Since the signal fed to gate 2007 is Vgz, x, y, and the signal fed to gate 2008 is $\overline{Vgz, x, y}$, the sampling of Vgy and Vgz includes only bits 11 through 16, while the sampling of Vgx includes bits 11 through 17.

Consider a +Vg word containing all zeros in bits 11 through 16. The output of NOR gate 2008 is a 0 during P11–16 time. NOR gate 2007 also produces a 0 output due to the inhibit caused by flip-flop 2005. Since there is no output pulse to set flip-flop 2009, its output is a logic 0. NOR gate 2011 generates a pulse at Z17 time to set pre-arm flip-flop 2012. This indicates that all three Vg words have been sensed and all are of the proper magnitude to allow a pre-arm signal to be generated. A negative word to be correct contains all ones in bits 11–16. If any one of these bits contains a 0, NOR gate 2007 produces an output.

If a pre-arm inhibit signal were to issue as a result of an excessive gyro signal, flip-flop 2012 would be set. As a result, flip-flop 2012 would be held reset and gate 2014 would be held in a disqualified condition. Under these conditions, pre-arm could not possibly issue. $\overline{\text{Pre-arm}}$ inhibit flip-flop 2013 is held reset before Sc time so that its state will allow the pre-arm inhibit signal to have the effect discussed. If pre-arm is inhibited by the pre-arm inhibit signal, the pre-arm indication from the not function output of flip-flop 2013 would go to a larger 0.

NOR gate 2014 has an output when the following conditions exist:

(1) Pre-arm flip-flop 2012 is set;
(2) Gimbal limit flip-flop 2013 is reset; and
(3) Tc has occurred.

The output of NOR gate 2014 is a pulse train synchronous with Pw pulses and is fed to the missile.

CUTOFF LOGIC

The cutoff signal occurs when Vgx is less than 0 and when the Tco signal has occurred. This indicates that it is the proper time to separate the motor from the re-entry body. FIG. 57 indicates the logic of this circuit 2200. A NOR gate 2201 has applied thereto a $\overline{Vgz}$, $\overline{Tco}$, $\overline{Pw}$ and $\overline{Y17}$ signal. The output of this gate is applied to a set terminal of a flip-flop 2202. The reset terminal of this flip-flop has applied thereto a $\overline{Tco}$ signal. The set terminal of the flip-flop generates the cutoff signal to the computer. The reset output terminal is fed through NOR gate 2203 along with a Pw and Tco signal, the output of which is the cutoff signal which is fed to the missile.

The cutoff signal occurs when the condition Vgx 0 is satisfied and the cutoff signal Tco has occurred. This indicates that it is the proper time to separate the motor from the re-entry body. NOR gate 2201 samples the 17th bit of the Vgx word every Y17 time and generates a pulse to set cutoff flip-flop 2202 when Tco time has occurred, and Vgx 17 contains a 1.

The initial value of Vgx (read by fire control prior to flight) is in the form of a 17-bit binary number representing velocity to be gained, and may or may not contain a 1 in the 17th bit. During flight, the value of Vgx is incrementally reduced by incoming ΔVx pulses from the PIGA until eventually the Vgx word goes beyond 0 and contains a 1 in the 17th bit. At this time, the cutoff flip-flop is set by the output of NOR gate 2201, since, by this time, a Tco signal has occurred. The cutoff signal is the output of NOR gate 2203 and is in the form of a pulse train synchronous with the Pw pulse train, and is fed to the missile.

FIRE CONTROL—AUTOPILOT CHECK

The fire control autopilot check signals allow the autopilot commands to be generated prior to Sc or To time, thus allowing the fire control to check the inverter starting mechanism. Any misalignment of these starting devices can thus be established by the fire control system and suitable predetermined signals can be sent to this portion of the computer, thus pre-aligning the steering devices prior to launch time.

Turning now to FIGS. 58*a* and *b*, logic circuitry for this portion is comprised of a flip-flop 2401 to which the ΔV's from fire control are sent. To and Pr signals are applied to the reset terminal. The output of this flip-flop is fed to inverter 2402, the output of which is applied to a NOR gate 2403 along with a $\overline{\text{P17}}$ signal. Another output from inverter 2402 is applied to a NOR gate 2404 with a $\overline{\text{P16}}$ signal. The output of this gate is fed to the set terminal of a flip-flop 2405. The reset terminal of this flip-flop has applied thereto a P13 signal. The reset output of this flip-flop feeds NOR gate 2406 which also receives a P17 signal as input thereto. A P15 signal is fed to a flip-flop 2407; the reset terminal has applied thereto a P2 signal. The set and reset terminals of this flip-flop yield a P15-1 and a $\overline{\text{P15-1}}$ signal output, respectively.

A flip-flop 2408 has a ΔV1 signal applied thereto from the fire control. The reset terminal thereof has a P15 signal applied thereto. Flip-flop 2409 has a Z17 signal applied to the set terminal and an $\overline{\text{ScP17}}$ signal applied to the reset terminal. Flip-flop 2411 has a ΔV2 signal applied to the set terminal from the fire control system and a P15 signal applied to the reset terminal. The reset output terminal of flip-flop 2408 is applied to NOR gates 2412 and 2413. The reset terminal of flip-flop 2411 is applied to the input of NOR gates 2414 and 2415 and the set output terminal of 2409 is applied to an input terminal of NOR gates 2412 to 2415. The set output of flip-flop 2407 is also applied to the input of NOR gates 2412 to 2415. NOR gates 2412 and 2415 have $\overline{\text{Y}}$ signals applied thereto and gates 2413 and 2414 have $\overline{\text{Z}}$ signals applied thereto.

The output of flip-flop 2409 allows steering commands to be sent to fire control prior to Sc time. This flip-flop is set by a Z17 pulse and inhibits gates 2412 to 2415 during X word time. The function ScP17 resets flip-flop 2409 at X17 thus enabling gates 2412 to 2415 during Y and Z word times until Z17. After Sc time, the function $\overline{\text{ScP17}}$ is no longer generated. Z17 sets the flip-flop which remains in this state and inhibits the gates. A fire control ΔV1 signal sets flip-flop 2408, enabling gates 2412 and 2413. This results in $-\Delta\psi$ and $+\Delta\theta$ to fire control. Also, a fire control ΔV2 signal sets flip-flop 2411 enabling gates 2414 and 2415 yeilding $+\Delta\psi$ and $-\Delta\theta$ to the fire control. These signals are buffered in the pitch and yaw command matching circuits so that either normal commands or fire control commands can be issued.

Only ΔVy and ΔVz signals are issued by fire control during this mode of operation. Thus, the output of gate 2403 could be a ΔV1y at X17 time, and ΔV1z at Y17 time. The output of gate 2406 could be a ΔV2y at X17 time and a ΔV2z at Y17 time. Signal P15-1 inhibits gates 2412 through 2415 so that if a ΔVz occurred after a ΔVy, an extra output during Y17 time could result from gates 2412 and 2413. The P15-1 signal generated by flip-flop 2407 prevents this action.

Thus, an incrementally wired program digital computer which solves a set of three equations simultaneously and in a real-time mode using only two adder circuits and time-sharing means to generate flight equations in real-time has been fully and completely disclosed.

Obviously many modifications and variations of the present invention are possible in the light of the above teachings. It is therefore to be understood that within the scope of the appended claims the invention may be practiced otherwise than as specifically described.

We claim:

1. A digital computer comprising:

timing means for generating bit time pulses, word time pulses so that said computer operates on a time-shared basis of M words each N bit in length;

pulses indicative of elapsed time from a start computation signal which is applied to said means from an external source;

a plurality of special pulses for use in said computer;

a decoder network having means for substantially continually sampling at least M varying signals;

means for simultaneously comparing the most recent sampling of said signals with the present sampling of said signals and generating at least M output signals indicative of changes in said signals;

and means for receiving said output signals indicative of changes and the bit timing signals from said timing means signals and generating at least M signals on a time shared basis suitable for use in said computer;

first computation circuits operatively connected to said timing means, and said decoder network;

a first binary adder operatively connected to said first computation circuits;

M serial shift register, each capable of storing N bits of information, and connected in series circuit arrangement one with the other, connected in a loop with said adder, and operatively connected to said input circuit;

means for reading M words, each N bits in length, into said registers, prior to the start of computation;

means for incrementally circulating the contents of said registers to said adder circuit which up-dates certain of said M words by a constant increment each addition and others of said words by a variable increment dependent upon an input signal received from said decoder network, and for returning said up-dated words to said registers on a time-shared basis, whereby said adder operates upon said words on a time-shared, real-time basis;

means for sensing the overflow from said adder circuit during certain of said M word times;

second computation circuits operatively connected to said timing means, decoder network and said overflow sensing means;

a second binary adder circuit operatively connected to said second computation circuits;

M serial shift registers each capable of storing N bits of information and connected in series arrangement one with the other, connected in a loop with said second adder circuit, and operatively connected to said input circuits, each of said registers having output means connected thereto;

means for reading M words, each N bit in length, into said registers prior to the start of computation;

means for incrementally circulating the contents of said registers to said adder circuit wherein said words are updated as a function of elapsed time, the outputs of said decoder network and said overflow sensing means on a time-shared, real-time basis;

third and fourth computation circuits each connected to said timing means, decoder network, first computation circuits and second computation circuits;

a full binary adder circuit connected to said third and fourth computation circuits, signals from said circuit applied as the addend to said adder;

a control register connected in a loop with said adder circuit;

means for initially reading information into said register and for incrementally shifting said information to said adder which information is the augend of said adder and shifting the sum back to said register;

means for holding a portion of the output of said adder if said sum is greater than the capacity of said register;

comparator means for substantially continually sampling the contents of said register and comparing said contents to a constant read into said means prior to flight;

means connected to said input circuit to change said constants upon receipt of a special signal from said timing circuits;

means connected to said comparator means for ;issuing command signals in response to said comparisons;

fourth and fifth computation circuits operatively connected to said timing means and said second computation circuit, which upon receipt of signals indicative of predetermined elapsed time and signals of less than a predetermined magnitude from said second computation circuits, issue output signals in response thereto.

2. A digital computer comprising:

means for generating time reference signals having
a crystal controlled oscillator circuit,
a divide-by-three circuit operatively connected to said oscillator,
synchronization means operatively connected in a loop between said oscillator and said divide-by-three circuits and having means to receive an external signal for synchronizing said oscillator with said signal,
pulse driver and generating means operatively connected to said divide-by-three circuit for generating read, write, transfer, sampling, and reset pulses for use in said computer;

means for generating bit time pulses in response to a signal from said time reference generating means and operatively connected thereto;

means for generating sets of M word time pulses in response to a signal from said bit time generator means and operatively connected thereto, said word time pulses occurring every N bit time;

a special timing circuit having
means for receiving an external signal and one of said bit time pulses occurring within one of said word times,
means responsive to said external signal and said time pulse for counting the occurrences of said pulse after receipt of said signal, thereby registering elapsed time from receipt of said special signal, means connected to said responsive means for generating a plurality of nonrecurring signals for use in said computer after a plurality of elapsed time has been registered and indicative that such times have elapsed;

a decoder network having
a first decoder circuit having
means for substantially continuously sampling a first and second wave of signals applied thereto
means connected to said last-mentioned means to store the most recent sampling of said waves
means for comparing said most recent sampling and a present sampling of said waves and for generating signals indicative of the magnitude and sense of change between said most recent and present samplings,
second and third decoder circuits for substantially continuously sampling second and third signals, respectively, applied thereto and for generating signals indicative of the sense of change of said signals,
means operatively connected to said decoders for sensing the signals from said decoders, for receiving signals from said word time generating means and for producing output signals in response thereto on a time-shared basis;
a first computation network having
means for storing, circulating and transmitting three sets of terms, on a time-shared basis, fed thereto prior to the start of operation of said computer, changing some of said terms by a fixed increment upon each cycle and changing others of said terms during each circulation at a rate determined by the output of said decoding network, each of said set of terms available as outputs during one of said word times;
a second computation network having
means for storing, circulating and transmitting a set of three terms,
means for modifying said terms on an incremental real-time time-shared basis as a fuction of the output of said first computation network the output of said decoder network;
third and fourth computation networks each having
means for storing a plurality of constants
means for receiving signals from said special timing circuits, said decoder network and said second computation network
means for summing selected ones of said received signals from said second computation circuits with selected ones of said constants upon receipt of certain of said signals from said decoder network and said special timing circuits,
means for comparing the sums generated by said last-mentioned means with selected ones of said constants and producing output signals as a result of said comparisons.

3. An inertial navigation digital guidance computer comprising:

timing means for generating reoccurring timing pulses defining word frames, each frame being three words in length, for receiving a zero time signal from a source external to said computer, for generating signals indicative of elapsed time since receipt of said zero time signal;

decoder means operatively connected to said timing means for sampling signals indicative of acceleration about a set of three orthogonal axes, for comparing the most recent sampling and the present sampling of said signals, and for generating signals indicative of acceleration about said axes on a time-shared basis;

computation means operatively connected to said decoder means and said timing means for receiving a plurality of pre-computed information, for updating said information as a function of elapsed time of flight and acceleration about said axes on a real-time, time-sharing basis.

4. The device of claim 3 wherein said computation means further comprises a digital differential analyzer having a first binary adder circuit three serial shift registers connected in series one with the other and in a loop with said adder.

5. The device of claim 4 further including steering command means operatively connected to said timing, decoder and computation means for receiving information from said last-mentioned means, for comparing said information to a set of constants, and for issuing steering commands in response to the difference between said steering commands and in response to said elapsed flight and acceleration about said axes.

6. The device of claim 5 further including generator means operatively connected to said computation means and said timing means for receiving signals from said last-mentioned means, and generating signals indicating that a predetermined time has elapsed and that said updated information signals are below a certain magnitude.

7. The device of claim 6 wherein said computation means further includes:

a second binary adder circuit a second series of three shift registers, connected in a loop with said adder circuit and operatively connected in a loop to said digital differential analyzer, said timing means and said decoder means.

8. An inertial navigation digital guidance computer comprising:

a computer clock having a crystal controlled oscillator circuit, a divide-by-three circuit operatively connected to said oscillator, a synchronization circuit operatively connected in a loop between said oscillator and said divide-by-three circuit and having an input lead for receiving a synchronization signal generated external to said computer, a pulse driver and generator circuit operatively connected to said divide-by-three circuit for generating read, write, transfer, sampling and reset pulses for use in said computer;

a bit time pulse generator operatively connected to said pulse driver and generator circuit having a 17 stage shift register, a flip-flop connected to the output of each stage of said register;

a word time generator connected to one of said flip-flops of said bit time pulse generator having delay circuitry for delaying the output of said flip-flop, and logic circuitry connected to said delay circuits for generating three recurring word pulses each 17 bits in length thereby providing a real-time base for said computer;

a functional timing circuit operatively connected to said word time generator, having an input lead for receiving a start computation pulse from a source external to said computer and a zero time pulse from a source external to said computer, a counter connected to said input circuit and enabled by the receipt of the start computation circuit and connected to said logic circuitry whereby said counter responds to a pulse thereby to count elapsed time from the receipt of the start computation circuitry, special signal generators having logic circuitry and operatively connected to said counter for generating signals after predetermined time period has elapsed, said signals designated as command time and staging correction time signals;

a decoder network operatively connected to said kit and word time generator having a first decoder circuit having a sampling circuit connected to an external source of varying signals, said signals indicative of changes in acceleration about a first of three mutually perpendicular axes, a storage circuit connected to said sampling circuit for storing the most recent sampling, a comparator circuit operatively connected to said storage and said sampling circuit for comparing the most recent and the present sampling, and a generator circuit connected to said comparator for issuing signals indicative of the magnitude and direction of increment of velocity about said first axes, a second and third decoder circuit each having a sampling circuit connected to an external source of varying signals indicative of acceleration about the second and third axes of said axes, respectively, a generator circuit connected to said sampling circuit for generating signals indicative of the sense of incremental velocity about said second and third axes, respectively, a time-sharing circuit connected to the generators of said first, second and third decoders, and said word time generator for presenting output signals from said decoders on a time-shared basis;

an input circuit for receiving a series of constants from an external source, and operatively connected to said functional timing circuit and said time-sharing circuit, a first digital differential analyzer having a first set of three series shift registers connected in series and each having a capacity of 17 bits, a first binary adder circuit connected to said input circuit and in a loop to said three shift registers, an overflow logic circuit connected to said adder;

a second computation network operatively connected to said first computation network, said decoder network and said functional timing circuit having a second digital differential analyzer having a second binary adder circuit a second set of three serial shift registers connected in series and each having a capacity of 17 bits, each having an output lead and connected in a loop with said adder, a generator circuit connected between said decoder network and said second digital differential analyzer;

third and fourth computation networks each having input circuits connected to said functional timing circuit, decoder network and second computation circuits, an enable circuit connected to said functional timing circuit for enabling said networks upon receipt of said command time signal, a full binary adder circuit connected to said input circuits, signals from said circuit applied as the addend to said adder, a control register connected in a loop with said adder circuit, means for initially reading information into said register from an external source and for incrementally shifting said information to said adder which information is the augend of said adder and shifting the sum back to said register a holding circuit connected to said adder holding a portion of the output of said adder if said sum is greater than the capacity of said register, a comparator for substantially continually sampling the contents of said register and comparing said contents to a constant read into said comparator prior to flight, a logic circuit connected to said input circuit to change said constants upon receipt of the staging correcting signal from said timing circuits, a generator connected to said comparator for issuing command signals in response to said comparisons, fourth and fifth computation circuits operatively connected to said timing means and said second computation circuit, which upon receipt of signals indicative of predetermined elapsed time and signal of less than a predetermined magnitude from said second computation network, issue output signals in response thereto.

* * * * *